US010696058B2

(12) United States Patent
Kudo et al.

(10) Patent No.: US 10,696,058 B2
(45) Date of Patent: Jun. 30, 2020

(54) LIQUID SUPPLY DEVICE, LIQUID JETTING SYSTEM, AND LIQUID JETTING DEVICE

(71) Applicant: Seiko Epson Corporation, Tokyo (JP)

(72) Inventors: Shoma Kudo, Shiojiri (JP); Naomi Kimura, Okaya (JP); Yusuke Hirasawa, Matsumoto (JP); Yuta Komatsu, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/079,417

(22) PCT Filed: Feb. 23, 2017

(86) PCT No.: PCT/JP2017/006893
§ 371 (c)(1),
(2) Date: Aug. 23, 2018

(87) PCT Pub. No.: WO2017/150342
PCT Pub. Date: Sep. 8, 2017

(65) Prior Publication Data

US 2019/0009569 A1 Jan. 10, 2019

(30) Foreign Application Priority Data

Feb. 29, 2016 (JP) ..... 2016-036516
Oct. 26, 2016 (JP) ..... 2016-209512
Oct. 27, 2016 (JP) ..... 2016-210309

(51) Int. Cl.
*B41J 2/19* (2006.01)
*B41J 2/175* (2006.01)
(Continued)

(52) U.S. Cl.
CPC ..... *B41J 2/19* (2013.01); *B41J 2/175* (2013.01); *B41J 2/1752* (2013.01);
(Continued)

(58) Field of Classification Search
CPC . B41J 2/19; B41J 2/175; B41J 2/17509; B41J 2/1752; B41J 2/17553; B41J 29/02; B41J 29/13
(Continued)

(56) References Cited

U.S. PATENT DOCUMENTS 6,976,753 B2 12/2005 Kuwabara et al.
9,254,666 B2 2/2016 Kimura et al.
(Continued)

FOREIGN PATENT DOCUMENTS

CN 202071509 U 12/2011
JP 2004-188720 A 7/2004
(Continued)

OTHER PUBLICATIONS

International Search Report dated May 16, 2017 in Int'l Appl. PCT/JP2017/006893 with English-language translation (10 pgs.).

*Primary Examiner* — An H Do
(74) *Attorney, Agent, or Firm* — Foley & Lardner LLP

(57) ABSTRACT

A liquid supply device includes a first shell having a liquid storage chamber configured to store liquid and a liquid inlet portion through which the liquid is poured to the liquid storage chamber, a second shell that is a different member from the first shell, a holding member for holding a mutual positional relationship between the first shell and the second shell to be constant, and an atmospheric communication channel that makes outside and the liquid storage chamber communicate with each other.

22 Claims, 29 Drawing Sheets

(51) Int. Cl.
*B41J 29/13* (2006.01)
*B41J 29/02* (2006.01)

(52) U.S. Cl.
CPC ..... *B41J 2/17509* (2013.01); *B41J 2/17553* (2013.01); *B41J 29/02* (2013.01); *B41J 29/13* (2013.01)

(58) Field of Classification Search
USPC ..... 347/36, 84, 85
See application file for complete search history.

(56) References Cited

U.S. PATENT DOCUMENTS

| | | | |
|---|---|---|---|
| 9,403,371 | B2 | 8/2016 | Koike et al. |
| 9,481,180 | B2 | 11/2016 | Kimura et al. |
| 9,487,012 | B2 | 11/2016 | Suzuki et al. |
| 9,493,010 | B2 | 11/2016 | Kudo et al. |
| 9,834,000 | B2 | 12/2017 | Koike et al. |
| 9,855,761 | B2 | 1/2018 | Suzuki et al. |
| 9,908,352 | B2 | 3/2018 | Kimura et al. |
| 10,040,295 | B2 * | 8/2018 | Kudo ..... B41J 2/19 |
| 10,183,495 | B2 * | 1/2019 | Kudo ..... B41J 2/19 |
| 2004/0135854 | A1 | 7/2004 | Kuwabara et al. |
| 2015/0109386 | A1 | 4/2015 | Koike et al. |
| 2015/0174907 | A1 | 6/2015 | Kimura et al. |
| 2016/0009096 | A1 | 1/2016 | Suzuki et al. |
| 2016/0009100 | A1 | 1/2016 | Kudo et al. |
| 2016/0016409 | A1 | 1/2016 | Kimura et al. |
| 2016/0318307 | A1 | 11/2016 | Koike et al. |
| 2017/0008298 | A1 | 1/2017 | Suzuki et al. |
| 2017/0096024 | A1 | 4/2017 | Kimura et al. |
| 2018/0111378 | A1 * | 4/2018 | Kudo ..... B41J 2/175 |

FOREIGN PATENT DOCUMENTS

| | | | |
|---|---|---|---|
| JP | 2011-240706 | A | 12/2011 |
| JP | 2011-240707 | A | 12/2011 |
| JP | 2015-080907 | A | 4/2015 |
| JP | 2015-116762 | A | 6/2015 |
| JP | 2015-147423 | A | 8/2015 |
| JP | 2016-000505 | A | 1/2016 |
| JP | 2017-071095 | A | 4/2017 |
| WO | WO-2014/132634 | A1 | 9/2014 |

* cited by examiner

LIQUID SUPPLY DEVICE, LIQUID JETTING SYSTEM, AND LIQUID JETTING DEVICE

CROSS-REFERENCE TO RELATED APPLICATIONS

This application is a national phase entry of PCT/JP2017/006893, filed Feb. 23, 2017; which claims priority to Japanese Appl. 2016-036516, filed Feb. 29, 2016; Japanese Appl. 2016-209512, filed Oct. 26, 2016; and Japanese Appl. 2016-210309, filed Oct. 27, 2016; the contents of all of which are incorporated by reference herein in their entirety.

FIELD

The present invention relates to a liquid supply device, a liquid jetting system, and a liquid jetting device.

BACKGROUND

Previous liquid supply devices that supply liquid to a liquid jetting head included in a liquid jetting device are known (for example, Patent Literatures 1 and 2). The previous liquid supply devices have: a liquid storage chamber that stores liquid; an atmospheric communication channel that make the liquid storage chamber and the atmosphere communicate with each other; and an air storage chamber partitioned by a partition wall in a middle of the atmospheric communication channel.

An example of the liquid jetting devices that jet liquid is an inkjet printer. As the inkjet printer, there is a so-called serial inkjet printer that includes a recording head serving as a liquid jetting part that jets ink being an example of the liquid, and includes a carriage being movable in a predetermined direction. In addition, types of the inkjet printer include an inkjet printer in which an ink storage container for storing ink is mounted in the carriage, and an inkjet printer in which the ink storage container is included in the outside of the carriage. In the inkjet printer in which the ink storage container is included in the outside of the carriage, the ink storage container and the carriage (recording head) are connected by a tube for ink supply.

For example, Patent Literature 3 discloses a configuration in which an ink storage container (tank unit) is included in a side surface of a device body, and ink is supplied to a liquid jetting head via a tube for ink supply.

CITATION LIST

Patent Literature

[Patent Literature 1] JP-A-2011-240706
[Patent Literature 2] JP-A-2011-240707
[Patent Literature 3] JP-A-2015-116762

SUMMARY

Technical Problem

In a conventional liquid supply device, a liquid storage chamber and an air storage chamber are integrally formed. The air storage chamber has an storage function of storing liquid flown out from the liquid storage chamber so that the liquid in the liquid storage chamber is prevented from flowing out to the outside through the atmospheric communication channel. The air storage chamber requires different capacity for achieving the storage function, depending on use conditions such as a liquid amount to be stored in the liquid storage chamber, and a use environment. Conventionally, when the use conditions of the liquid supply device change, and the required capacity of the air storage chamber changes, design change of the entire liquid supply device needs to be performed. Accordingly, a technique capable of easily providing a liquid supply device having an air storage chamber according to use conditions of a liquid supply device is desired.

There is a case where a flow channel included in a liquid supply device is blocked due to change of posture of the liquid supply device, or the like, and liquid cannot be stably supplied from the liquid supply device to a liquid jetting head. Accordingly, a technique capable of stably supplying liquid from a liquid supply device to a liquid jetting head is desired from before.

In order to make a tube for ink supply extend along the carriage from the ink storage container, a holding member that holds the tube not to move needs to be provided in an appropriate position. However, when a larger number of ink storage containers are arranged according to increase of ink colors, the number of holding members holding the tube also increases according to the increase of the number of the tubes, the number of members for fixing the holding member also increases, and costs increase. At the same time, the device may increase in size.

Types of the tube include, in addition to a tube connected to the ink storage container and the carriage (recording head), a tube connected to a maintenance part that performs maintenance of the recording head and a waste liquid storage container that stores waste liquid, and a tube further provided as needed. The costs increase and size increase of the device described above are not limited to a case of large number arrangement of the ink storage containers, and there are various reasons for that. There is room for further improvement in conventional ink jet printers in the point of view described above.

Thus, it is desired that a liquid jetting device in consideration with at least any of prevention of costs increase of the device and prevention of size increase of the device is provided in a configuration including a non-mobile fluid storage container.

Solution to Problem

The present invention has been performed for solving at least part of the problem described above and may be realized as embodiments described below.

(1) According to a first aspect of the present invention, a liquid supply device is provided. The liquid supply device includes: a first shell having a liquid storage chamber configured to store liquid and a liquid inlet portion through which the liquid is poured into the liquid storage chamber; a second shell that is a different member from the first shell; a holding member for holding a mutual positional relationship between the first shell and the second shell to be constant; and an atmospheric communication channel that makes the outside and the liquid storage chamber communicate with each other, the atmospheric communication channel including an air inlet port formed at a wall partitioning the liquid storage chamber, and serving as one end for leading air into the liquid storage chamber, an atmospheric opening port provided at the second shell and serving as an other end that opens outward, an air storage chamber included in the second shell and located between the atmospheric opening port and the air inlet port, and a connection channel connecting the first shell and the second shell and located between the air storage chamber and the liquid storage chamber.

According to this aspect, the first shell having the liquid storage chamber and the second shell having the air storage chamber are different members. Thereby, even when a configuration (for example, capacity) of the air storage chamber changes due to change of use conditions of the liquid supply device such as a liquid amount of the liquid storage chamber and a use environment, a configuration of the entire liquid supply device need not be changed. That is, the liquid supply device having the air storage chamber according to the use conditions can be easily provided by changing a configuration of the second shell that is different member from the first shell. Since a mutual positional relationship between the first shell and the second shell is held to be constant by the holding member, the connection chamber can be prevented from deforming due to change of posture of the liquid supply device, or the like. Thereby, air can be stably led-in from the air storage chamber to the liquid storage chamber. Thus, the liquid can be stably supplied from the liquid storage chamber to the liquid jetting head.

(2) In the aspect described above, the holding member may be a member connected to part of the first shell and part of the second shell.

According to this aspect, the mutual positional relationship between the first shell and the second shell can be held to be constant by directly connecting the first shell and the second shell by the holding member.

(3) In the aspect described above, the holding member may be a member that connects the part of the first shell and the part of the second shell so that the second shell configured to be detached from the first shell. According to this aspect, the liquid supply device having the air storage chamber according to the use conditions can be easily provided by detaching the second shell from the first shell and attaching a new second shell.

(4) In the aspect described above, the holding member may be a member for fixing the first shell and the second shell to an other member that is different from the liquid supply device.

According to this aspect, the mutual positional relationship between the first shell and the second shell can be held to be constant by fixing the first shell and the second shell to the other member by the holding member.

(5) In the aspect described above, the other member may be an accommodation member that accommodates the liquid supply device.

According to this aspect, the mutual positional relationship between the first shell and the second shell can be held to be constant by fixing the first shell and the second shell to the accommodation member by the holding member.

(6) In the aspect described above, the first shell may include an inside air storage chamber that composes part of the atmospheric communication channel, for storing the air, and is located between the air storage chamber and the air inlet port.

According to this aspect, the first shell has the inside air storage chamber so that possibility of leakage of liquid in the liquid storage chamber to the outside through the atmospheric communication channel can be reduced.

(7) In the aspect described above, in the air flow direction extending from the atmospheric opening port to the air inlet port, the air storage chamber may include a sheet member partitioning an upstream side portion and a downstream side portion, through which gas permeates and liquid does not permeate.

According to this aspect, the possibility of the leakage of the liquid in the liquid storage chamber to the outside through the atmospheric communication channel can be further reduced. Since the second shell is configured by a different member from the first shell, when the sheet member is exchanged, exchange work can be performed by detaching the second shell from the first shell. Thus, exchange of the sheet member can be easily performed.

(8) In the aspect described above, the air inlet port may be located in a region of a lower side of a vertical direction in the liquid storage chamber.

According to this aspect, even when a liquid level position of the liquid storage chamber changes, the liquid can be stably supplied to the liquid jetting head.

(9) According to a second aspect of the present invention, a liquid jetting system is provided. This liquid jetting system includes the liquid supply device of the aspect described above, the liquid jetting head, and a liquid supply flow channel that connects the liquid jetting head and the liquid supply device.

According to this aspect, since the first shell partitioning the liquid storage chamber and the second shell partitioning the air storage chamber are different members, a second shell that partitions the air storage chamber according to the use conditions of the liquid supply device such as a liquid amount of the liquid storage chamber and a use environment can be prepared so as to be a component of the liquid supply device. That is, the liquid supply device having the air storage chamber according to the use conditions can be easily provided by changing the configuration of the second shell without changing the configuration of the entire liquid supply device. Since the mutual positional relationship between the first shell and the second shell is held to be constant by the holding member, the connection channel can be prevented from deforming due to the change of the posture of the liquid supply device, or the like. Thereby, the air can be stably led from the air storage chamber into the liquid storage chamber. Thus, the liquid can be stably supplied from the liquid storage chamber to the liquid jetting head.

For example, in an aspect of the present invention, the present invention may be realized as a device including one or more of a plurality of elements of the first shell, the second shell, the holding member, and the atmospheric communication channel. That is, this device may have, or may not have the first shell. This device may have, or may not have the second shell. This device may have, or may not have the holding member. This device may have, or may not have the atmospheric communication channel. According to the various aspects, at least one of various problems such as downsizing of the device, costs reduction, energy saving, facilitation of manufacture, and improvement in usability, can be solved. Part or all of the technical features of each aspect of the liquid supply device described above can be applied to this device.

(10) According to a third aspect of the present invention, a liquid jetting device is provided. This liquid jetting device includes: a liquid jetting part having a nozzle configured to jet liquid; a non-mobile fluid storage container configured to store at least one of the liquid and gas, and does not move together with the liquid jetting part; a flow channel member connected to the fluid storage container; and a flow channel holding part that is located in an upper portion of the fluid storage container and configured to hold the flow channel member.

According to this aspect, since the flow channel holding member that can hold the flow channel member is located in an upper portion of the fluid storage container, the liquid jetting device can be prevented from increasing in size in a planer direction. Since the flow channel holding part is located in the upper portion of the fluid storage container, work can be performed from above at the time of device assembly, and workability is improved.

(11) In the aspect described above, the flow channel holding part may be included in the fluid storage container, or a container holding member holding the fluid storage container.

According to this aspect, since the flow channel holding part that can hold the flow channel member is included in the fluid storage container, or the container holding member holding the fluid storage container, as compared to the configuration in which the flow channel holding part is provided in a different place from the fluid storage container and the container holding member, the components related to the fluid such as liquid are made compact, the device can be prevented from increasing in size, or assembly work of the device is facilitated.

(12) In the aspect described above, the fluid storage container may include a first fluid storage container, and a second fluid storage container that at least partially overlaps with the first fluid storage container when plan-viewed in a height direction.

According to this aspect, the fluid storage container includes the first fluid storage container, and the second fluid storage container that at least partially overlaps with the first fluid storage container when plan-viewed in the height direction. Thus, in a configuration in which a plurality of fluid storage containers are provided, particularly, the device can be prevented from increasing in size in the planer direction.

(13) In the aspect described above, the first fluid storage container may be located upper than the second fluid storage container, the flow channel member may include a first flow channel member connected to the first fluid storage container, and a second flow channel member connected to the second fluid storage container, and at least the first flow channel member among the first flow channel member and the second flow channel member may be held above the first fluid storage container.

According to this aspect, the first fluid storage container is located upper than the second fluid storage container, the flow channel member includes the first flow channel member connected to the first fluid storage container, and the second flow channel member connected to the second fluid storage container, and at least the first flow channel member among the first flow channel member and the second flow channel member may be held above the first fluid storage container. Thus, installation work of the first flow channel member can be performed from above, and workability is facilitated.

(14) In the aspect described above, the first fluid storage container may be located upper than the second fluid storage container, the flow channel member may include a first flow channel member connected to the first fluid storage container, and a second flow channel member connected to the second fluid storage container, and the first flow channel member and the second flow channel member may be held by the flow channel holding part so as to be above the container holding member holding the first fluid storage container, so that one of the first flow channel member and the second flow channel member overlaps with the other.

According to this aspect, since the first flow channel member and the second flow channel member are held by the flow channel holding part in above the container holding member holding the first fluid storage container, installation space of the flow channel member can be prevented from expanding according to expansion of the flow channel member in a horizontal direction. Since the first flow channel member and the second flow channel member are held by the flow channel holding part so that one of the first flow channel member and the second flow channel member overlaps with the other, one flow channel member can prevent the other flow channel member from being uplifted, and as compared to a configuration in which dedicated uplift prevention members are provided in both flow channel members, the installation space of the flow channel members in the height direction can be prevented from expanding. Since the uplift of the flow channel members are prevented, interference between the liquid jetting device and other components can also be prevented.

(15) In the aspect described above, a wiring holding part that holds an electric wiring may be included in the fluid storage container or the container holding member.

According to this aspect, since the wiring holding part that holds an electric wiring is included in the fluid storage container or the container holding member, the device can be prevented from increasing in size as compared to when dedicated space for installation of the wiring holding part is secured.

(16) According to a fourth aspect of the present invention, a liquid jetting device is provided. This liquid jetting device includes: a liquid jetting part having a nozzle configured to jet liquid; a liquid tank configured to store the liquid; a connection flow channel member connected to the liquid tank, a buffer tank connected to the liquid tank by the connection flow channel member; a liquid supply channel member that supplies liquid from the liquid tank to the liquid jetting part; and a cover member that covers at least part of the liquid tank and the buffer tank, the cover member including a flow channel holding part that holds the connection flow channel member and the liquid supply channel member.

According to this aspect, since the cover member that covers at least part of the liquid tank and the buffer tank includes the flow channel holding part holding the connection flow channel member and the liquid supply channel member, as compared to a configuration in which the flow channel holding part is provided to a dedicated installation member in a different position, the components related to the liquid are made compact, the device can be prevented from increasing in size, or the assembly work of the device is facilitated.

(17) In the aspect described above, the liquid jetting device may have a waste liquid tank that collects waste liquid discharged via the nozzle of the liquid jetting part, and a waste liquid flow channel member that is connected to the waste liquid tank, and is for collecting the waste liquid, and the flow channel holding part may hold the waste liquid flow channel member.

According to this aspect, since the flow channel holding part holds the waste liquid flow channel member, the components related to the liquid are made compact, the device can be prevented from increasing in size, or the assembly work of the device is facilitated.

(18) In the aspect described above, the flow channel holding part may hold the connection flow channel member and the waste liquid flow channel member so that the connection flow channel member and the waste liquid flow channel member overlap with each other in the height direction.

According to this aspect, the flow channel holding part holds the connection flow channel member and the waste liquid flow channel member so that the connection flow channel member and the waste liquid flow channel member overlap with each other when plan-viewed in the height direction. Thus, the installation space of the flow channel member can be prevented from expanding according to expansion of the flow channel member in the horizontal direction. Since the connection flow channel member and the waste liquid flow channel member are held by the flow channel holding part so that one of the connection flow channel member and the waste liquid flow channel member overlaps with the other, one flow channel member can prevent uplift of the other flow channel member, and as compared to a configuration in which dedicated uplift prevention members are provided in both flow channel members, the installation space of the flow channel members in the height direction can be prevented from expanding. Since the uplift of the flow channel members are prevented, interference between the liquid jetting device and other components can also be prevented.

(19) In the aspect described above, the cover member may include a wiring holding part that holds an electric wiring.

According to this aspect, since the cover member includes the wiring holding part that holds an electric wiring, the device can be prevented from increasing in size as compared to when dedicated space for installation of the wiring holding part is secured.

(20) In the aspect described above, the liquid tank and the buffer tank may be arranged with an interval along a front and back direction of the liquid jetting device, and at least part of a maintenance unit that causes the liquid to be discharged from the nozzle of the liquid jetting part may be arranged in the interval.

According to this aspect, since the liquid tank, the buffer tank, and the maintenance unit are arranged along the device front and back direction, the device can be prevented from increasing in size in a right and left direction.

(21) In the aspect described above, the liquid tank and the buffer tank may be arranged along a right and left direction of the liquid jetting device.

According to this aspect, since the liquid tank and the buffer tank are arranged along the device right and left direction, the device can be prevented from increasing in size in the front and back direction.

(22) According to a fifth aspect of the present invention, a liquid jetting device is provided. This liquid jetting device includes: a liquid jetting part having a nozzle configured to jet liquid; a plurality of liquid tanks configured to store the liquid; buffer tanks connected to the plurality of liquid tanks respectively via a connection flow channel member; and a holding member that integrally holds the plurality of buffer tanks.

According to this aspect, the liquid jetting device includes: the liquid jetting part having the nozzle that can jet the liquid; the plurality of liquid tanks that can store the liquid; the buffer tanks connected to the plurality of liquid tanks respectively via the connection flow channel member; and the holding member that integrally holds the plurality of buffer tanks. Since the plurality of buffer tanks are integrally held by the holding member, components are easy to be made compact, and increase in size can be prevented.

The present invention can be realized in various aspects, and can be realized in aspects such as, in addition to the liquid supply device, the liquid jetting system, and the liquid jetting device, a manufacturing method of these devices, a manufacturing device of these devices, and an object jetted with liquid by these devices. The liquid supply device of the present invention can be performed in an aspect in which the liquid is supplied to the liquid jetting head via a sub tank, or the like.

DESCRIPTION OF EMBODIMENTS

The embodiments of the present invention will be described below with reference to the drawings. In each embodiment, the same components are added with the same reference signs, and are described only in the first embodiment, and description thereof is sometimes omitted in the embodiment thereafter.

A. First Embodiment

A-1. Configuration of Liquid Jetting System

Figure 1:
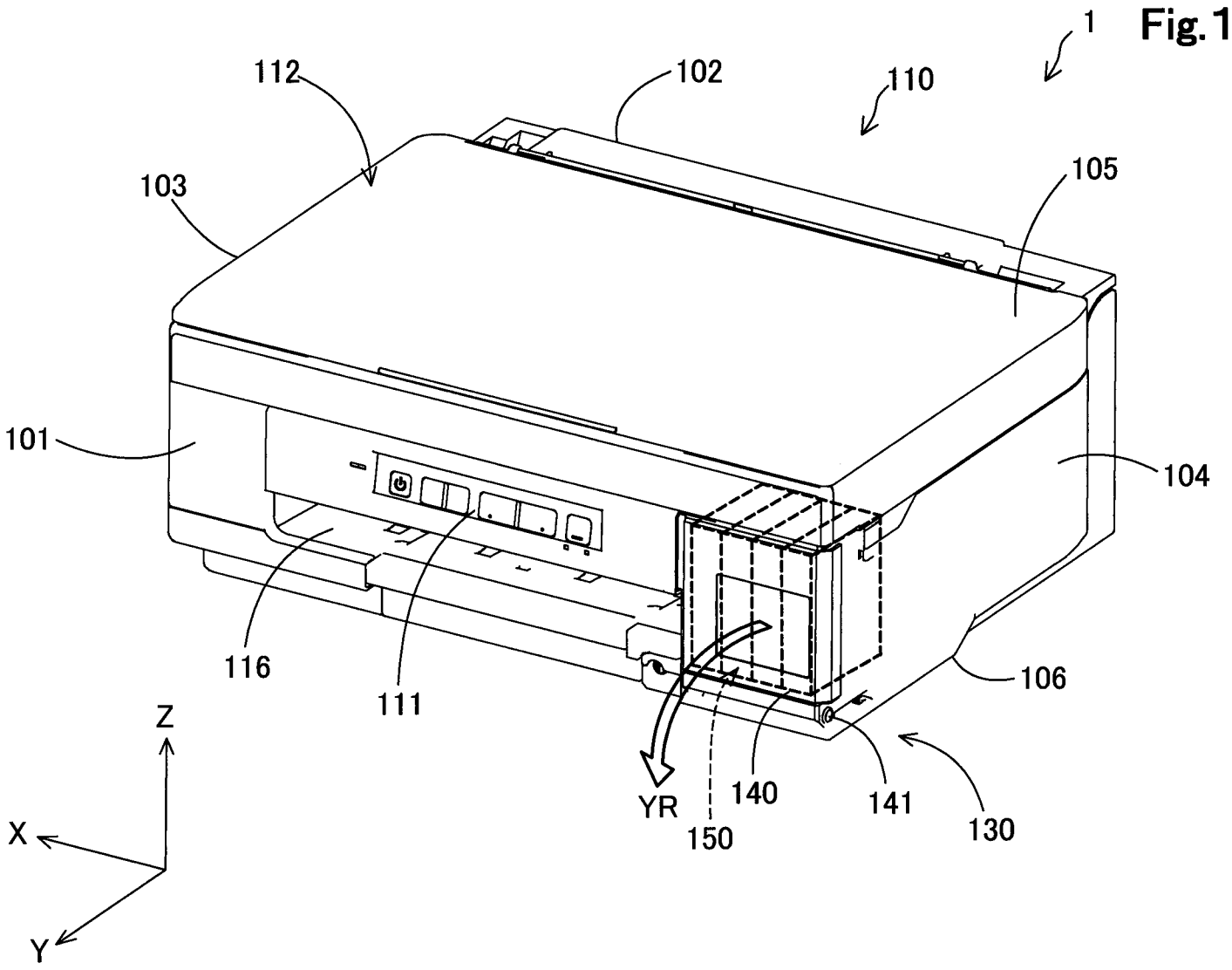
FIG. 1 is a schematic view of a liquid jetting system as a first embodiment.
Figure 2:
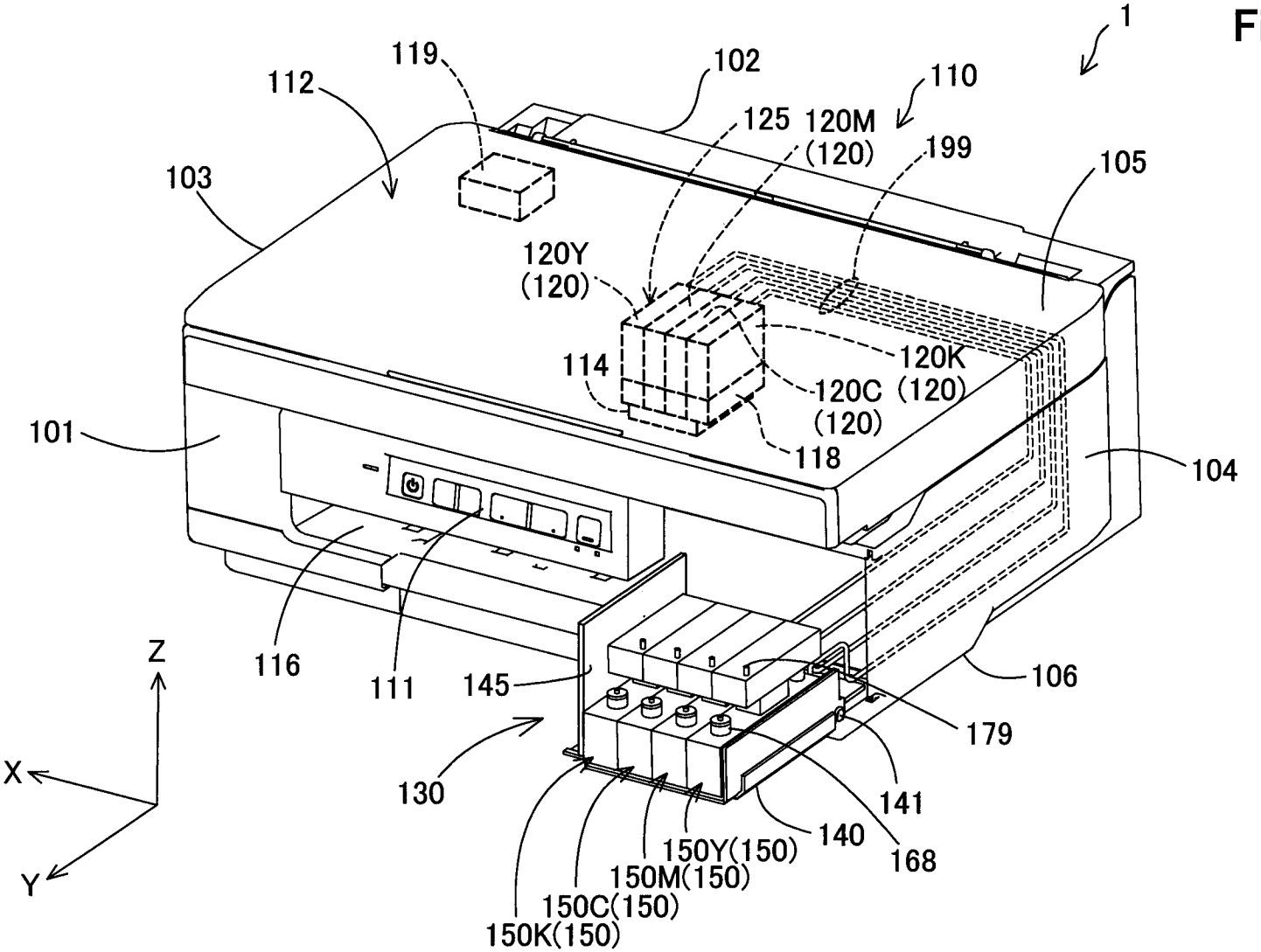
FIG. 2 is a schematic view of a liquid jetting system as the first embodiment.
Figure 3:
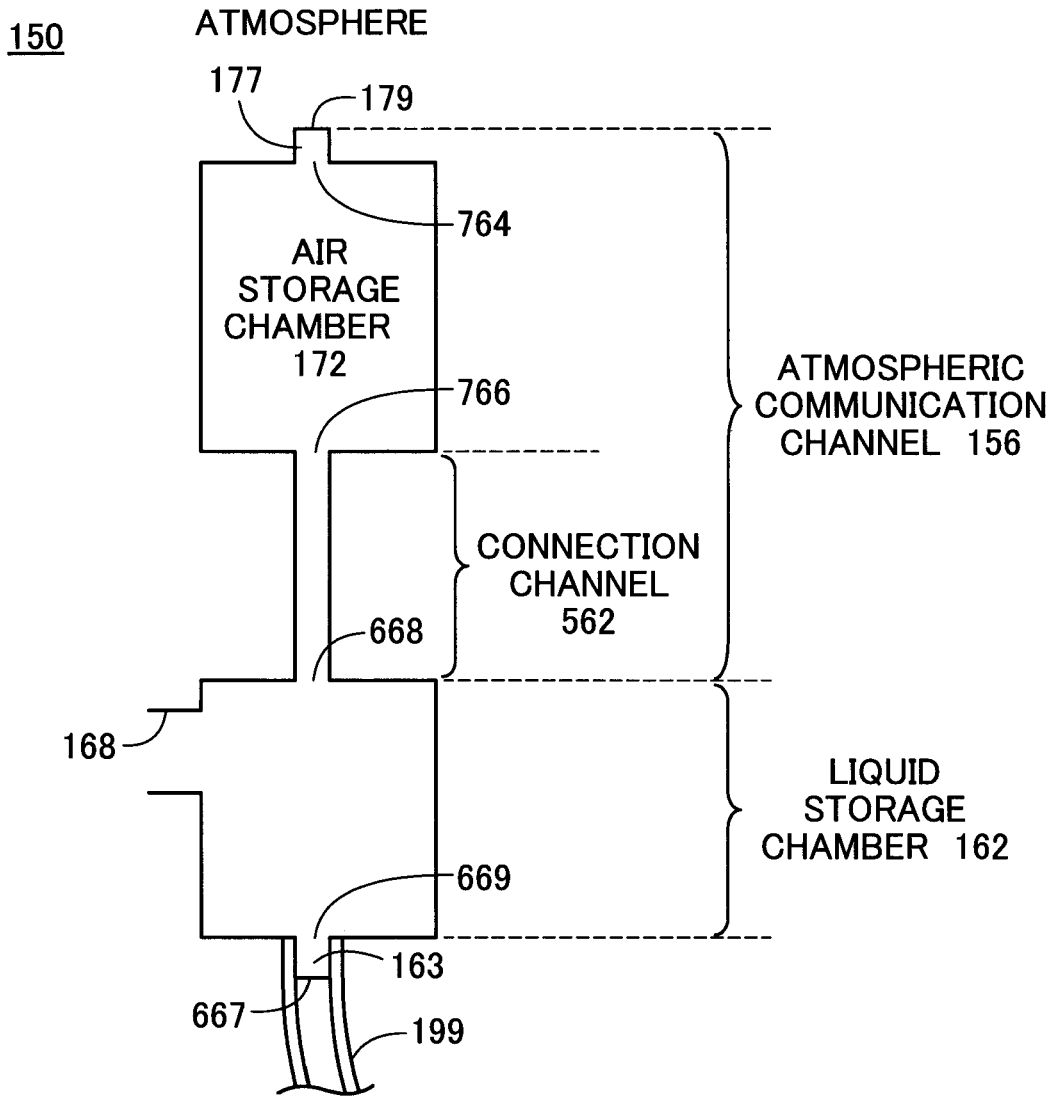
FIG. 3 is a diagram conceptually showing a route from an atmospheric opening port to a liquid outlet part.

FIG. 1 and FIG. 2 are schematic diagrams of a liquid jetting system 1 as a first embodiment of the present invention. FIG. 1 represents appearance of the liquid jetting system 1 in a use state. FIG. 2 represents part of appearance and an internal structure (dot line) in a pouring state of the liquid jetting system 1. FIG. 1 and FIG. 2 show XYZ axes that are orthogonal to each other. The X axis corresponds to a "width direction" of a printer 110. Similarly, the Y axis corresponds to a "depth direction" of the printer 110, and the Z axis corresponds to a "height direction" of the printer 110. That is, the printer 110 is installed in a horizontal installation surface that is defined by the X axis direction and the Y axis direction. In FIG. 1 and FIG. 2, a +Z axis direction (that is, an upper side of a sheet) is also referred to as a vertically upper direction, and a −Z axis direction (that is, a lower side of the sheet) is also referred to as a vertically lower direction. In FIG. 3 and drawings thereafter, the XYZ axes that are directions corresponding to FIG. 1 and FIG. 2 are shown as needed.

The liquid jetting system 1 (FIG. 2) includes the printer 110 serving as a liquid jetting device, and four liquid supply devices 150. The printer 110 is a so-called inkjet printer. The printer 110 discharges ink as liquid (droplet) on a recording medium such as a sheet, to perform printing with respect to the recording medium.

In the use state of the liquid jetting system 1, as shown in FIG. 1, the liquid supply device 150 is accommodated inside the printer 110. In the use state of the liquid jetting system 1, the printer 110 can perform printing operation. In the pouring state of the liquid jetting system 1, as shown in FIG. 2, the liquid supply device 150 is exposed to the outside of the printer 110, and a user can pour the ink into the liquid supply device 150. Hereinafter, posture of the liquid supply device 150 in the use state is also referred to as "use posture". On the other hand, posture of the liquid supply device 150 in the pouring state is also referred to as "pouring posture". Directions of a liquid inlet portion 168 included in the liquid supply device 150 are different between the use posture and the pouring posture. In the use posture, the liquid inlet portion 168 opens toward a horizontal direction, and in the pouring posture, the liquid inlet portion 168 opens toward a vertically upward. According to other embodiments, in the use posture, the liquid inlet portion 168 may open toward a direction having a horizontal direction component, and in the pouring posture, the liquid inlet portion 168 may open in a direction having a vertically upward component.

The printer 110 (FIG. 2) includes an operation panel 111, a casing 112, a discharge part 116, a control part 119, a carriage unit 125, and an accommodation member 130. The carriage unit 125 includes a carriage 118 and four sub tanks 120. The four sub tanks 120 store inks having different colors. Particularly, the four sub tanks 120 are a sub tank 120K storing a black ink, a sub tank 120C storing a cyan ink, a sub tank 120M storing a magenta ink, and a sub tank 120Y storing a yellow ink. As the ink, various types of ink such as a pigment ink and dye ink can be used. The four sub tanks 120 are mounted to the carriage 118. In this specification, when the four sub tanks 120K to 120Y are used without distinguishing the sub tanks, the reference sign "120" is used.

The casing 112 has a substantially rectangular parallelepiped shape. The casing 112 includes a front surface (first surface, first wall) 101, a rear surface (second surface, second wall) 102, a left side surface (first side surface, first side wall) 103, a right side surface (second side surface, second side wall) 104, an upper surface (third surface, third wall) 105, and a bottom surface (fourth surface, fourth wall) 106. The six surfaces 101 to 106 compose the casing 112 serving as a shell of the printer 110. The front surface 101 and the rear surface 102 face to each other. Similarly, the left side surface 103 and the right side surface 104 face to each other. The front surface 101, the rear surface 102, the left side surface 103, and the right side surface 104 are substantially perpendicular surfaces to an installation surface of the printer 110. The left side surface 103 and the right side surface 104 cross with the front surface 101 and the rear surface 102, respectively. On the other hand, the upper surface 105 and the bottom surface 106 face to each other. The upper surface 105 and the bottom surface 106 are substantially horizontal surfaces to the installation surface of the printer 110. In this specification, meaning of "substantially perpendicular" and "substantially horizontal" includes generally "perpendicular" or "horizontal", in addition to completely "perpendicular" or "horizontal". That is, each of the surfaces 101 to 106 may not be complete plan surface, may have unevenness or the like, and may be generally "perpendicular" or generally "horizontal" in its appearance.

The X axis direction described above is a direction in which the left side surface 103 and the right side surface 104 face to each other. Similarly, the Y axis direction is a direction in which the front surface 101 and the rear surface 102 face to each other. The Z axis direction is a direction in which the upper surface 105 and the bottom surface 106 face to each other.

The operation panel 111 and the discharge part 116 are provided in the front surface 101 of the casing 112. The operation panel 111 includes a plurality of buttons for operating each part of the printer 110, and a display part (LED, or the like) representing a state of the printer 110. For example, switching of power ON/OFF or the like of the printer 110 is performed by the operation of the operation panel 111. The discharge part 116 discharges the recording medium with which printing has performed.

The carriage 118 is provided inside the casing 112. The carriage 118 is movable in a main scanning direction (sheet width direction, X axis direction). This movement is performed via a timing belt (not shown) by drive of a stepping motor (not shown). A liquid jetting head 114 is included in a lower surface of the carriage 118. Ink is jetted on the recording medium such as a sheet from a plurality of nozzles included in the liquid jetting head 114, and thereby, printing is performed. Various components composing the printer 110, such as the timing belt, and the carriage 118 are accommodated inside the casing 112 to be protected. In the present embodiment, the liquid jetting head 114 is configured to be moved in the main scanning direction. However, other embodiments can be adopted. For example, the liquid jetting head 114 may be a line head extending over the entire the main scanning direction (X axis direction), of which position is fixed.

The accommodation member 130 accommodates the liquid supply device 150 inside the casing 112, in the use state. In other embodiments, the accommodation member 130 may accommodate the liquid supply device 150 in the inside, in a position outside the casing 112, in the use state. The accommodation member 130 is provided in a right side portion of the front surface 101. As shown in FIG. 2, the accommodation member 130 has a front surface case 140 that composes part of the front surface 101 and has a plate shape, and a side surface case 145 that is connected to an end portion in the +X axis direction of the front surface case 140 and has a plate shape. The front surface case 140 and the side surface case 145 are rectangular shapes. A hinge 141 for fixing the front surface case 140 in the casing 112, and making the front surface case 140 rotatable in an arrow YR direction with a lower portion of the front surface case 140, is provided in the lower portion of the front surface case 140. The liquid supply device 150 is attachably and detachably attached to the front surface case 140. The front surface case 140 is substantially perpendicular to the installation surface in the use state (use posture) shown in FIG. 1, and is substantially horizontal to the installation surface in the pouring state (pouring posture) shown in FIG. 2. When pouring ink to the liquid supply device 150, the user rotates the front surface case 140 and the side surface case 145 in an arrow YR direction shown in FIG. 1 with a hinge 141 as a fulcrum to change the posture of the liquid supply device from the use posture to the pouring posture. The user pours the ink through a liquid inlet portion 168 described later into the liquid supply device 150. The side surface case 145 is substantially perpendicular to the installation surface in the use posture and the pouring posture.

The four liquid supply devices 150 (FIG. 2) store inks corresponding to colors stored by the four sub tanks 120. That is, the liquid supply device 150K stores a black ink, the liquid supply device 150C stores a cyan ink, the liquid supply device 150M stores a magenta ink, and the liquid supply device 150Y stores a yellow ink. As the ink, various types of ink such as pigment ink and dye ink can be used. The liquid supply device 150 can store larger amount of ink than the sub tank 120. In this specification, when the four liquid supply devices 150K to 150Y are used without distinguishing the supply devices, the reference sign "150" is used.

The four liquid supply devices 150 (FIG. 2) are arranged side by side along the X axis direction. Each of the liquid supply device 150 includes a liquid inlet portion 168 for pouring the ink to the inside (a liquid storage chamber described later), an atmospheric opening port 179 that leads air into the inside according to consumption of the ink, and a liquid outlet part connected to a tube 199 described later, for leading the ink out toward the carriage unit 125.

The liquid supply devices 150 that store the inks of each color are connected to the sub tanks 120 for storing inks of corresponding colors, by tubes 199 as liquid supply flow channels. The tube 199 is formed of a member having flexibility such as a synthetic rubber. When the ink is jetted from the liquid jetting head 114, and then the ink in the sub tank 120 is consumed, the ink of the liquid supply devices 150 is supplied to the sub tanks 120 via the tube 199. The sub tanks 120 communicate with the liquid jetting head 114. Thereby, the liquid jetting system 1 can continue the printing continuously without interruption operation for a long time. As described above, the tube 199 makes the liquid jetting head 114 and the liquid supply device 150 communicate with each other. The ink may be directly supplied from the liquid supply device 150 to the liquid jetting head 114 via the tube 199 without the sub tanks 120 provided.

A-2. Overview of Liquid Supply Device:

Before the detailed configuration of the liquid supply device 150 is described, for facilitating understanding, a mechanism in which the ink is supplied from the liquid supply device 150 to the printer 110 will be described. FIG. 3 is a diagram conceptually showing a route from the atmospheric opening port 179 to the liquid outlet part 163. The "upstream" and "downstream" in the description below, are on the basis of a flow direction of air that is fluid heading from the atmospheric opening port 179 to the liquid outlet part 163.

The route (flow channel) from the atmospheric opening port 179 to the liquid outlet part 163 is roughly divided into the atmospheric communication channel 156 and the liquid storage chamber 162. The atmospheric communication channel 156 has the air inlet port 668 serving as an end connected to the liquid storage chamber 162, and the atmospheric opening port 179 that is the other end opened to the atmosphere. The liquid inlet portion 168 is formed on the liquid storage chamber 162.

The atmospheric communication channel 156 makes the outside of the liquid supply device 150 and the liquid storage chamber 162 communicate with each other. The atmospheric communication channel 156 has an atmospheric opening part 177, an air storage chamber 172, and a connection chamber 562 in order from the upstream side.

The atmospheric opening part 177 leads the atmosphere (air) in the outside into the air storage chamber 172. The atmospheric opening part 177 has an atmospheric side connection part 764 formed in one end, and an atmospheric opening port 179 formed in the other end. The atmospheric opening port 179 opens outward. The atmospheric opening port 179 forms an end (upstream end) of the atmospheric communication channel 156. The atmospheric side connection part 764 is connected to the air storage chamber 172. The atmospheric side connection part 764 is an opening through which fluid can flow. The atmospheric side connection part 764 opens in the air storage chamber 172.

The atmospheric storage chamber 172 is located between the atmospheric opening port 179 and the air inlet port 668. The atmospheric storage chamber 172 has larger flow channel cross-sectional area than the connection channel 562. The air storage chamber 172 has a predetermined capacity in order to accommodate the ink flown from the liquid storage chamber 162 to the atmospheric communication channel 156 to prevent the ink from flowing into the atmospheric opening port 179 side. The volume of the air storage chamber 172 may be a volume that is a flowing-in amount or more by calculating an amount of flowing (flowing-in amount) of the ink in the liquid storage chamber 162 to the atmospheric communication channel 156 side on the basis of the use conditions with which the liquid supply device 150 is used. The use conditions are an amount of ink accommodated in the liquid storage chamber 162, and an amount of change in temperature and an amount of change in atmospheric pressure that are assumed under an environment in which the liquid supply device 150 is arranged.

The connection channel 562 connects the air storage chamber 172 and the liquid storage chamber 162. The connection channel 562 has an air side connection port 766 formed in an upstream end, and an air inlet port 668 formed in a downstream end. The connection channel 562 leads the air in the air storage chamber 172 into the liquid storage chamber 162 according to consumption of the ink of the liquid storage chamber 162. In the use posture, a liquid level that directly contacts with the atmosphere is formed in the air inlet port 668, the air (air bubble) is led from the air inlet port 668 into the ink in the liquid storage chamber 162, and thereby, the air is led into the liquid storage chamber 162. That is, the air inlet port 668 forms an end of the atmospheric communication channel 156 for leading the air into the liquid storage chamber 162. It is preferable that the connection channel 562 including the air inlet port 668 has a small flow channel cross-sectional area in an extent with which meniscus can be formed.

The liquid storage chamber 162 can accommodate the ink to be supplied to the liquid jetting head 114. The liquid storage chamber is connected to the liquid outlet part 163. The liquid outlet part 163 is a portion connected with the tube 199. An end 667 of the liquid outlet part 163 opens outward, and the other end 669 opens in the liquid storage chamber 162. The ink in the liquid storage chamber 162 is supplied to the liquid jetting head 114 via the liquid outlet part 163 and the tube 199. In an unused state that is before the liquid supply device 150 is connected to the tube 199 (FIG. 2), the one end 667 is sealed by a film that can be peeled, or the like.

The ink can be poured into the liquid storage chamber 162 through the liquid inlet portion 168. The liquid inlet portion 168 is a cylindrical member, one end of the liquid inlet portion 168 is connected to the liquid storage chamber 162, and the other end opens outward. A stopper is attachably and detachably attached to the other end of the liquid inlet portion 168 in the use state. When pouring the ink into the liquid storage chamber 162, the user detaches the stopper from the liquid inlet portion 168.

The route described above is only an example, and various modifications can be performed. For example, a connection member that connects a flow channel and a flow channel, a moisture permeable waterproof member (for example, a gas and liquid separation film) for preventing liquid from flowing in the upstream, and the like may be provided in a middle of the atmospheric communication channel 156. Other routes not described above may be further provided in the route from the atmospheric opening port 179 to the liquid outlet part 163.

Figure 4:
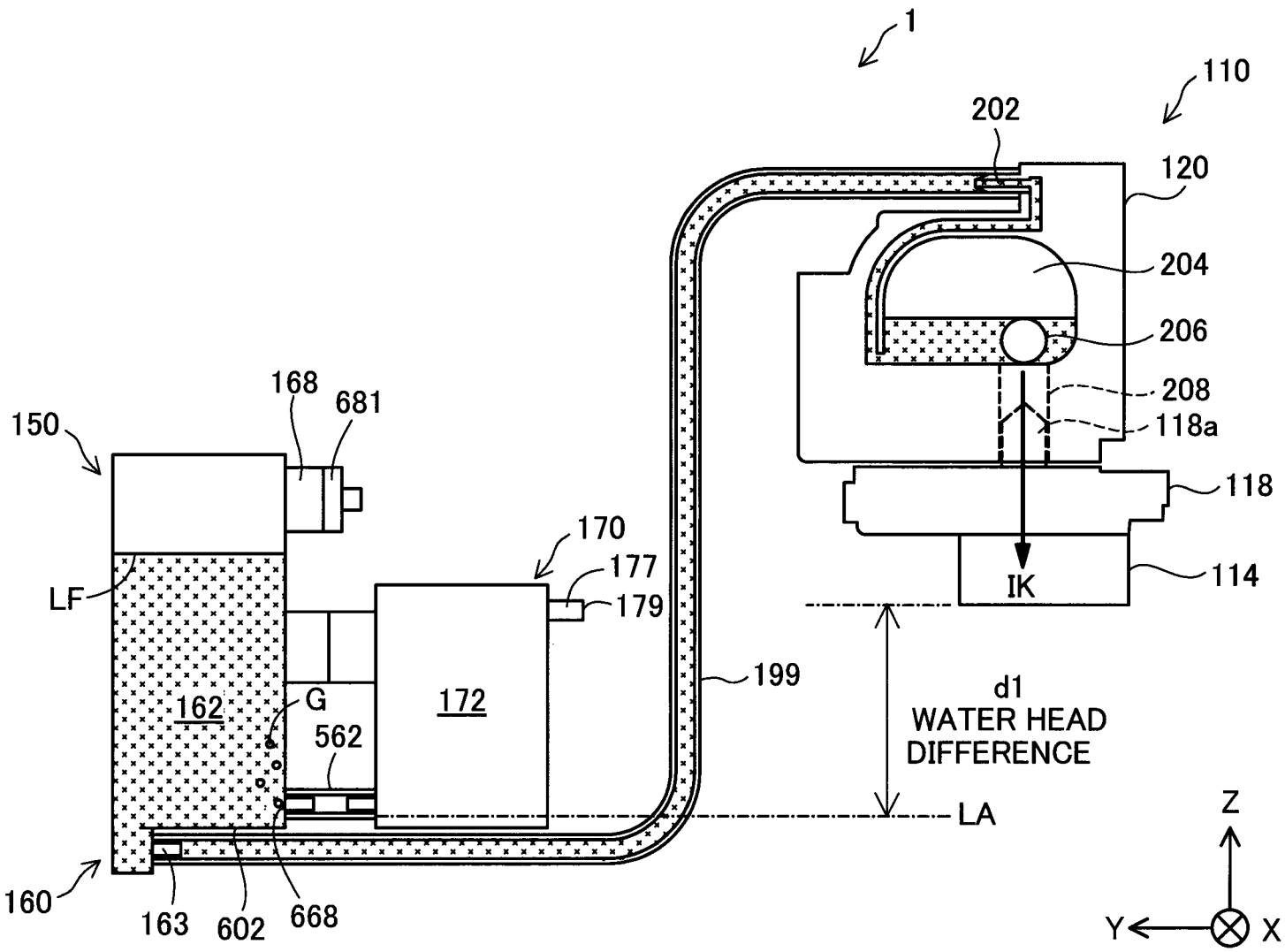
FIG. 4 is a diagram for explaining a principle of ink supply.

For further facilitating understanding, a principle of supply of the ink by the liquid supply devices 150 to the sub tanks 120 will be described with reference to FIG. 4. FIG. 4 is a diagram for explaining the principle of supply of the ink by the liquid supply devices 150 to the sub tanks 120. FIG. 4 shows a schematic diagram of the liquid supply device 150 of when the liquid supply device 150 in the use posture is viewed from the −X axis direction side. FIG. 4 schematically shows an inside situation of the tube 199 and the carriage unit 125.

The liquid supply device 150 of the present embodiment supplies the ink to the printer 110 by utilizing a principle of Mariotte's bottle.

The liquid outlet part 163 of the liquid supply device 150 and the liquid receiving part 202 of the sub tank 120 are connected via the tube 199. The sub tank 120 is molded by a synthetic resin such as polyethylene and polyethylene. The sub tank 120 includes a liquid reservoir chamber 204, a liquid flowing channel 208, and a filter 206. A liquid supply needle 118*a* of the carriage 118 is inserted to the liquid flowing channel 208. When an impurity such as a foreign substance is mixed in the ink, the filter 206 captures the impurity to prevent the impurity from flowing into the liquid jetting head 114. The ink in the liquid reservoir chamber 204 flows through the liquid flowing channel 208 and the liquid supply needle 118*a* by suction from the liquid jetting head 114, to the liquid jetting head 114. The ink supplied to the liquid jetting head 114 is jetted to the outside (recording medium) via the nozzle.

When, after the ink is poured from the liquid inlet portion 168 into the liquid storage chamber 162 in the pouring posture, the liquid inlet portion 168 is sealed with a stopper 681 and the posture is changed to the use posture, the air in the liquid storage chamber 162 increases and the liquid storage chamber 162 has a negative pressure. The ink in the liquid storage chamber 162 is sucked from the liquid jetting head 114 so that the liquid storage chamber 162 is maintained to have a negative pressure.

In the use posture, the air inlet port 668 is located in a region in a lower side of the vertical direction in the liquid storage chamber 162. That is, in the use posture, the air inlet port 668 is provided in a position that is a middle or lower than a height of the liquid storage chamber 162 in the Z axis direction. In the present embodiment, the air inlet port 668 is formed near a wall 602 composing the bottom surface of the liquid storage chamber 162. Thereby, even when the ink of the liquid storage chamber 162 is consumed, and a liquid level LF of the liquid storage chamber 162 is lowered, a liquid level (atmospheric contact level surface) LA that directly contacts with the atmosphere is maintained to be a constant height for a long time. In the use posture, the air inlet port 668 is arranged so as to be in a lower position than the liquid jetting head 114.

When the ink in the liquid reservoir chamber 204 is sucked by the liquid injection head 114, the liquid reservoir chamber 204 has a predetermined negative pressure or higher. When the liquid reservoir chamber 204 has a predetermined negative pressure or higher, the ink in the liquid storage chamber 162 is supplied to the liquid reservoir chamber 204 via the tube 199. That is, the ink for the amount flown out to the liquid jetting head 114 is automatically replenished from the liquid storage chamber 162 to the liquid reservoir chamber 204. In other words, when a suction force (negative pressure) from the printer 110 side becomes larger to some extent than a water head difference d1 generated by a height difference in the vertical direction between an ink liquid level (atmospheric contact liquid level) LA and the liquid jetting head 114, the ink is supplied from the liquid storage chamber 162 to the liquid reservoir chamber 204.

When the ink in the liquid storage chamber 162 is consumed, the air in the air storage chamber 172 is led in the liquid storage chamber 162 via the connection channel 562, as air bubbles G. Thereby, the liquid level of the liquid storage chamber 162 is lowered. On the other hand, since the height of the atmospheric contact liquid level LA that directly contacts with the atmosphere is maintained to be constant, the water head difference d1 is maintained to be constant. That is, the ink can be stably supplied from the liquid supply device 150 to the liquid jetting head 114 by a predetermined suction force of the liquid jetting head 114.

Figure 5:
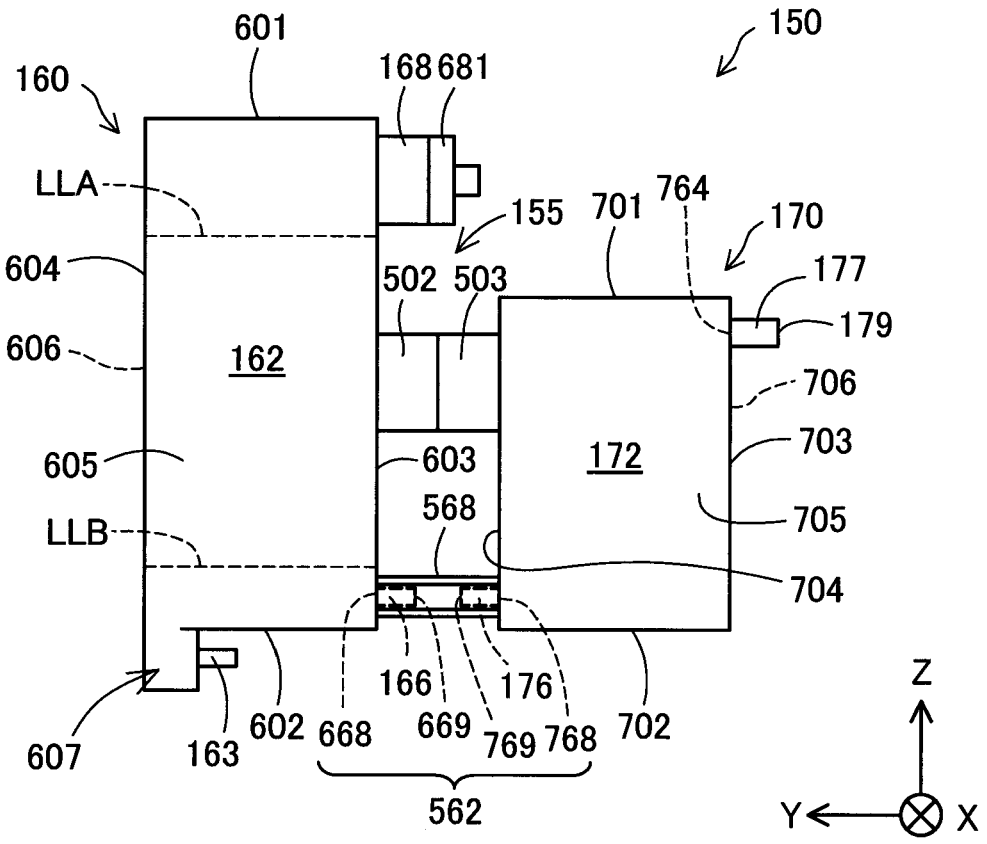
FIG. 5 is a schematic diagram of a liquid supply device.

A-3. Configuration of liquid supply device:

FIG. 5 is a schematic diagram of the liquid supply device 150. FIG. 5 shows the XYZ axis in the use state. The liquid supply device 150 includes a first shell 160, a second shell 170 that is different member from the first shell 160, a holding member 155, and a connection channel 562.

An outer shape of the first shell 160 is a substantially rectangular parallelepiped shape. The first shell 160 forms part of an outer surface of the liquid supply device 150. The first shell 160 has the liquid storage chamber 162 that can store the ink, and the liquid inlet portion 168 through which the ink is poured into the liquid storage chamber 162. In the present embodiment, the liquid storage chamber 162 is partitioned by the first shell. The first shell 160 is integrally formed by a synthetic resin such as polypropylene. In the other embodiments, the first shell 160 may be formed of an integrally formed synthetic resin that has a concaved shape and a film that seals an opening having the concaved shape. The first shell 160 may be formed by combination of a plurality of members.

The first shell 160 is translucent or transparent so that the liquid level of the liquid storage chamber 162 can be visually recognized from outside. In the other embodiments, in the first shell 160, the first shell 160, part of a wall part forming partition of the liquid storage chamber 162 may be translucent or transparent so that a state of the ink in the liquid storage chamber 162 can be checked from outside in the use posture and the pouring posture. In the other embodiment, the first shell 160 may not be translucent or transparent. In this case, it is preferable that a sensor mechanism for detecting a liquid residual amount is arranged in the liquid storage chamber 162. Examples of the sensor mechanism include a mechanism such as a pair of electrodes, a prism, and a piezoelectric vibrator in which signals to be output are different between a state being immersed in the ink and a state not being immersed in the ink.

The first shell 160 is formed of a first liquid storage wall (first liquid storage chamber surface) 601, a second liquid storage chamber wall (second liquid storage chamber surface) 602, a third liquid storage chamber wall (third liquid storage chamber surface) 603, a fourth liquid storage chamber wall (fourth liquid storage chamber surface) 604, a fifth liquid storage chamber wall (fifth liquid storage chamber surface) 605, a sixth liquid storage chamber wall (sixth liquid storage chamber surface) 606, and a corner portion 607. The first shell 160 having a substantially rectangular parallelepiped shape is formed of the first to sixth liquid storage chamber walls 601 to 606 and the corner part 607. The sixth liquid storage chamber wall 606 is a wall located in a depth side of a sheet, and is hidden by the fifth liquid storage chamber wall 605 in FIG. 5.

The first liquid storage chamber wall 601 and the second liquid storage chamber wall 602 face to each other. The third liquid storage chamber wall 603 and the fourth liquid storage chamber wall 604 face to each other. The fifth liquid storage chamber wall 605 and the sixth liquid storage chamber wall 606 face to each other. The corner part 607 is a wall part projecting outward from a portion in the fourth liquid storage chamber wall 604 side in the second liquid storage chamber wall 602. In the use posture, the corner part 607 projects from the second liquid storage chamber wall 602 to a vertically lower side. In this specification, "facing" is a concept including a mode in which members directly face to each other without other member arranged therebetween, and a mode in which the other member is arranged therebetween. The third liquid storage chamber wall 603 to the sixth liquid storage chamber wall 606 cross with the first liquid storage chamber wall 601 and the second liquid storage chamber wall 602. In this specification, "crossing" of two elements (for example, a wall or a surface) means any state of a state where two elements actually cross with each other, a state where, one element is extended, the one element crosses with the other element, and a state where when both are extended, extended portions cross with each other.

In the use posture, the first liquid storage chamber wall 601 composes the upper surface of the liquid storage chamber 162, and the second liquid storage chamber wall 602 composes the bottom surface of the liquid storage chamber 162. In the use posture, the third to sixth liquid storage chamber walls 603 to 606 compose the side surface of the liquid storage chamber 162.

In the pouring posture, the third liquid storage chamber wall 603 composes the upper surface of the liquid storage chamber 162, and the fourth liquid storage chamber wall 604 composes the bottom surface of the liquid storage chamber 162. In the pouring posture, the first, second, fifth, sixth liquid storage chamber walls 601, 602, 605, 606 compose the side surface of the liquid storage chamber 162.

One end of the liquid inlet portion 168 is connected to the liquid storage chamber 162, and the other end opens outward. In the use posture, the liquid inlet portion 168 opens toward the horizontal direction. The liquid inlet portion 168 is a cylindrical member projecting from the third liquid storage chamber wall 603. In the present embodiment, the liquid inlet portion 168 is provided in a side closer to the first liquid storage chamber wall 601 than the second liquid storage chamber wall 602 in the third liquid storage chamber wall 603.

The liquid supply device 150 has a first shell side flow channel part 166 forming part of the connection channel 562. The first shell side flow channel part 166 is a cylindrical member projecting outward from the third liquid storage chamber wall 603. The first shell side flow channel part 166 is formed by integral molding with the first shell 160. One end 668 of the first shell side flow channel part 166 opens in the liquid storage chamber 162, and the other end 669 of the first shell side flow channel part 166 opens outward. The first shell side flow channel part 166 projects from near the second liquid storage chamber wall 602 in the third liquid storage wall 603. The first shell side flow channel part 166 is connected with one end part of a connection forming member 568 described later. The one end 668 of the first shell side flow channel part 166 is the air inlet port 668 described above. The air inlet port 668 is formed in a wall (the third liquid storage wall 603) that partitions the liquid storage chamber 162 in the first shell 160.

In an upper limit amount of the ink immediately after the ink is poured into the liquid storage chamber 162, the ink is stored up to an upper limit line LLA shown by a dot line. In a lower limit amount of the ink in the liquid storage chamber 162 of when the ink of the liquid storage chamber 162 is consumed, the ink level reaches a lower limit line LLB shown by a dot line. The upper limit amount of the ink is an amount of when the ink is poured by a time point determined by a mark or the like formed in the liquid storage chamber 162 when the user pours ink from the liquid inlet port 58. In the present embodiment, the upper limit amount of the ink is set to an extent in which the liquid level of the ink is located in slightly lower side of the liquid inlet port 68 when the posture is changed from the pouring posture to the use posture. The lower limit amount of the ink is an amount of when the ink pouring determined by a mark or the like formed in the liquid storage chamber 162 is required, in the use posture. In the present embodiment, the lower limit amount of the ink is set to an amount of an extent in which the liquid level of the ink is located in a slightly upper side from the air inlet port 668 and the liquid outlet part 163 in the use posture.

The outer shape of the second shell 170 is a substantially rectangular parallelepiped shape. The second shell 170 forms part of the outer surface of the liquid supply device 150. The second shell 170 has an air storage chamber 172. In the present embodiment, the air storage chamber 172 is partitioned by the second shell 170. The second shell 170 is integrally molded by a synthetic resin such as polypropylene. The second shell 170 is attachably and detachably connected to the first shell 160. In the other embodiment, the second shell 170 may be formed by an integrally molded synthetic resin having a concaved shape, and a film that seals an opening having the concaved shape. The second shell 170 may be formed by combination of a plurality of members.

The second shell 170 may be translucent or transparent so that the inside can be recognized from outside, or may not be translucent or transparent.

The second shell 170 is formed of a first liquid storage wall (first liquid storage chamber surface) 701, a second liquid storage chamber wall (second liquid storage chamber surface) 702, a third liquid storage chamber wall (third liquid storage chamber surface) 703, a fourth liquid storage chamber wall (fourth liquid storage chamber surface) 704, a fifth liquid storage chamber wall (fifth liquid storage chamber surface) 705, and a sixth liquid storage chamber wall (sixth liquid storage chamber surface) 706. The second shell 170 having a substantially rectangular parallelepiped shape is formed of the first to sixth liquid storage chamber walls 701 to 706. The sixth liquid storage chamber wall 706 is a wall located in a depth side of a sheet, and is hidden by the fifth liquid storage chamber wall 705 in FIG. 5.

The first air storage chamber wall 701 and the second air storage chamber wall 702 face to each other. The third air storage chamber wall 703 and the fourth air storage chamber wall 704 face to each other. The fifth air storage chamber wall 705 and the sixth air storage chamber wall 706 face to each other. The third air storage chamber wall 703 to the sixth air storage chamber wall 706 cross with the first air storage chamber wall 701 and the second air storage chamber wall 702.

In the use posture, the first air storage chamber wall 701 composes the upper surface of the air storage chamber 172, and the second air storage chamber wall 702 composes the bottom surface of the air storage chamber 172. In the use posture, the third to sixth air storage chamber walls 703 to 706 compose the side surface of the air storage chamber 172.

In the pouring posture, the third air storage chamber wall 703 composes the upper surface of the air storage chamber 172, and the fourth air storage chamber wall 704 composes the bottom surface of the air storage chamber 172. In the pouring posture, the first, second, fifth, sixth air storage chamber walls 701, 702, 705, 706 compose the side surface of the air storage chamber 172.

The atmospheric opening part 177 is a cylindrical member. The atmospheric opening part 177 is arranged in a position closer to the first air storage chamber wall 701 than the second air storage chamber wall 702 in the third air storage chamber wall. In the present embodiment, the atmospheric opening part 177 is arranged near the first air storage chamber wall 701 in the third air storage chamber wall 703. The shape of the atmospheric opening part 177 is not limited to a cylindrical shape. For example, the atmospheric opening part 177 may be a through hole formed in the third air storage chamber wall 703. A formation position of the atmospheric opening part 177 is not limited to the third air storage chamber wall 703, and may be, for example, other wall such as the first air storage chamber wall 701. As described above, the atmospheric opening part 177 including the atmospheric opening port 179 is provided in the second shell 170.

The liquid supply device 150 has a second shell side flow channel part 176 forming part of the connection channel 562. The second shell side flow channel part 176 is a cylindrical member projecting outward from the fourth air storage chamber wall 704. The second shell side flow channel part 176 is formed by integrally molding with the second shell 170. One end 768 of the second shell side flow channel part 176 opens in the air storage chamber 172, and the other end 769 of the second shell side flow channel part 176 opens outward. The second shell side flow channel part 176 projects from near the second air storage chamber wall 702 in the fourth air storage chamber wall 704. The second shell side flow channel part 176 is connected with the other end part of a connection forming member 568 described later.

The connection forming member 568 is a tube having flexibility. One end portion of the connection forming member 568 is detachably connected to the first shell side flow channel part 166, and the other end part is detachably connected to the second shell side flow channel part 176. The connection channel 562 is composed of the first shell side flow channel part 166, the connection forming member 568, and the second shell side flow channel part 176. As described above, the connection channel 562 connects the first shell 160 and the second shell 170. The connection channel 562 is located between the air storage chamber 172 and the liquid storage chamber 162 in an air flow direction.

The holding member 155 holds a mutual positional relationship between the first shell 160 and the second shell 170 to be constant. The holding member 155 couples the first shell 160 and the second shell 170. The holding member 155 is a member that connects part of the first shell 160 and part of the second shell. The holding member 155 is configured so that the second shell 170 can be detached from the first shell 160.

The holding member 155 has a first holding member 502 and a second holding member 503. The first holding member 502 is a hook and loop fastener attached to the second shell 170. In the present embodiment, the second holding member 503 is attached to the fourth air storage chamber wall 704 facing with the third liquid storage chamber wall 603. The first holding member 502 and the second holding member 503 are bonded with each other so as to be able to be peeled. When the first holding member 502 is peeled off from the second holding member 503, coupling of the second shell 170 from the first shell 160 can be released. That is, the holding member 155 is configured so that the first shell 160 can be detached from the second shell 170.

A-4. Effect:

According to the embodiment described above, the first shell 160 having the liquid storage chamber 162 and the second shell 170 having the air storage chamber 172 are different members (FIG. 5). Thereby, even when the use conditions of the liquid supply device 150 such as the ink amount and the use environment of the liquid storage chamber 162 is changed, and a configuration (for example, volume) of the air storage chamber 172 is changed, the configuration of the entire liquid supply device 150 need not be changed. That is, the liquid supply device 150 having the air storage chamber 172 according to the use condition can be easily provided by changing the configuration of the second shell 170 that is a different member from the first shell 160, and connecting the second shell 170 after the change (that is, a new second shell 170) to the first shell 160.

Figure 6:
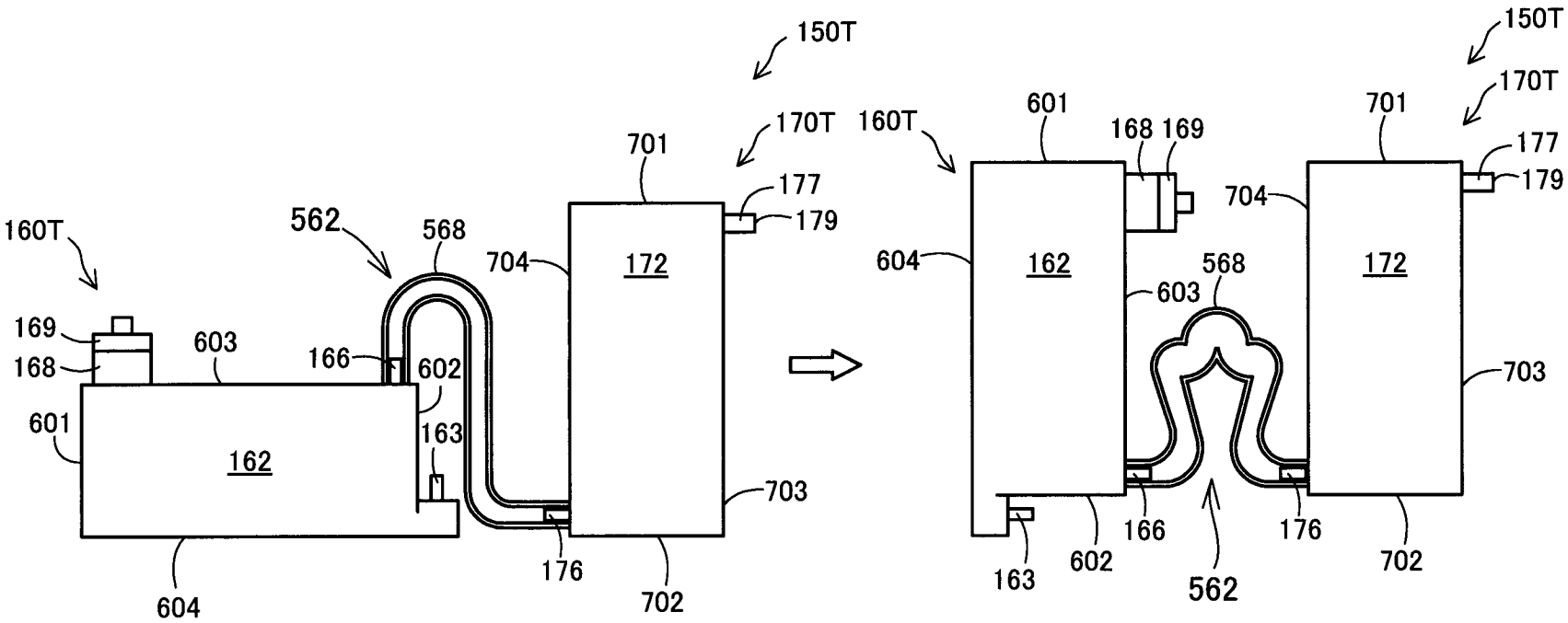
FIG. 6 is a diagram for explaining a liquid supply device of a reference example.

FIG. 6 is a diagram for explaining a liquid supply device 150T of a reference example. The left diagram of FIG. 6 is a diagram of the liquid supply device 150T in the pouring posture, and the right diagram is a diagram of the liquid supply device 150T in the use posture. Difference between the liquid supply device 150T of the reference example and the liquid supply device 150 of the first embodiment described above is that the liquid supply device 150T does not have the holding member 155, and that the second shell 170 take the same posture in the pouring posture and the use posture. Since other components are similar, similar component is added with the same reference signs and description thereof is omitted.

Since the liquid supply device 150T does not have the holding member 155, the mutual positional relationship between the first shell 160 and the second shell 170 is not maintained to be constant. That is, the first shell 160 and the second shell 170 can be independently moved. For example, in the use posture and the pouring posture, only the posture of the first shell 160 that partitions the liquid storage chamber 162, and the posture of the second shell 170 that partitions the air storage chamber 172 does not change. In this case, by repetition of the change of the two postures of the use posture and the pouring posture, the connection forming member 568 composing the connection channel 562 may tangle, or may be sandwiched by other member (for example, the first shell 160, the second shell 170, and the casing 112 shown in FIG. 1). Thereby, there is a case where the connection forming member 568 bends having a small curvature that is not assumed, or is crushed to deform largely, and air supply from the air storage chamber 172 to the liquid storage chamber 162 via the air inlet port 668 cannot be performed smoothly. Thereby, there is a case where air inlet to the liquid storage chamber 162 can be performed according to the consumption of the ink of the liquid storage chamber 162, and the ink supply from the liquid storage chamber 162 to the liquid injection head 114 cannot be stably performed.

According to the first embodiment, the mutual positional relationship between the first shell 160 and the second shell 170 can be held to be constant by the holding member 155. Thereby, the connection channel 562 can be prevented from deforming due to the change of the posture of the liquid supply device 150, and the like. Thereby, since the air can be stably led from the air storage chamber 172 into the liquid storage chamber 162, the ink can be stably supplied from the liquid storage chamber 162 to the liquid jetting head.

According to the first embodiment, the holding member 155 is a member connected to part of the first shell 160 and part of the second shell 170 (FIG. 5). Thereby, since the first shell 160 and the second shell 170 are directly connected by the holding member 155, the mutual positional relationship between the first shell 160 and the second shell 170 can be held to be constant.

According to the first embodiment described above, the holding member 155 is a member connected to part of the first shell 160 and part of the second shell 170 so that the first shell 160 and the second shell 170 can be detached (FIG. 5). Thereby, the liquid supply device 150 having the air storage chamber 172 according to the use conditions can be easily provided by detaching the second shell 170 from the first shell 160 and attaching a new second shell 170.

A-5. Modification of Holding Member 155:

In the first embodiment described above, the holding member 155 has the first holding member 502 and the second holding member 503 serving as a hook and loop fastener. However, the holding member 155 is not limited to the hook and loop fastener as long as the holding member 155 is a member that holds the mutual positional relationship between the first shell 160 and the second shell 170 to be constant.

A-5-1. Modification of First Type:

A modification of the holding member connected to part of the first shell 160 and part of the second shell 170 so that the second shell 170 can be detached from the first shell 160 will be described below.

Figure 7:
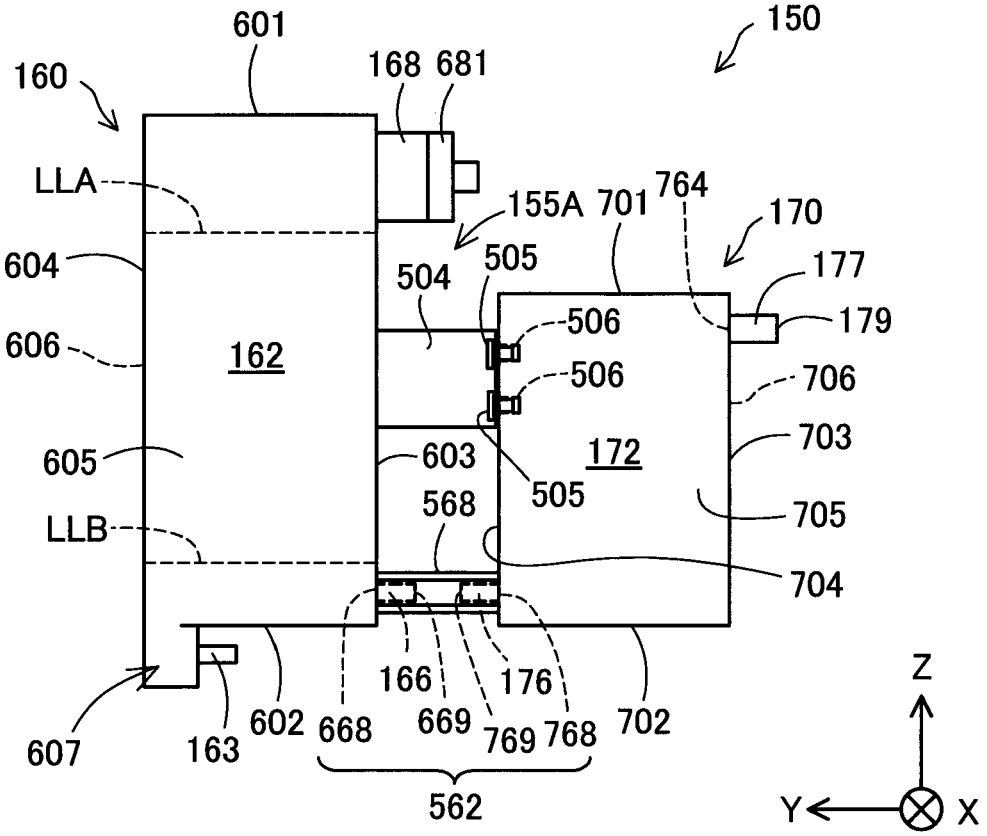
FIG. 7 is a diagram for explaining a holding member of a modification.

FIG. 7 is a diagram for explaining a holding member 155A of the modification. The holding member 155A may be a screw mechanism. The holding member 155A has a bracket 504, two screws 505, and two screw holes 506. The bracket 504 is attached to the first shell 160. The bracket 504 has a plate shape member that faces to the fourth air storage chamber wall 704, and a through hole through which the screw 505 is inserted is formed in the plate shape member. The screw hole 506 in which the screw 505 is tightened is formed in the fourth air storage chamber wall 704. The first shell 160 and the second shell 170 are coupled by tightening the screw 505 to the screw hole 506 in a state where the screw 505 is inserted through the through hole of the bracket 504. Thereby, the mutual positional relationship between the first shell 160 and the second shell 170 can be held to be constant. The second shell 170 can be detached from the first shell 160 by detaching the screw 505 from the screw hole 506.

In another embodiment, the holding member 155 may be an adhesive. Particularly, the first shell 160 and the second shell 170 may be connected by the adhesive that can be peeled by heating or the like.

The holding member 155 may be a mechanism using a snap-fitting of fixing the first shell 160 and the second shell 170 by fitting utilizing elasticity of a material. For example, the first member that elastically deforms, and has a claw part may be attached to the third liquid storage chamber wall 603, and a fitting part to which the claw part is fit may be provided in the fourth air storage chamber wall 704.

The holding member 155 may be a magnet. A first magnet may be arranged in the third liquid storage chamber wall 603, and a second magnet may be arranged in a position facing with the first magnet in the fourth air storage chamber wall 704. The first magnet and the second magnet are arranged so that different poles face to each other. The holding member 155 may be a double-sided tape for adhering part of the first shell 160 and part of the second shell 170.

A-5-2. Second Type Modification of Holding Member:

In the first embodiment and the first type modification, the holding members 155, 155A are members that directly connect part of the first shell 160 and part of the second shell 170. However, the holding members are not limited thereto, and may be a member that fixes the first shell 160 and the second shell 170 to the other member that is different from the liquid supply device 150. A specific example of this will be described below.

Figure 8:
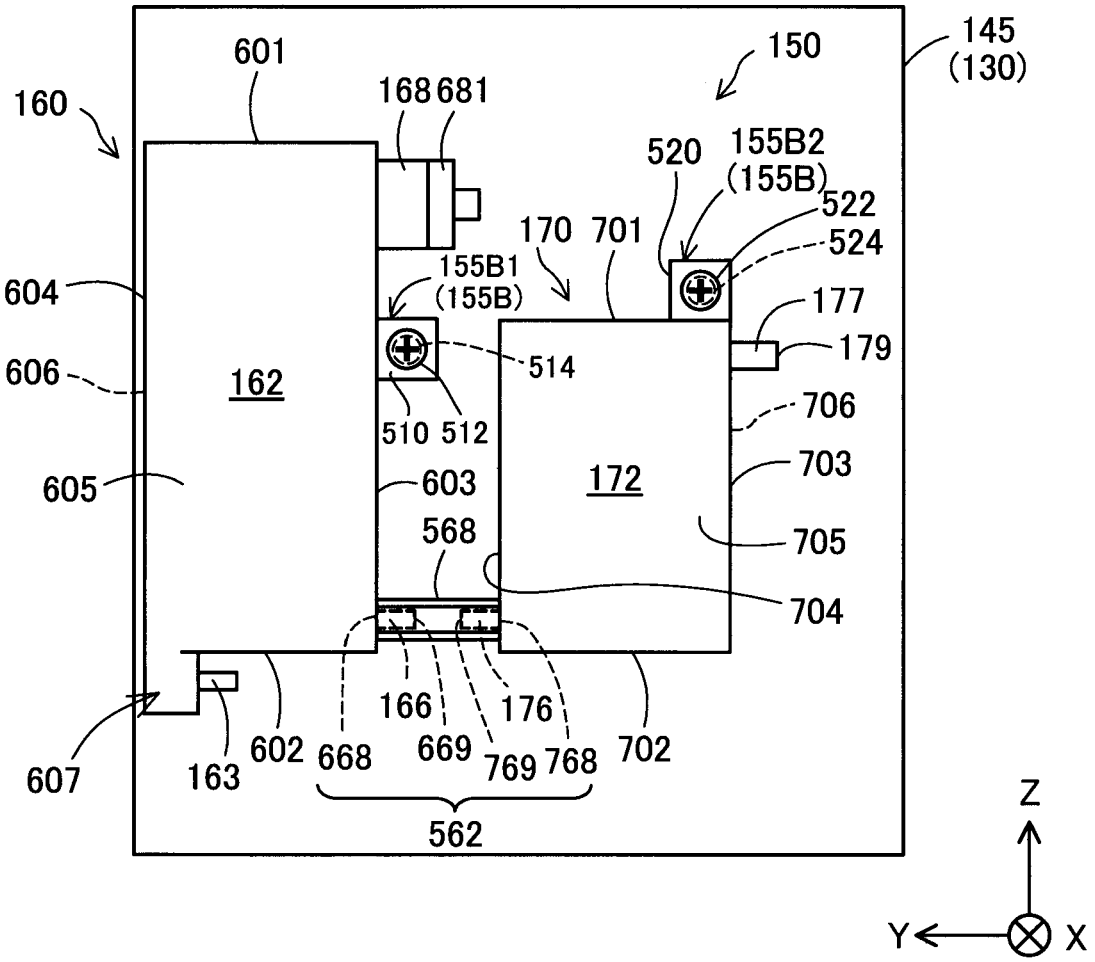
FIG. 8 is a diagram for explaining a holding member of a second-type modification.

FIG. 8 is a diagram for explaining a holding member 155B of the second type modification. The holding member 155B has a first holding member 155B1 and a second holding member 155B2.

The first holding member 155B1 has a first bracket 510, a screw 512, and a screw hole 514. The first bracket 510 is attached to the first shell 160 (specifically, a third liquid storage chamber wall 603). A through hole through which the screw 512 is inserted is formed in the first bracket 510. The screw hole 514 is formed in the side surface case 145 of the accommodation member 130. The first shell 160 is fixed to the side surface case 145 by tightening the screw 512 to the screw hole 514 in a state where the screw 512 is inserted through the through hole of the first bracket 510.

The second holding member 155B2 has a second bracket 520, a screw 522, and a screw hole 524. The second bracket 520 is attached to the second shell 170 (specifically, the first air storage chamber wall 701). A through hole through which the screw 522 is inserted is formed in the second bracket 520. The screw hole 524 is formed in the side surface case 145 of the accommodation member 130. The second shell 170 is fixed to the side surface case 145 by tightening the screw 522 to the screw hole 524 in a state where the screw 522 is inserted through the through hole of the second bracket 520.

The holding member 155B of the second type modification described above is a member for fixing the first shell 160 and the second shell 170 with the other member (here, the side surface case 145) that is different from the liquid supply device 150. The mutual positional relationship between the first shell 160 and the second shell 170 is held to be constant by the holding member 155B. Also in this holding member 155B, the first holding member 155B1 is connected to part of the first shell 160, and the second holding member 155B2 is connected part of the second shell 170. Also in this holding member 155B, the second shell 170 can be detached from the first shell 160.

In the second type modification, the other member to which the first shell 160 and the second shell 170 are fixed by the holding member 155B is the side surface case 145 of the accommodation member 130. However, the other member is not limited thereto, and may be, for example, part of the casing 112 (FIG. 1), or may be the other member that is different from the casing 112 and the accommodation member 130.

B. Second Embodiment

Figure 9:
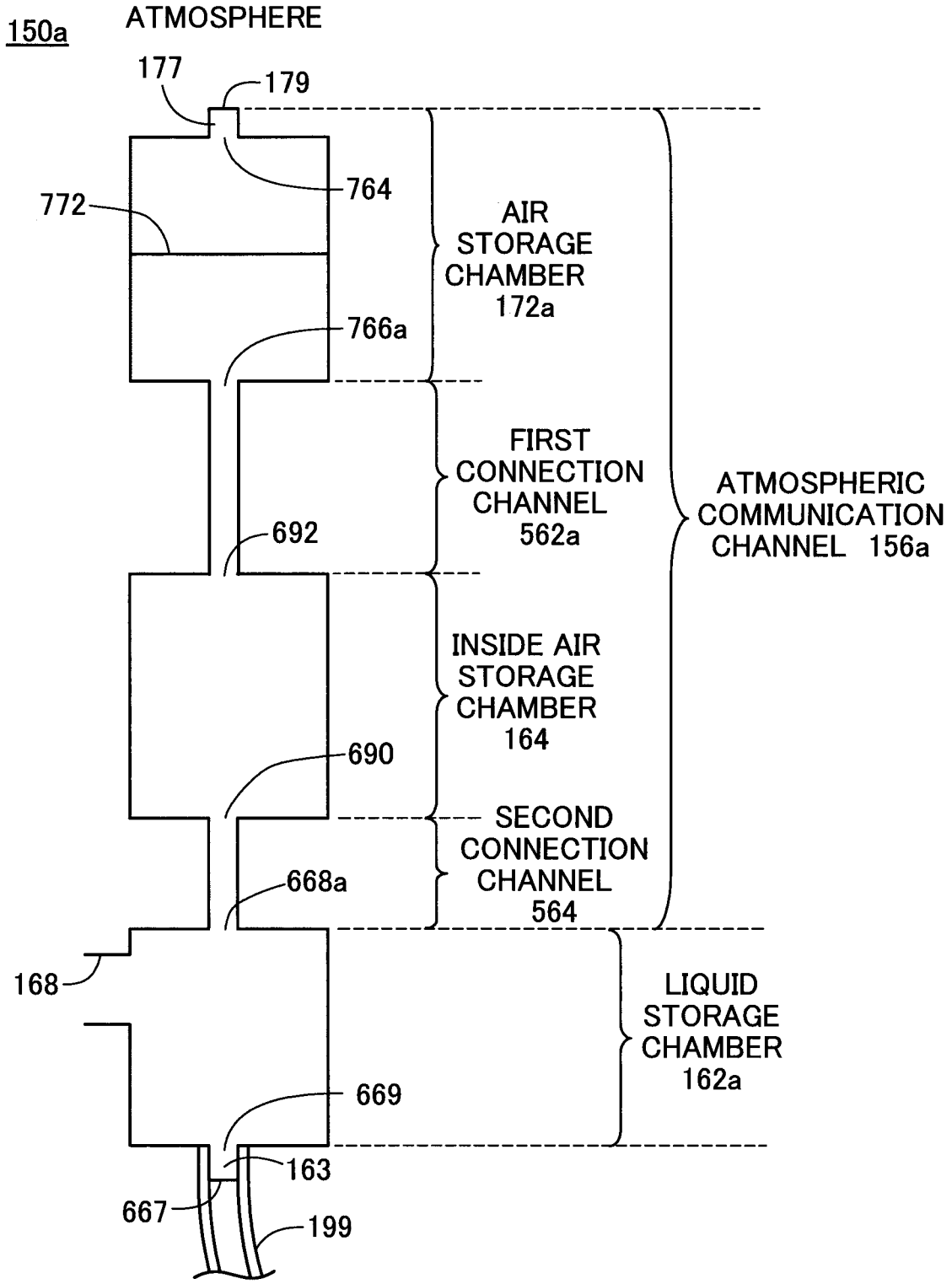
FIG. 9 is a diagram conceptually showing a flow channel from an atmospheric opening port to a liquid outlet part of the liquid supply device in a second embodiment.

FIG. 9 is a diagram conceptually showing a flow channel from the atmospheric opening port 179 to the liquid outlet part 163 of the liquid supply device 150*a* in the second embodiment of the present invention. The difference between the liquid supply device 150*a* of the second embodiment and the liquid supply device 150 of the first embodiment is that the atmospheric communication channel 156*a* has two air storage chambers (an air storage chamber 172*a* and an inside air storage chamber 164) in series, and that the atmospheric communication channel 156*a* has a new second connection channel 564 that connects between the inside air storage chambers 164*a* and the liquid storage chamber 162*a*. Since other components are similar between the liquid supply device 150*a* and the liquid supply device 150, similar component is added with the same reference signs and description thereof is omitted.

The atmospheric communication channel 156*a* has an air storage chamber 172*a*, a first connection channel 562*a*, an inside air storage chamber 164, and a second connection channel 564. The liquid storage chamber 162*a* can accommodate the ink to be supplied to the liquid jetting head 114.

The air storage chamber 172*a* partitions an upstream side portion and a downstream side portion, and has a sheet member (gas and liquid separation film) 772 through which gas permeates and liquid does not permeate. As the sheet member 772, for example, a Gore-Tex (registered trademark) can be used.

The first connection channel 562*a* connects the air storage chamber 172*a* and the inside air storage chamber 164. the first connection channel 562*a* has a first upstream side connection port 766*a* formed in an upstream end, and a first downstream side connection port 692 formed in a downstream end. The first upstream side connection port 766*a* opens in the air storage chamber 172*a*. The first downstream side connection port 692 opens in the inside air storage chamber 164. Here, the first connection channel 562*a* corresponds to the "connection channel" described in the Solutions to Problems.

The second connection channel 564 connects the inside air storage chamber 164 and the liquid storage chamber 162*a*. The second connection channel 564 has a second upstream side connection port 690 formed in the upstream end, and an air inlet port 668*a* formed in the downstream end. The second upstream side connection port 690 opens in the inside air storage chamber 164. The air inlet port 668*a* is formed in the wall 615 that partitions the liquid storage chamber 162*a*. The liquid inlet port 668*a* opens in the liquid storage chamber 162*a*. In the use posture, liquid level that directly contacts with the atmosphere is formed in the air inlet port 668*a*, the air (air bubbles) is led from the air inlet port 668*a* into the ink in the liquid storage chamber 162*a*, and thereby, the air is led into the liquid storage chamber 162*a*. That is, the air inlet port 668*a* forms one end of the atmospheric communication channel 156 for leading air into the liquid storage chamber 162*a*. It is preferable that the second connection channel 564 including the air inlet port 668*a* has a small flow channel cross-sectional area in an extent with which meniscus can be formed.

Figure 10:
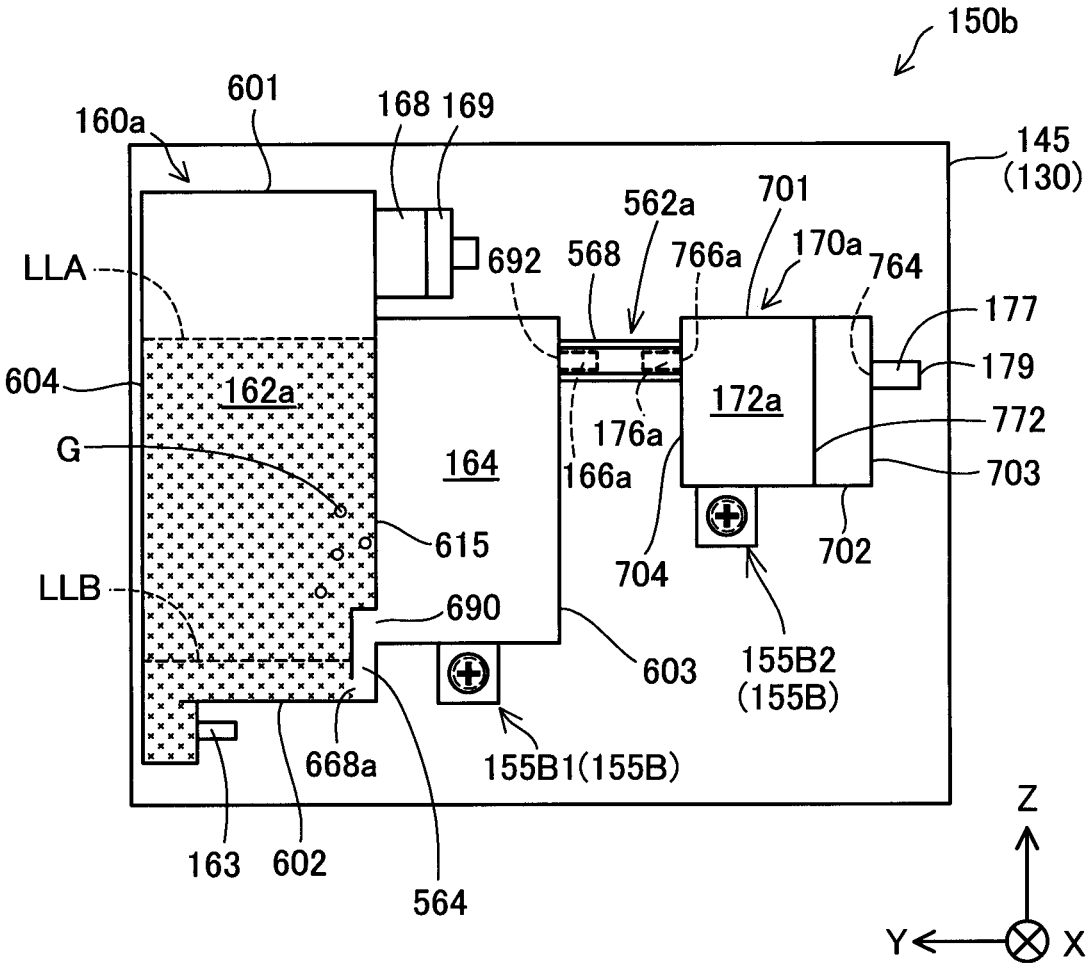
FIG. 10 is a diagram for explaining a liquid supply device of the second embodiment.

FIG. 10 is a diagram for explaining the liquid supply device 150*a*. Similar component as the liquid supply device 150 (FIG. 5) of the first embodiment is added with the same reference sign and description thereof is omitted.

The liquid supply device 150*a* includes a first shell 160*a*, a second shell 170*a* that is a different member from the first shell 160*a*, and a holding member 155B.

The difference between the first shell 160*a* and the first shell 160 of the first embodiment is that the first shell 160*a* has the inside air storage chamber 164 and the second connection channel 564. Since other components are similar to the first shell 160, similar component is added with the same reference signs and description thereof is omitted. The outer shape of the first shell 160*a* is a columnar shape. The liquid storage chamber 162*a* and the inside air storage chamber 164, and the second connection channel 564 are partitioned by the first shell 160*a*. That is, the first shell 160*a* has the liquid storage chamber 162*a*, the inside air storage chamber 164, and the second connection channel 564. The liquid storage chamber 162*a* and the inside air storage chamber 164 are partitioned by the partition wall 615 provided inside the first shell 160*a*. The flow channel cross-sectional area of the second connection channel 564 is smaller than the cross-sectional areas of the inside air storage chamber 164 and the air storage chamber 172*a*.

The air inlet port 668*a* is located in a region in a lower side of the vertical direction in the liquid storage chamber 162*a*. That is, in the use posture, the air inlet port 668*a* is provided in a position that is a middle of a height of the liquid storage chamber 162*a* in the Z axis direction. In the present embodiment, the air inlet port 668*a* is formed near the wall 602 composing the bottom surface of the liquid storage chamber 162*a*.

The difference between the second shell 170*a* and the second shell 170 of the second embodiment is that the capacity of the air storage chamber 172*a* partitioned by the second shell 170*a* is smaller than the capacity of the air storage chamber 172 partitioned by the second shell 170. Since other components are similar to the second shell 170, similar component is added with the same reference signs and description thereof is omitted. The outer shape of the second shell 170*a* is a substantially rectangular parallelepiped shape. The air storage chamber 172*a* is partitioned by the second shell 170*a*. The air storage chamber 172*a* has a smaller capacity than the air storage chamber 172 of the first embodiment, for the amount that the liquid supply device 150*a* has the inside air storage chamber 164.

The first connection channel 562*a* connects the first shell 160*a* and the second shell 170*a*. The first connection channel 562*a* has a first shell side flow channel part 166*a* projecting outward from the first shell 160*a*, a second shell side flow channel part 176*a* projecting outward form the second shell 170*a*, and a connection forming member 568. The first shell side flow channel part 166*a* and the second shell side flow channel part 176*a* are cylindrical members.

The mutual positional relationship between the first shell 160*a* and the second shell 170*a* is held to be constant by a holding member 155B. The holding member 155B has a similar configuration to the second type modification (FIG. 8) of the first embodiment described above. As the holding member for holding the mutual positional relationship between the first shell 160*a* and the second shell 170*a*, the holding member 155 (FIG. 5) of the first embodiment described above, and the holding member (for example, a magnet) described in the modification of the first embodiment described above may be used.

According to the second embodiment described above, the present invention exhibits a similar effect in a feature that the second embodiment has the similar configuration to the first embodiment. For example, the first shell 160*a* having the liquid storage chamber 162*a* and the second shell 170*a* having the air storage chamber 172*a* are different members. Thereby, even when the use conditions of the liquid supply device 150*a* such as the ink amount and the use environment of the liquid storage chamber 162*a* change, and the configuration (for example, capacity) of the air storage chamber 172*a* changes, the configuration of the entire liquid supply device 150*a* need not be changed. That is, the liquid supply device 150*a* having the air storage chamber 172*a* according to the use conditions can be easily provided by changing the configuration of the second shell 170*a* that is a different member from the first shell 160*a*, and connecting the second shell 170*a* after the change (that is, a new second shell 170*a*) to the first shell 160*a*.

According to the second embodiment described above, the air storage chamber 172*a* has a sheet member 772. Thereby, the possibility of leakage of the ink in the liquid storage chamber 162*a* to the outside through the atmospheric communication channel 156*a* can be further reduced. Here, when a lifetime of the sheet member 772 has passed, or the sheet member 772 is wet by the ink, it may be necessary that the sheet member 772 is exchanged with a new sheet member 772. In the second embodiment described above, since the second shell 170*a* is composed of a different member from the first shell 160*a*, when the sheet member 772 is exchanged, exchange work can be performed with the second shell 170*a* detached from the first shell 160*a*. Thus, exchange of the sheet member 772 or the second shell 170*a* having the sheet member 772 can be easily performed.

According to the second embodiment described above, the first shell 160*a* composes part of the atmospheric communication channel 156*a* and has an inside air storage channel 164 for storing the air. This inside air storage chamber 164 is located between the air storage chamber 172*a* and the air inlet port 668*a*. Thereby, the possibility of leakage of the ink of the liquid storage chamber 162*a* to the outside through the atmospheric communication channel 156*a* can be reduced.

C. Modifications of First Embodiment and Second Embodiment

The present invention is not limited to the embodiments described above, and can be performed in various embodiments without departing from the spirit of the invention.

C-1. First Variation:

In the first and second embodiments described above, the outer shape of the first shells 160, 160*a* and the outer shape of the second shells 170, 170*a* are substantially rectangular parallelepiped shapes or columnar shapes. However, the shapes are not limited thereto, and may be oval shapes, circle shapes, or polygonal shapes. The outer shape of the first shell 160, 160*a* and the outer shape of the second shell 170, 170*a* may have a spherical shape or a spherical surface.

C-2. Second Variation:

In the first and second embodiments described above, the holding members 155, 155A, 155B are configured so that the second shells 170, 170*a* can be detached from the first shells 160, 160*a*. However, the holding members 155, 155A, 155B are not limited thereto, and may be configured so that, for example, the second shells 170, 170*a* cannot be detached from the first shells 160, 160*a*. For example, the holding member may be a member attached to the first shell 160, 160*a* and the second shell 170, 170*a* by welding.

C-3. Third Variation

In the second embodiment, although the air storage chamber 172*a* has the sheet member 772, the air storage chamber 172*a* may not have the sheet member 772.

C-4. Fourth Variation

In the first and second embodiments described above, the liquid supply devices 150, 150*a* perform ink supply by using the principle of Mariotte. However, the ink supply is not limited thereto. For example, the liquid level of the liquid storage chambers 162, 162*a* may be a liquid level that contacts with the atmosphere. That is, the water head difference d1 may change according to the consumption of the ink in the liquid storage chambers 162, 162*a*.

D. Third Embodiment

Figure 11:
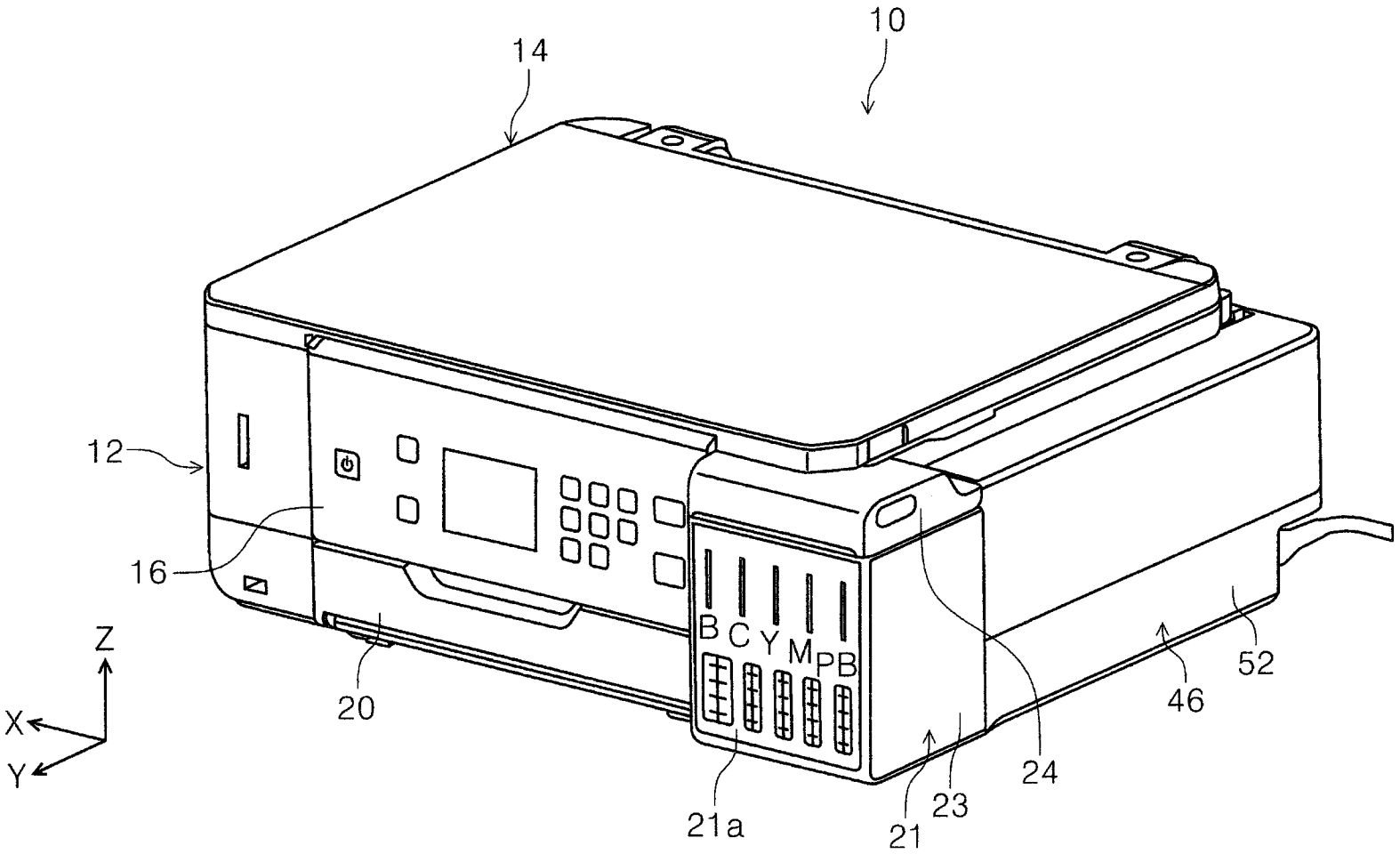
FIG. 11 is an appearance perspective view of a printer in a third embodiment.
Figure 12:
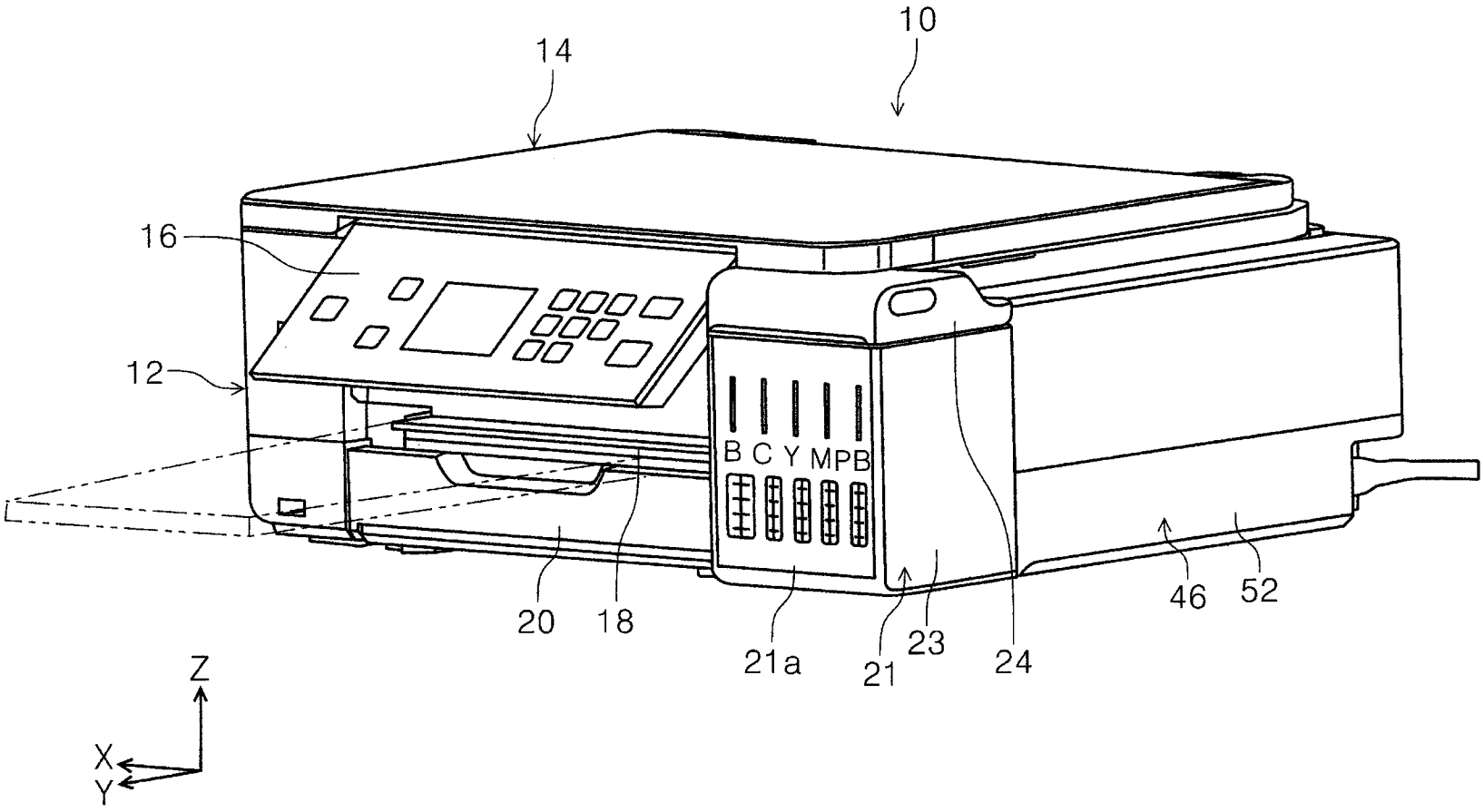
FIG. 12 is an appearance perspective view of the printer in a state where an operation part is rotated in a front surface side of a device depth direction.
Figure 13:
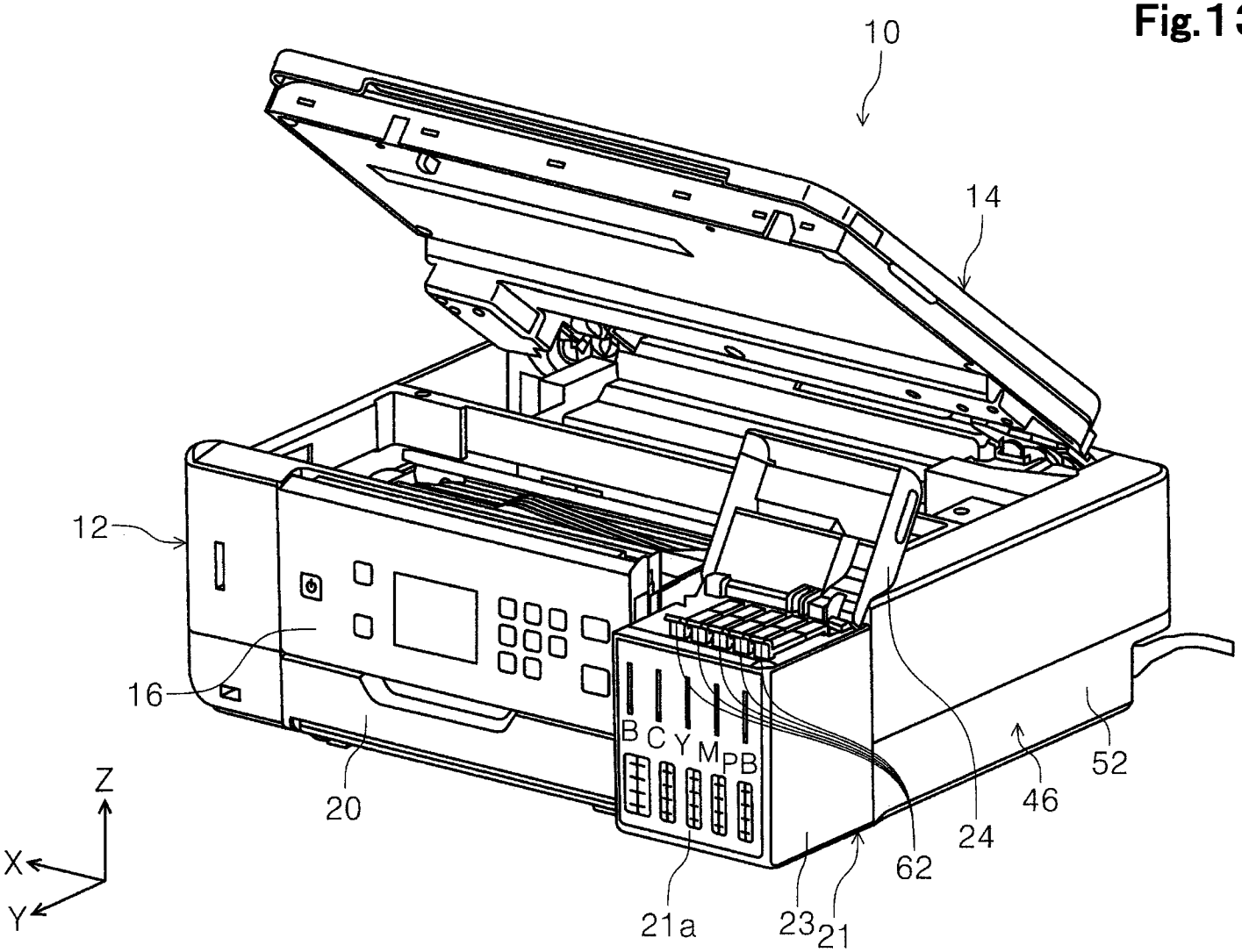
FIG. 13 is an appearance perspective view of the printer of when covers of a scanner part and an ink tank are opened with respect to a device body.
Figure 14:
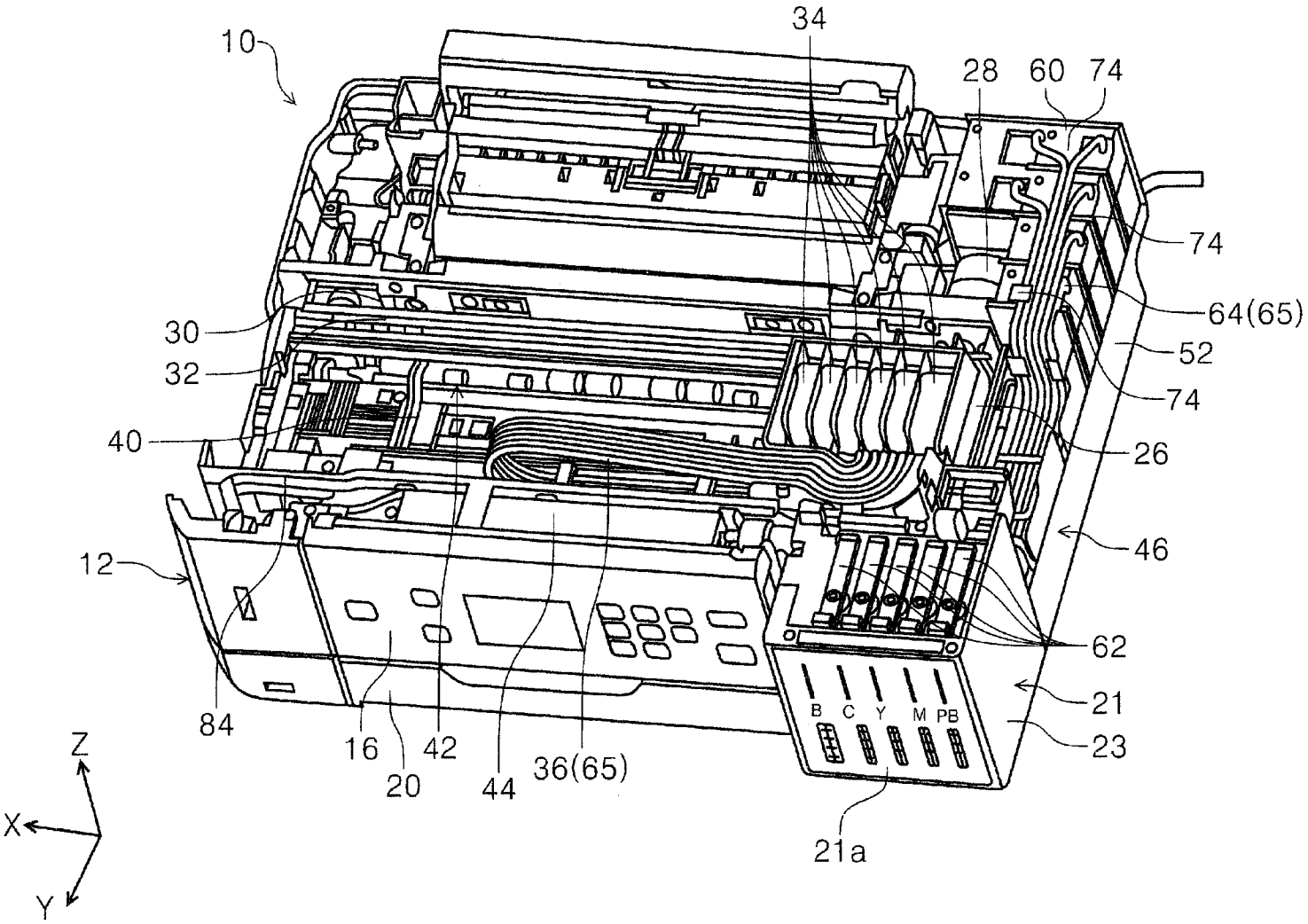
FIG. 14 is an appearance perspective view of the device body.
Figure 15:
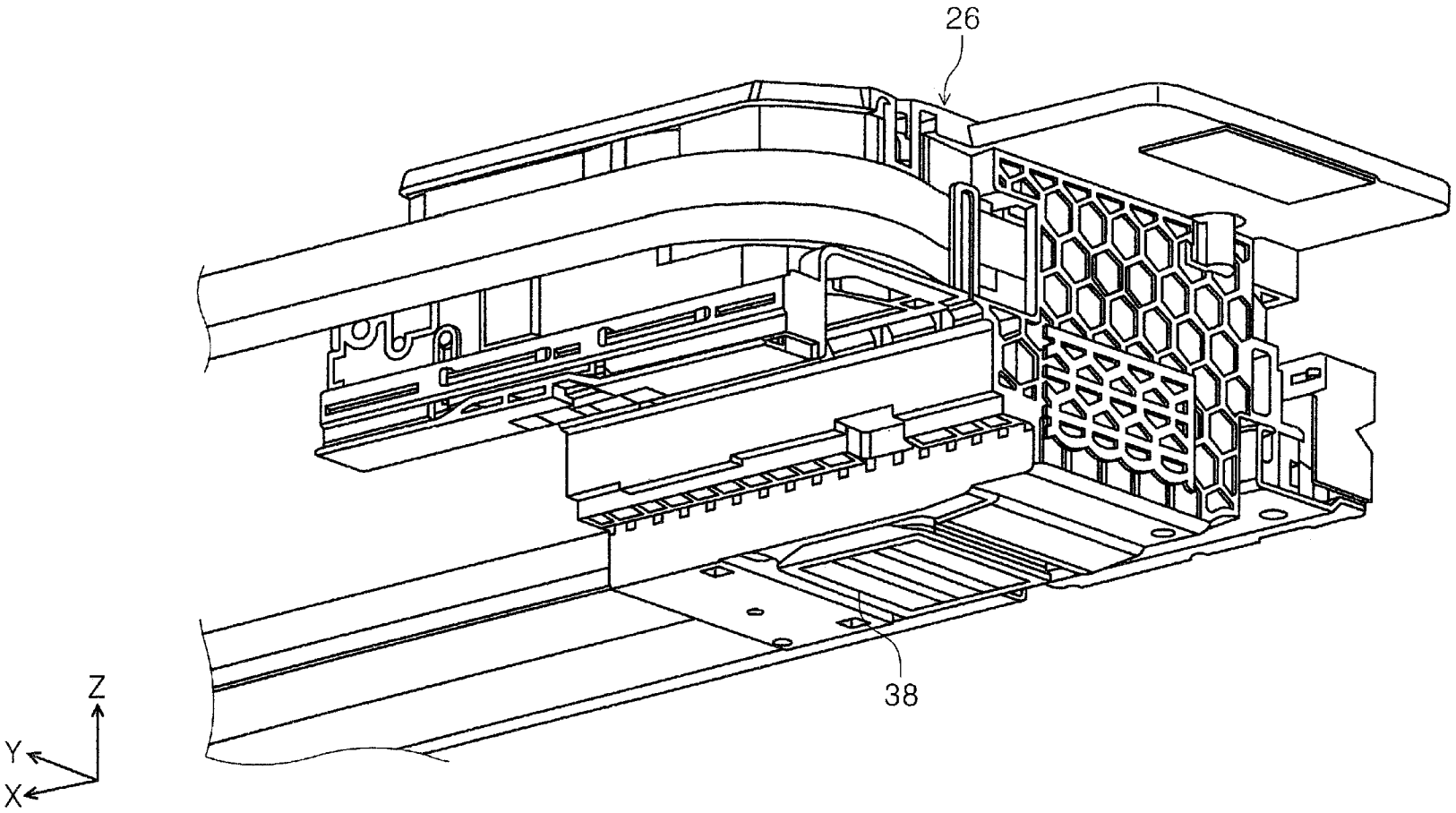
FIG. 15 is a perspective view of a carriage viewed from a diagonally lower side in a device height direction.
Figure 16:
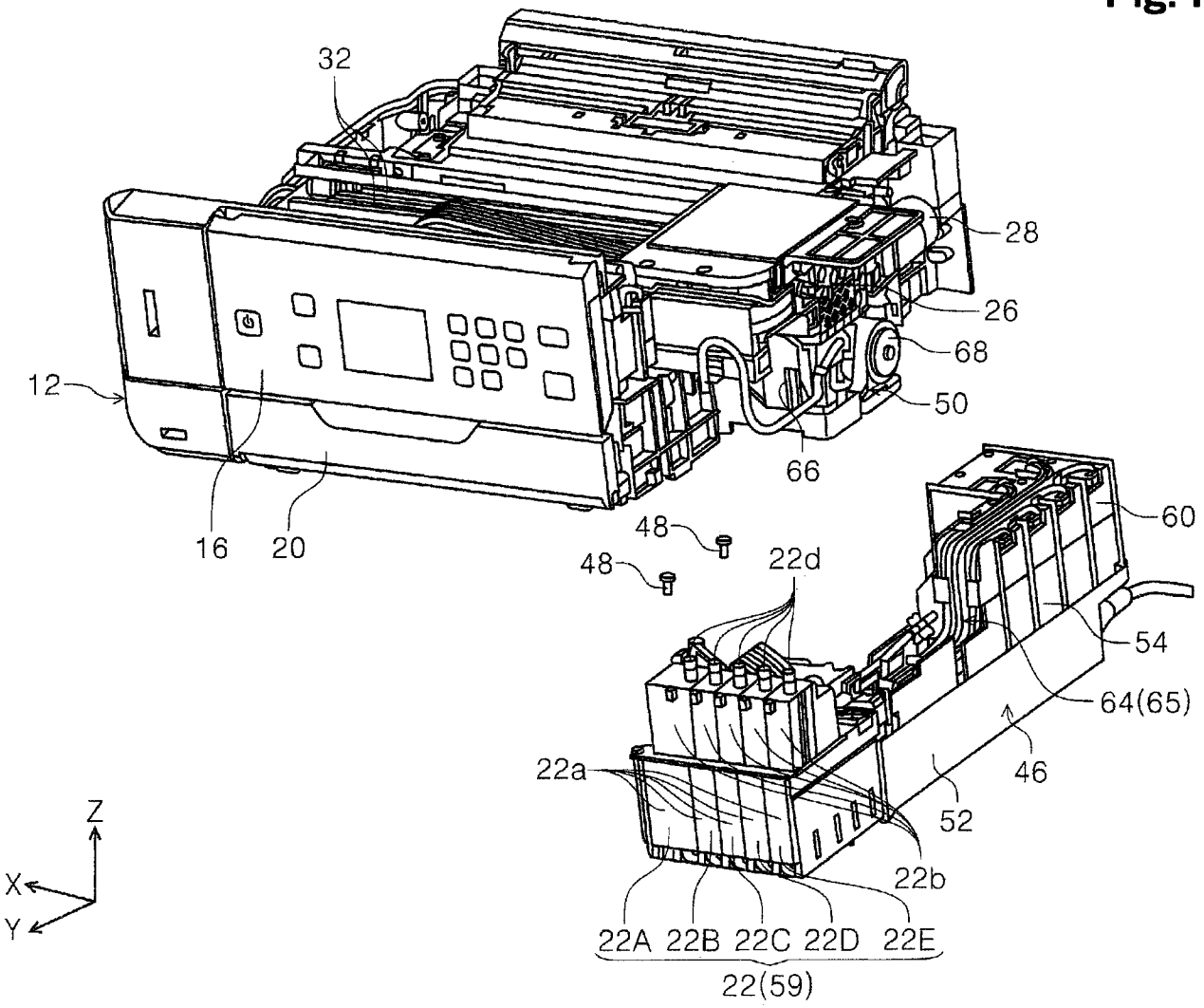
FIG. 16 is an exploded perspective view of a recording unit and an ink supply unit composing the device body.

FIG. 11 is an appearance perspective view of the printer in a third embodiment of the present invention. FIG. 12 is an appearance perspective view in a state where the operation part is rotated in a front surface side of a device depth direction. FIG. 13 is an appearance perspective view of the printer of when covers of a scanner part or an ink tank are opened with respect to a device body. FIG. 14 is an appearance perspective view of the device body. FIG. 15 is a perspective view of the carriage viewed from a diagonally lower side in a device height direction. FIG. 16 is an exploded perspective view of a recording unit and an ink supply unit composing the device body.

Figure 17:
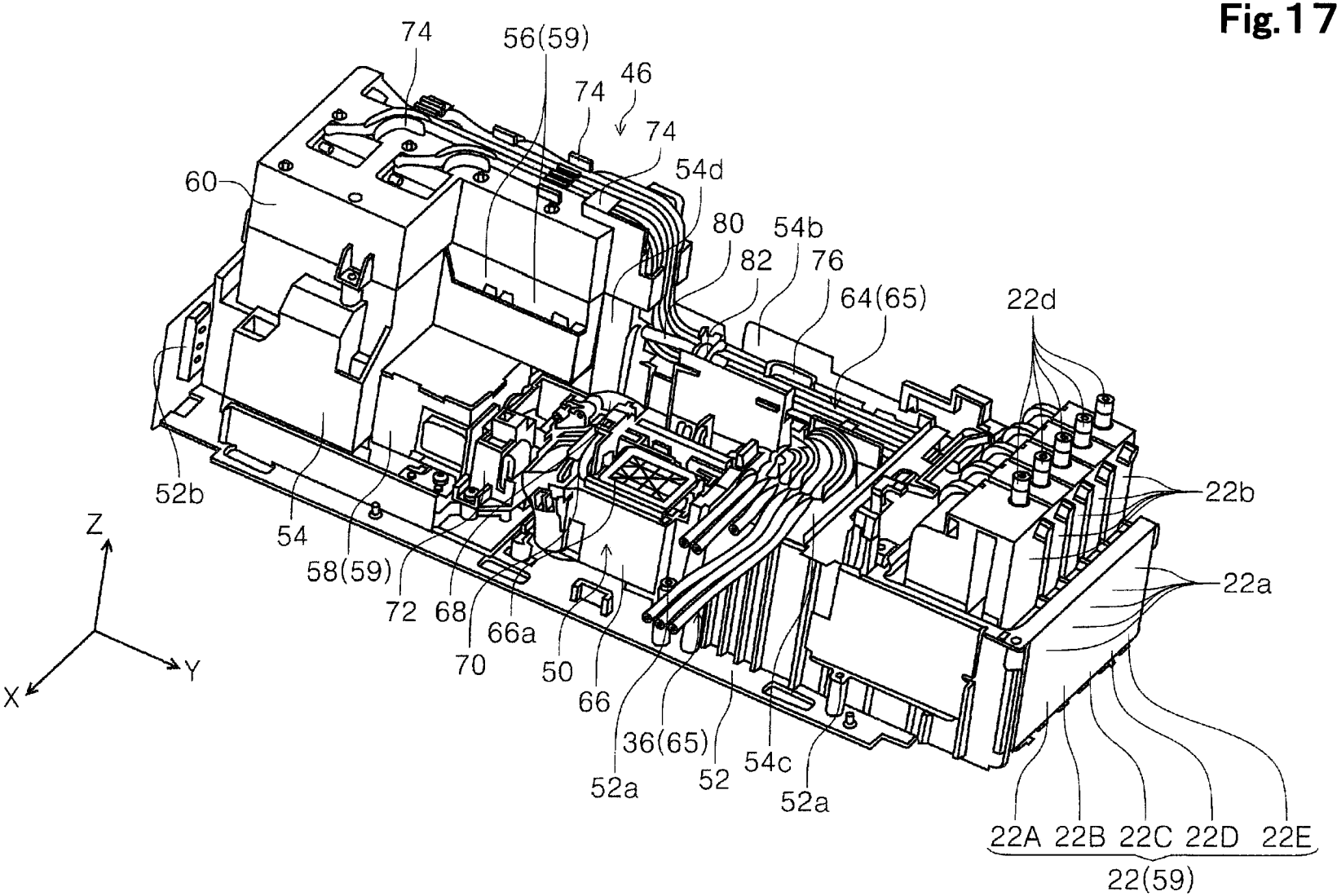
FIG. 17 is a perspective view of the ink supply unit.
Figure 18:
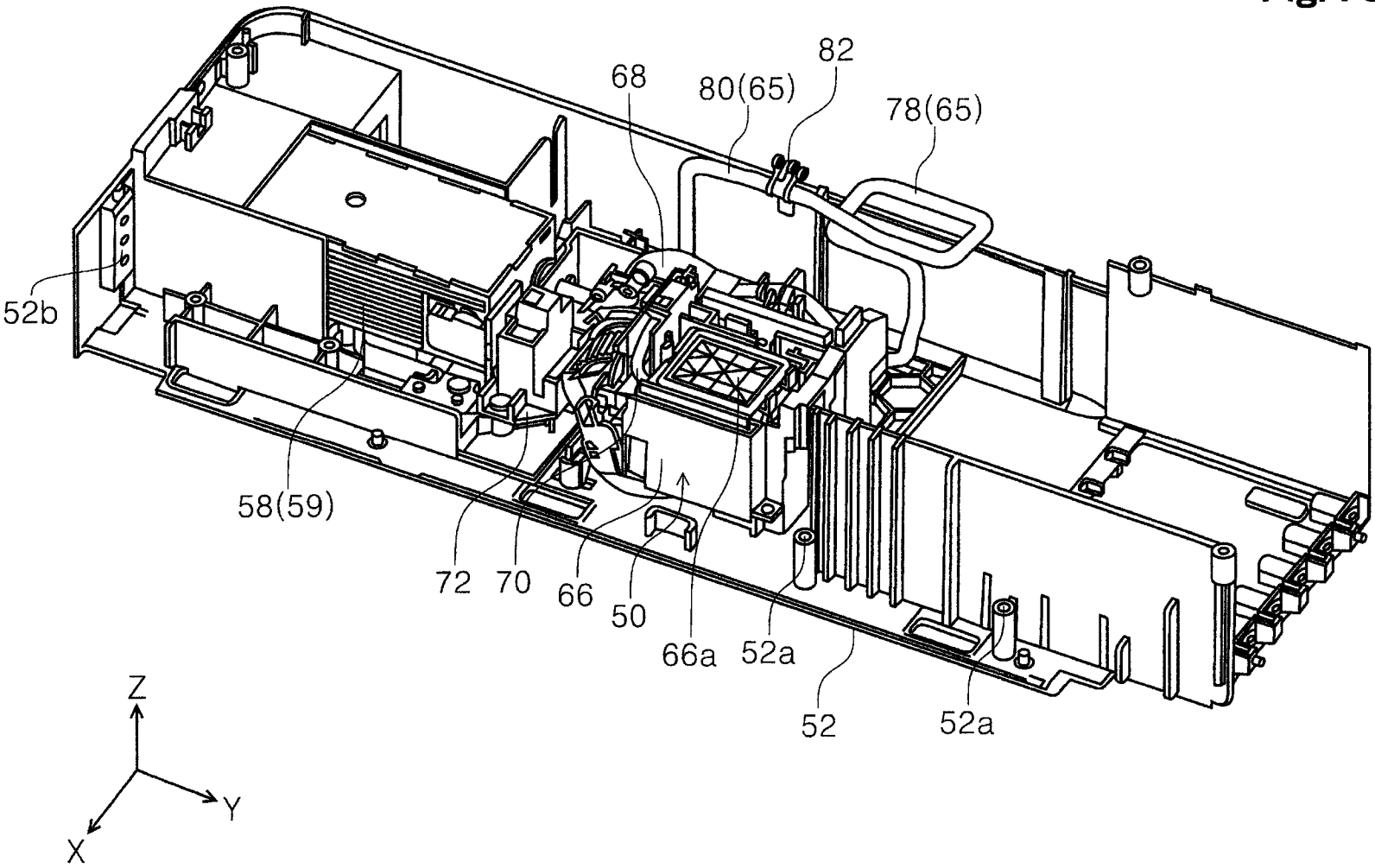
FIG. 18 is a perspective view of a maintenance unit and a waste ink tank.
Figure 19:
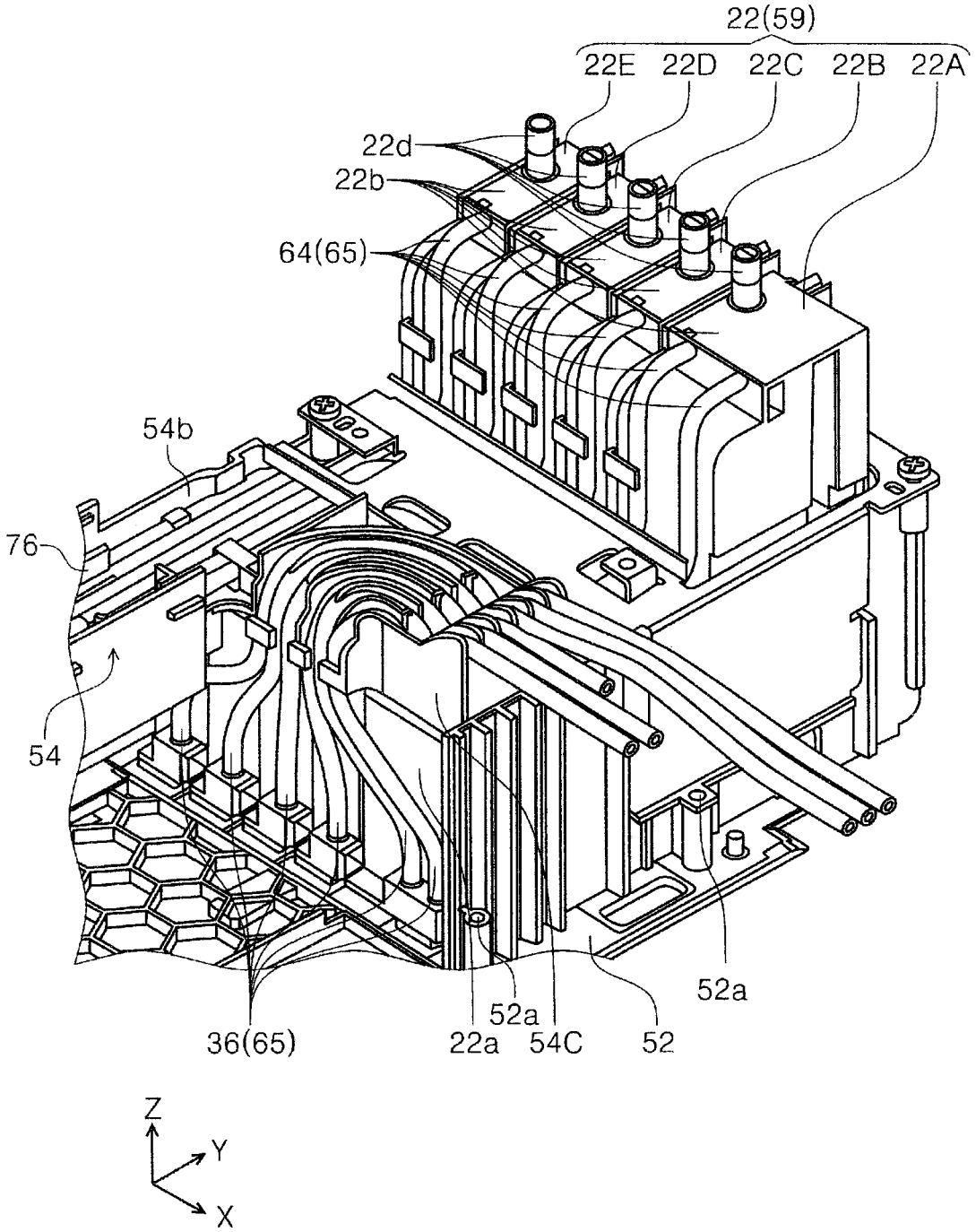
FIG. 19 is a perspective view of the ink tank.
Figure 20:
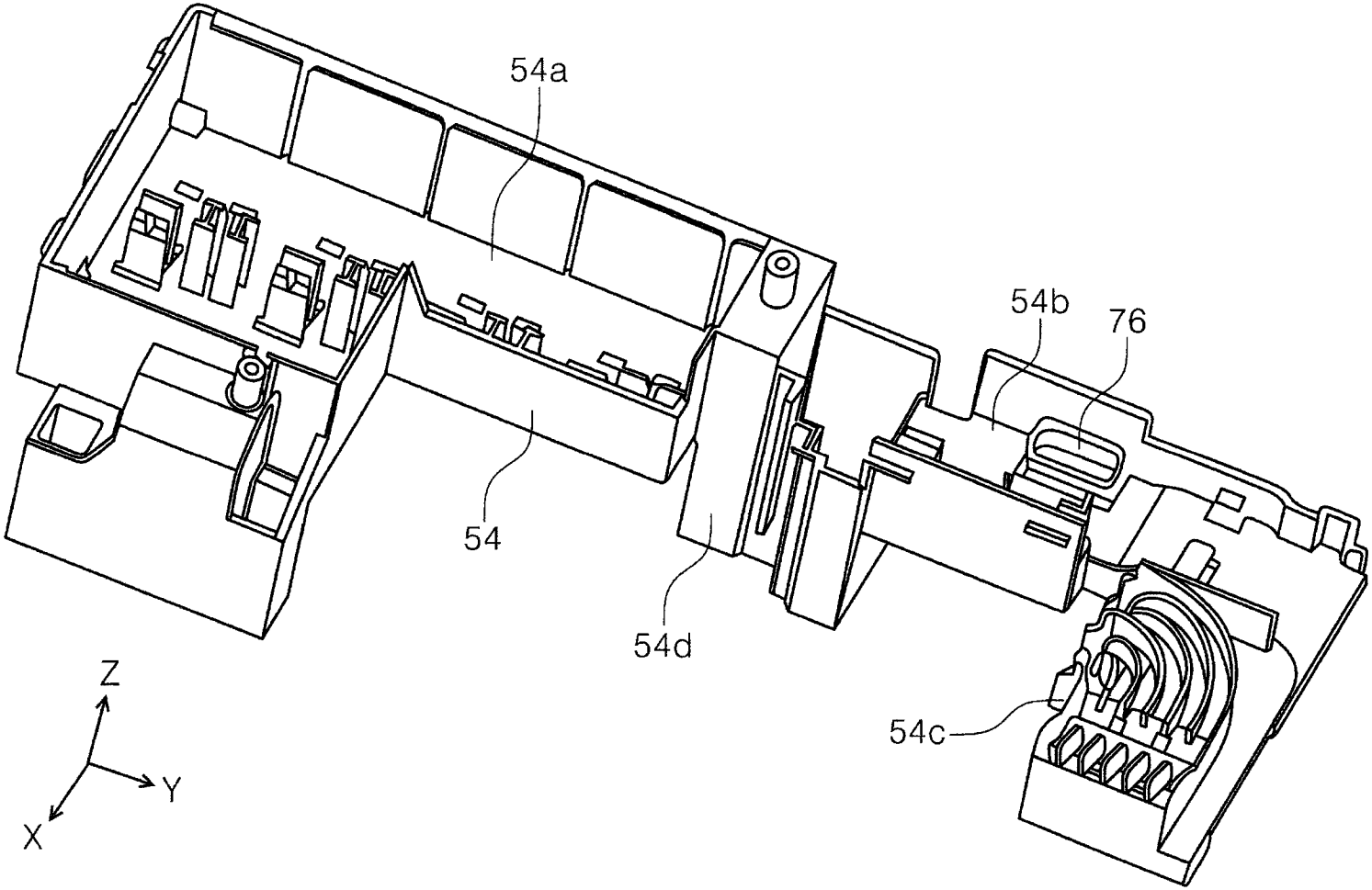
FIG. 20 is a perspective view of a container holding member.
Figure 21:
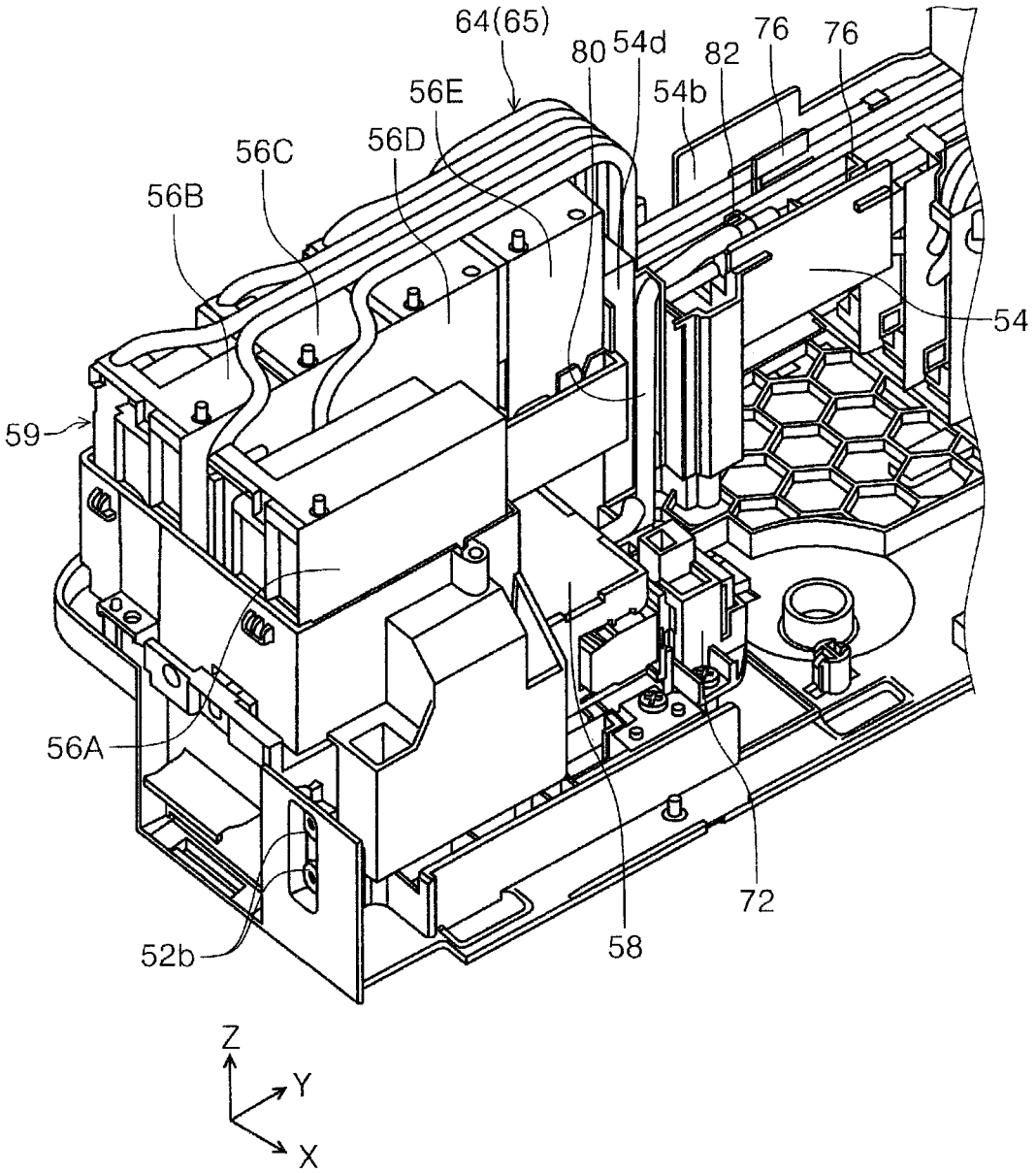
FIG. 21 is a perspective view of a buffer tank and the waste ink tank in the ink supply unit.
Figure 22:
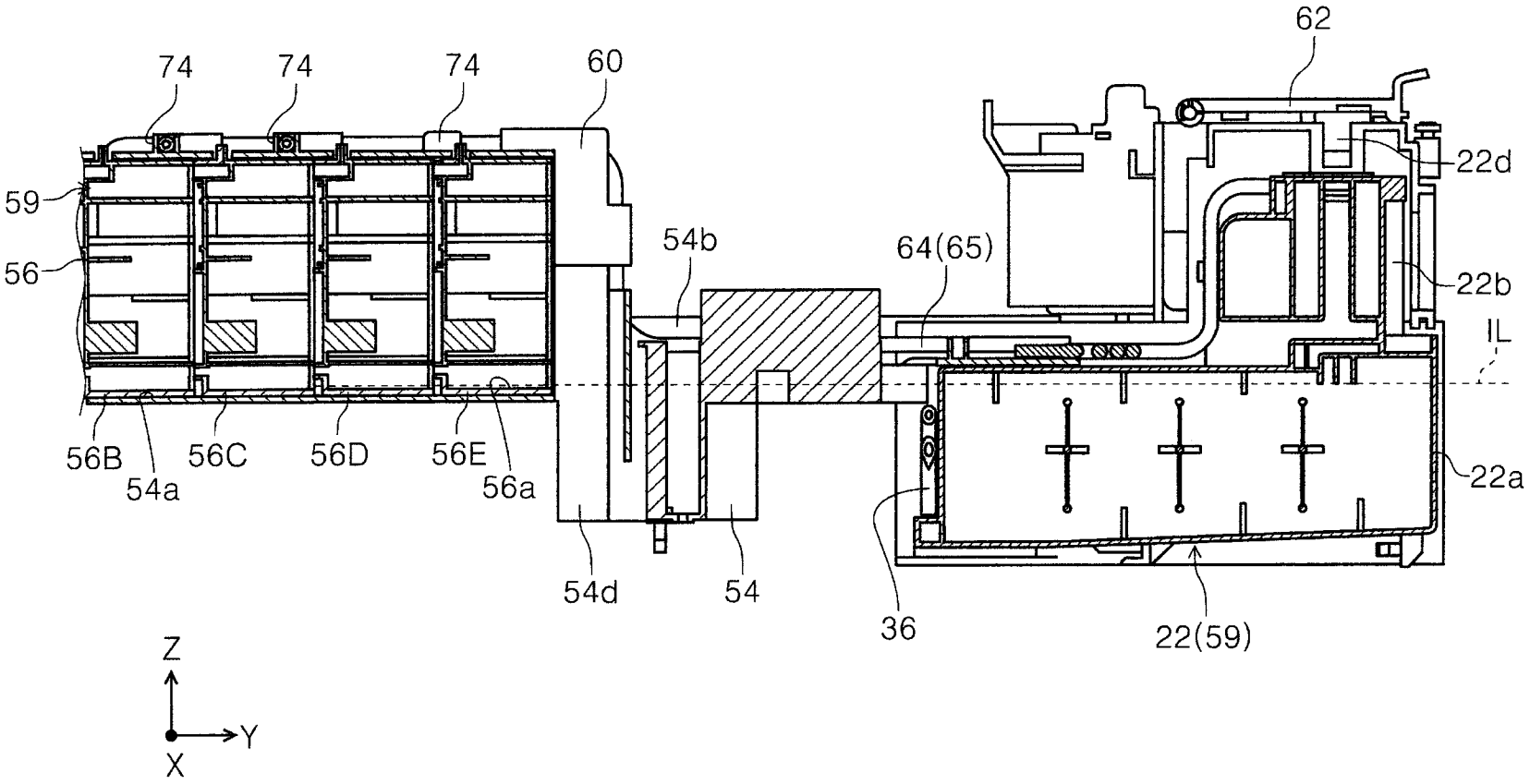
FIG. 22 is a cross-sectional view of the ink tank and the buffer tank showing a relationship between the ink tank and the buffer tank in the device height direction.

FIG. 17 is a perspective view of the ink supply unit. FIG. 18 is a perspective view of a maintenance unit and a waste ink tank. FIG. 19 is a perspective view of the ink tank. FIG. 20 is a perspective view of a container holding member. FIG. 21 is a perspective view of a buffer tank and the waste ink tank in the ink supply unit. FIG. 22 is a cross-sectional view of the ink tank and the buffer tank showing a relationship between the ink tank and the buffer tank in the device height direction.

Figure 23:
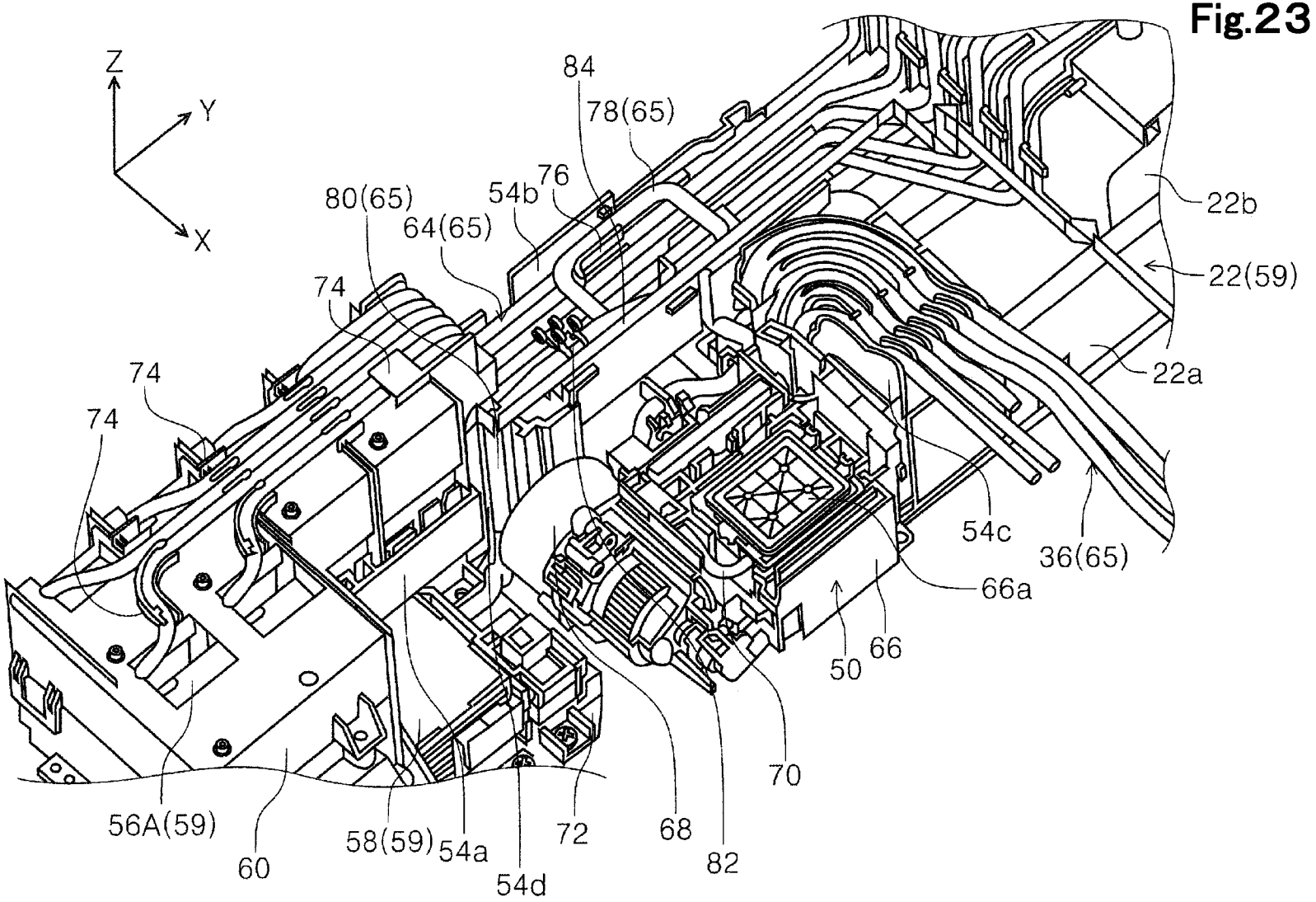
FIG. 23 is a perspective view of the ink supply unit showing a routing state of an ink tube.
Figure 24:
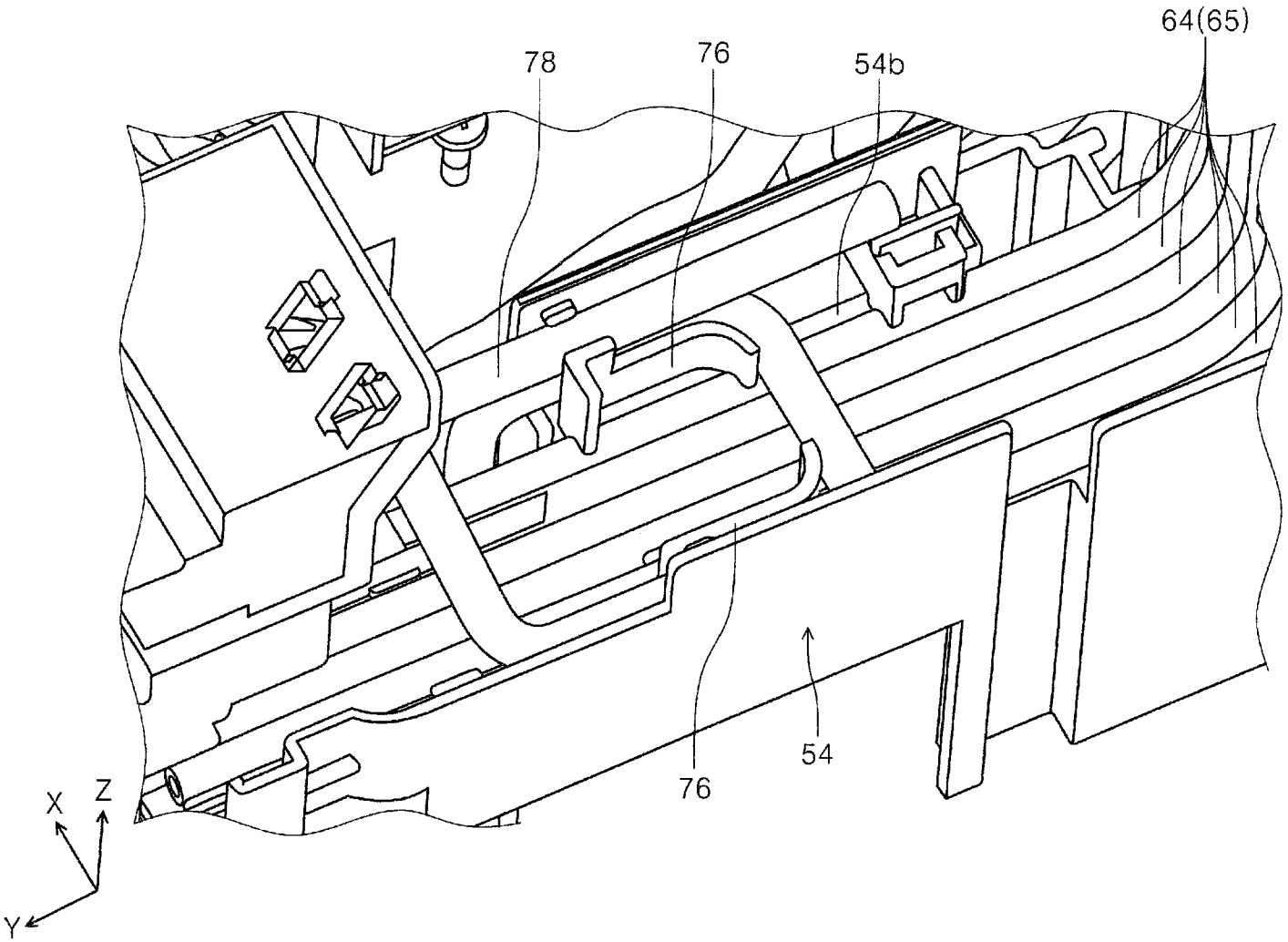
FIG. 24 is a perspective view of a flow channel holding part of a container holding member.
Figure 25:
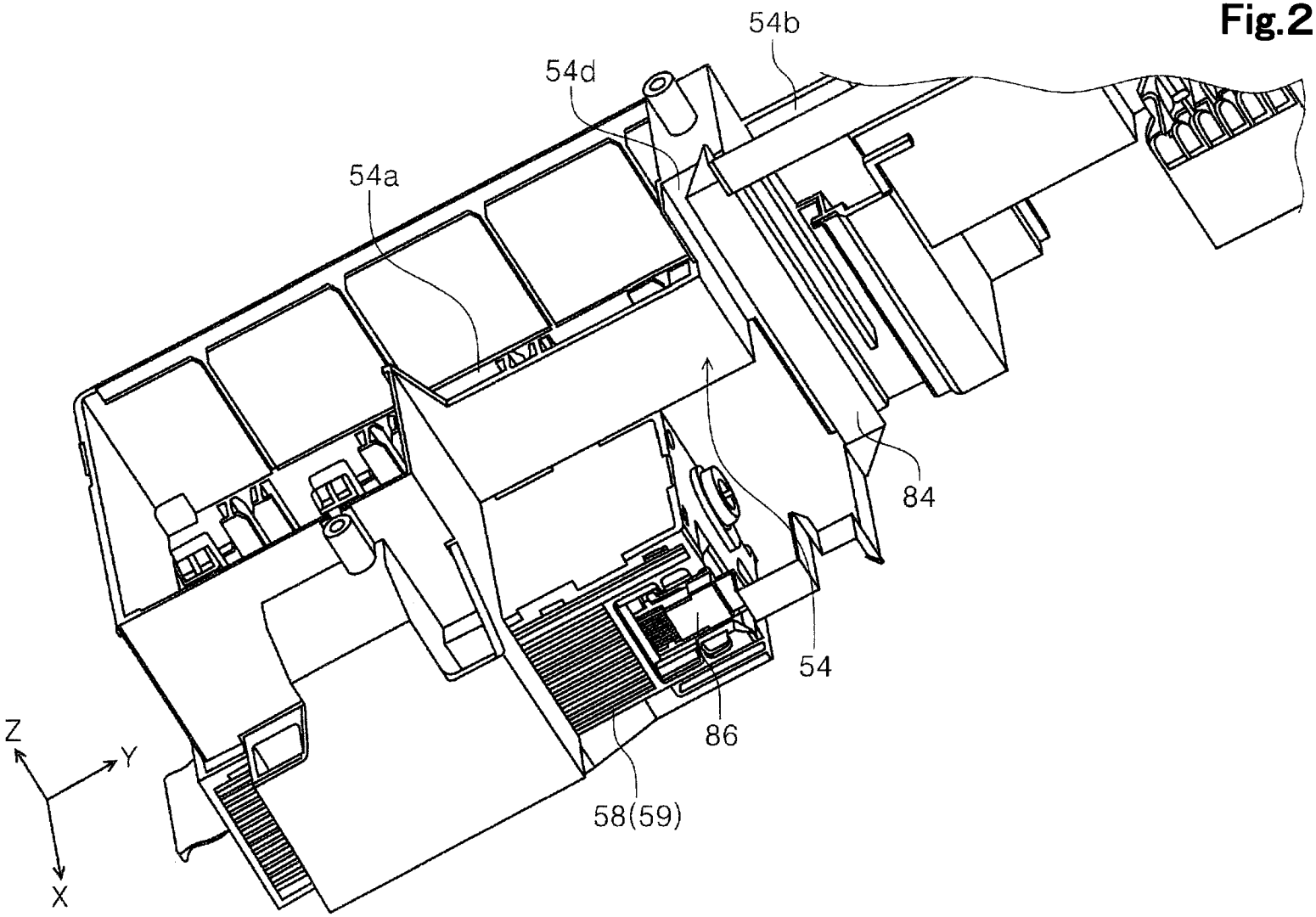
FIG. 25 is a perspective view of a wiring holding part and an electric wiring of the container holding member.
Figure 26:
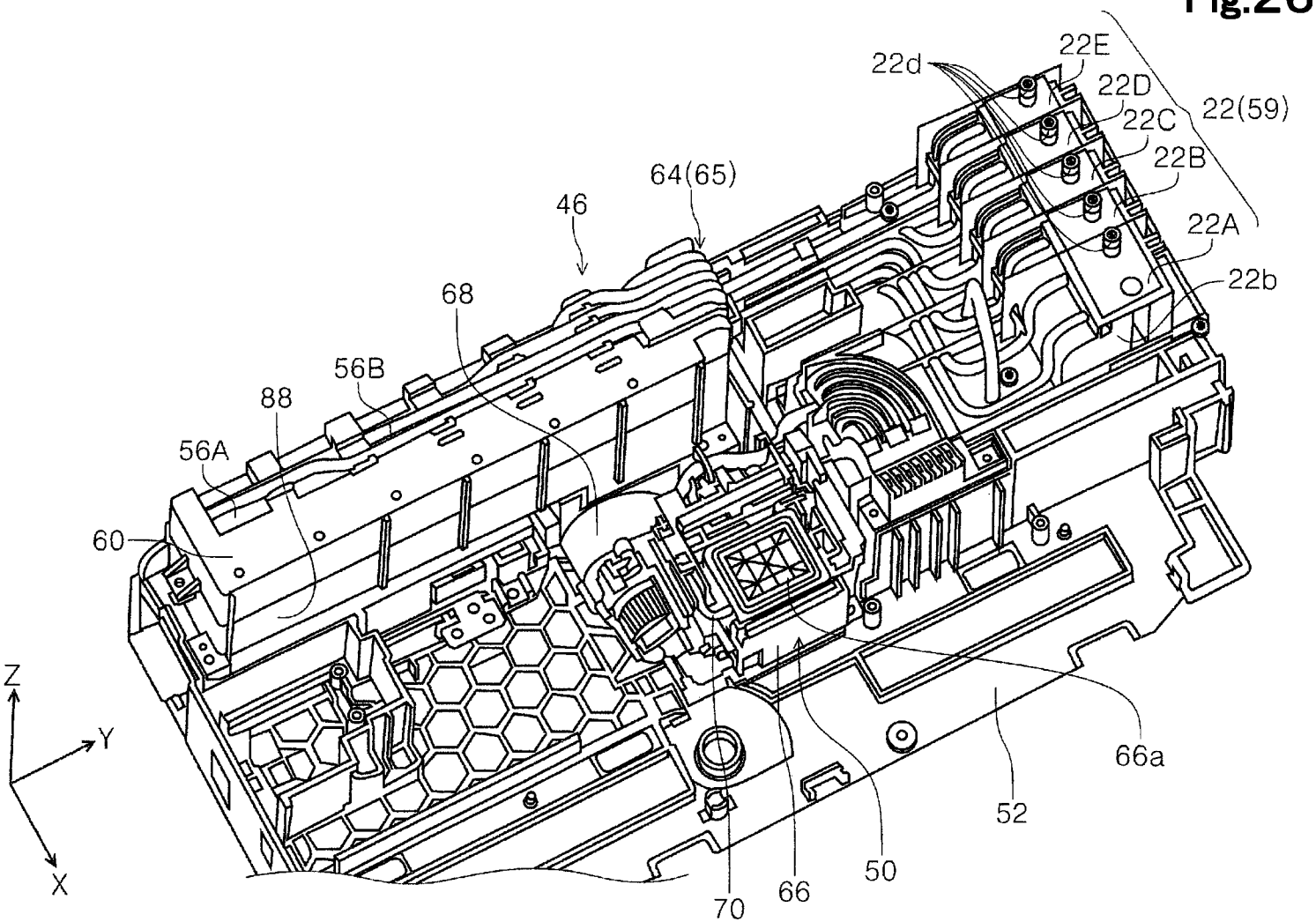
FIG. 26 is a perspective view of the ink supply unit showing an example of change in an arrangement position of the buffer tank in the container holding member.
Figure 27:
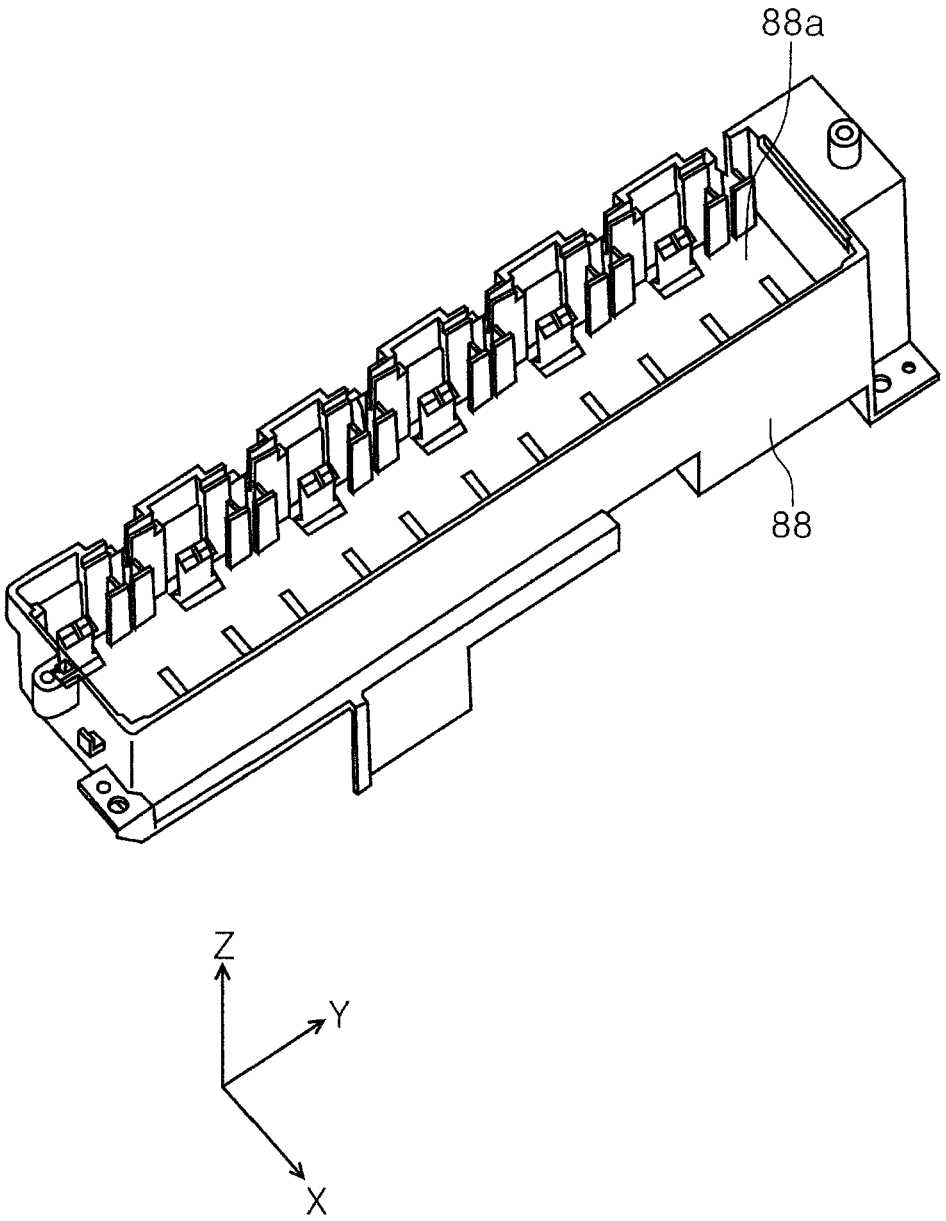
FIG. 27 is a perspective view of the container holding member in which the arrangement position of the buffer tank is changed.
Figure 28:
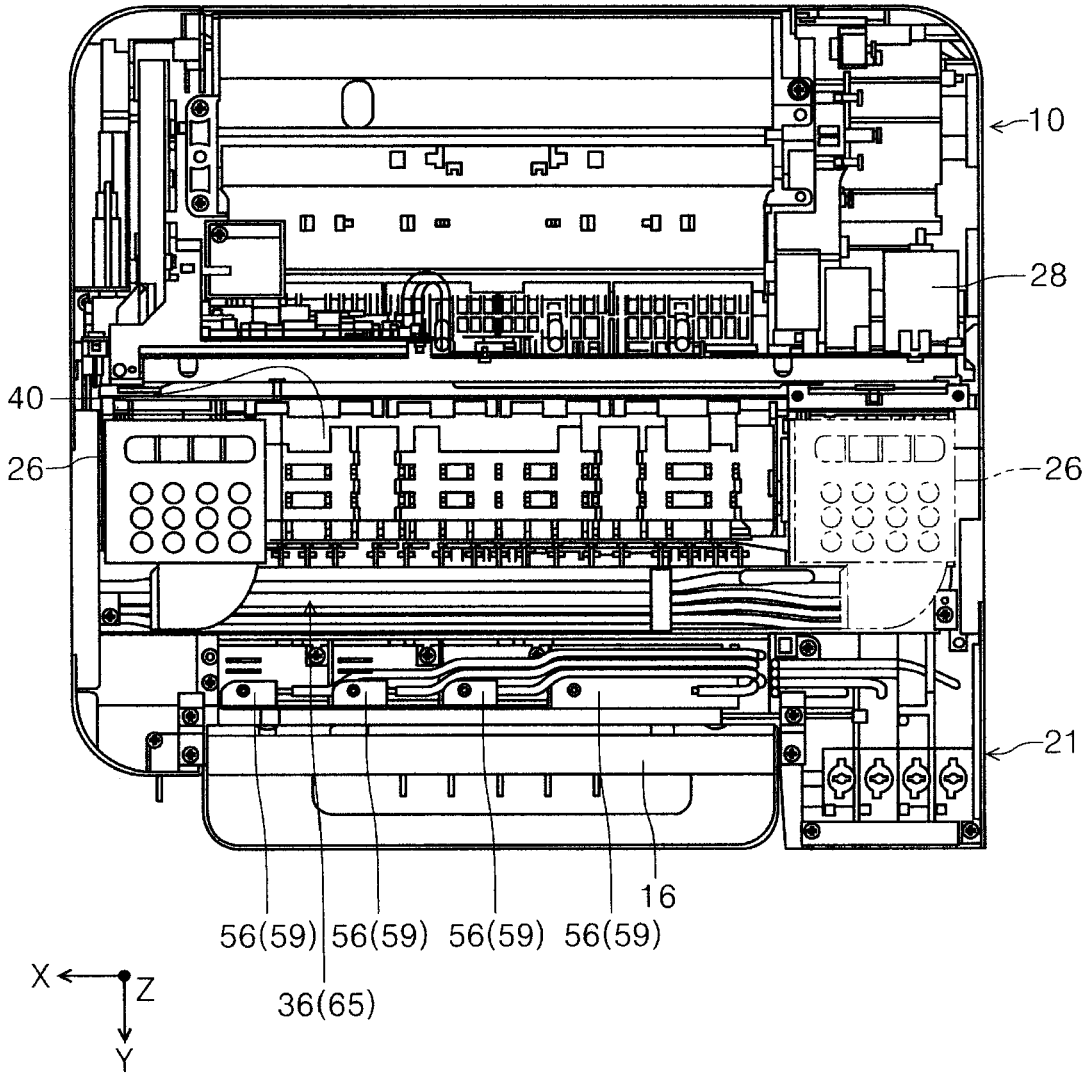
FIG. 28 is a plan view of the printer showing an example of change in arrangement of the buffer tank in the device body.
Figure 29:
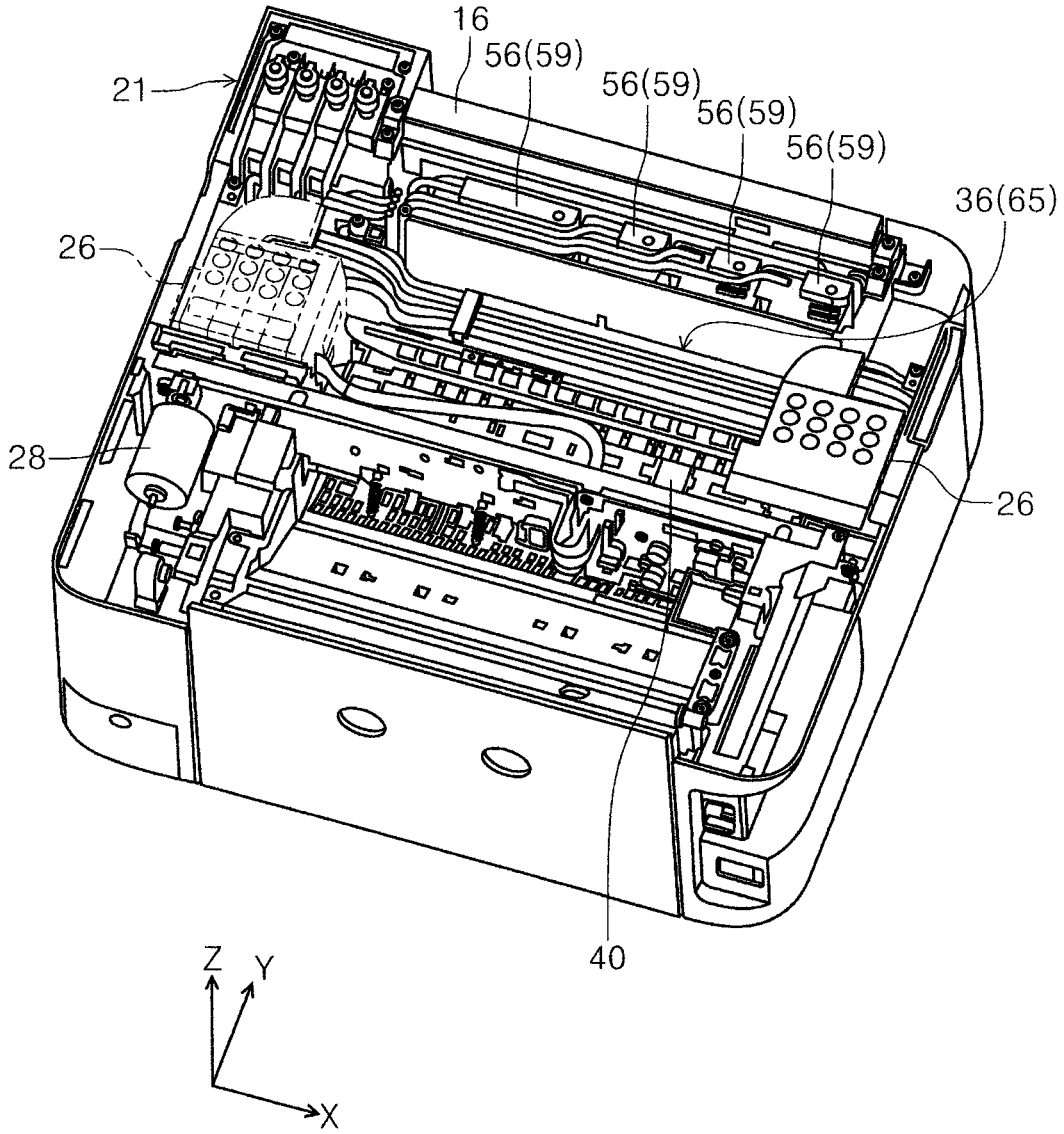
FIG. 29 is a perspective view of the printer showing an example of change in the arrangement of the buffer tank in the device body.

FIG. 23 is a perspective view of the ink supply unit showing a routing state of an ink tube. FIG. 24 is a perspective view of a flow channel holding part of a container holding member. FIG. 25 is a perspective view of a wiring holding part and an electric wiring of the container holding member. FIG. 26 is a perspective view of the ink supply unit showing an example of change in an arrangement position of the buffer tank in the container holding member. FIG. 27 is a perspective view of the container holding member in which the arrangement position of the buffer tank is changed. FIG. 28 is a plan view of the printer showing an example of change in arrangement of the buffer tank in the device body 12. FIG. 29 is a perspective view of the printer showing an example of change in the arrangement of the buffer tank in the device body 12.

In a X-Y-Z coordinate system shown in each diagram, a X direction indicates a main scanning direction (movement direction) of the carriage, that is, a width direction of a recording device, a Y direction indicates a depth direction of the recording device, and a Z direction indicates a device height direction. In each diagram, it is assumed that a +X direction side is a device left side, a −X direction side is a device right side, a +Y direction side is a device front surface side, a −Y direction side is a device rear surface side, a +Z axis direction side is a device upward side, and a −Z axis direction side is a device lower side. The coordinate system in the third embodiment is the same as the coordinate systems in the first embodiment and the second embodiment.

D-1. Overview of Printer:

A printer 10 as an example of the "liquid jetting device" will be described with reference to FIG. 11 to FIG. 14. The printer 10 includes a device body 12, and a scanner 14 arranged in an upper part of the device body 12 so as to be rotatable with respect to the device body 12.

An operation part 16 is provided in the front surface side of the device depth direction of the device body 12. A display means such as a liquid crystal panel as shown in FIG. 11 to FIG. 14 and an input means including a plurality of input buttons, switches, and the like, are provided in the operation part 16. As shown in FIG. 12, the operation part 16 is attached in the front side of the device depth direction so as to be rotatable with respect to the device body 12.

As shown in FIG. 12, when the operation part 16 is rotated in the front surface side of the device depth direction with respect to the device body 12, a medium discharge tray 18 stored in the device body 12 is exposed. The medium discharge tray 18 is configured to be able to advance and retract between a position in which the medium discharge tray 18 is stored in the device body 12 (see a solid lined part of FIG. 12) and a position in which the medium discharge tray 18 is drawn from the device body 12 to the front surface side of the device depth direction.

With reference to FIG. 14, a power supply part 44 that supplies power to a drive element in the printer 10 and extends in a device width direction is arranged in a rear surface side of the operation part 16 in the device depth direction. The power supply part 44 supplies power to a control part not shown and provided in the device body 12.

A medium storage part 20 that can accommodate the medium is mounted in the lower side of the device height direction of the medium discharge tray 18 in the device body 12 so as to be able to be inserted to or drawn from the front surface side of the device depth direction with respect to the device body 12.

With reference to FIG. 13, the scanner 14 is configured to be rotatable with respect to the device body 12 with the rear surface side of the device depth direction as a rotation fulcrum, and can be switched in between a closing posture with respect to the device body 12 (see FIG. 11 and FIG. 12) and an opening posture (see FIG. 13).

In FIG. 11 to FIG. 14, an ink tank part 21 is provided in the front surface side of the device depth direction of a right end part of the device width direction of the device body 12. The ink tank part 21 includes a plurality of ink tanks 22 (see FIG. 16 and FIG. 17), a casing 23 covering the plurality of ink tanks 22, and a cover 24 attached so as to be rotatable with respect to the casing 23. The ink tank 22, and a buffer tank 56 and a waste liquid tank 58 described later are configured as a non-mobile fluid storage container 59.

The ink tank part 21 is arranged so as to be located below the scanner 14 in a posture in which at least part of the scanner 14 is closed in the device width direction. In the present embodiment, the ink tanks 22 are provided by five, inks of black, magenta, yellow, cyan, and photo black as "liquid" are accommodated in the ink tanks 22, respectively. A display part 21*a* with which a residual amount of the ink in each ink tank 22 can be checked is provided in the front surface side of the device depth direction of the ink tank part 21.

When the scanner 14 takes the opening posture with respect to the device body 12, the cover 24 provided in the upper part of the casing 23 in the ink tank part 21 and covering the upper part of the ink tank 22 is completely exposed. The cover 24 is attached so as to be rotatable with respect to the casing 23. In a state where the cover 24 is completely exposed, as shown in FIG. 13, the upper part of the ink tank 22 can be exposed by rotating the cover 24 with respect to the casing 23. The configuration of the ink tank 22 will be described later.

Next, with reference to FIG. 14, the carriage 26 is arranged in the rear surface side of the ink tank part 21 in the device depth direction. As an example, the carriage 26 is configured to be able to reciprocate in the device width direction in the device body 12. For more particular explanation of the drive mechanism of the carriage 26, a drive motor 28 is provided in the rear surface side of the carriage 26 in the device depth direction.

A drive pulley not shown is provided in a drive axis of the drive motor 28. A driven pulley 30 is provided in the device body 12 so as to be driven and rotatable with respect to the drive pulley, with an interval in the device width direction with respect to the drive pulley (not shown). An endless belt 32 (see also FIG. 16) extends around the drive pulley (not shown) and the driven pulley 30. Although not shown, at least part of the endless belt 32 is gripped by the carriage 26 in the end part of the rear surface side of the carriage 26. When the drive motor 28 rotates and drives, the endless belt 32 is rotated and driven in the same direction as the rotation direction of the drive motor 28, and moves the carriage 26 in the device width direction. As an example, a position of the carriage 26 shown in FIG. 14 is set as a home position of the carriage 26 in the device body 12.

As shown in FIG. 14, a plurality of relay adapters 34 are mounted to the carriage 26. Each of the relay adapters 34 are connected to the ink tank 22 via the ink supply tube 36 serving as the "liquid supply channel member". As shown in FIG. 15, a recording head 38 serving as the "liquid jetting part" is provided in a lower part of the carriage 26. A plurality of nozzles that jet the ink are provided in a lower surface of the recording head 38.

In FIG. 14, a medium support member 40 extending in the device width direction is provided below the recording head 38. A conveyance roller pair 42 is provided in a rear surface side of the medium support member 40 in the device depth direction.

For explanation of recording operation of the medium of the printer 10, the medium accommodated in the medium storage part 20 is sent to the conveyance roller pair 42 by a sending means not shown. Then, the conveyance roller pair 42 nips the medium, and sends the medium to a region facing to the recording head 38 in a lower side of the recording head 38. The medium supported by the medium support member 40 receives the ink jetted from the nozzle of the recording head 38 in a surface facing to the recording head 38. Thereby, recording is performed in the surface facing to the recording head 38 in the medium. The medium performed with the recording is discharged to the medium discharge tray 18 projecting the front surface side of the device depth direction of the device body 12.

D-2. Ink Supply Unit:

Next, the ink supply unit 46 will be described with reference to FIG. 16 to FIG. 25. With reference to FIG. 16, the ink supply unit 46 is configured to be able to be mounted and removed with respect to the device body 12, and composes part of the device body 12 in a mounted state to the device body 12. As an example, the ink supply unit 46 is attached to the device body 12 via a tightening member 48. In the present embodiment, the tightening member 48 is configured as a screw member. With reference to FIG. 17 to FIG. 19, two tightening parts 52*a* are provided in positions closer to the front surface of the device depth direction of a base member 52. With reference to FIG. 17, FIG. 18, and FIG. 21, the tightening part 52*b* is provided in a rear surface side end part of the device depth direction of the base member 52. In the present embodiment, two tightening members 48 are passed through for each of the tightening parts 52*a*, 52*b*, and the tightening member 48 is tightened with respect to the device body 12. Thereby, the ink supply unit 46 is tightened to the device body 12. That is, the ink supply unit 46 is mounted to the device body 12 via four tightening members 48.

Next, the configuration of the ink supply unit 46 will be described in detail with reference to FIG. 17. A maintenance unit 50 described later with reference to FIG. 17, FIG. 18, and FIG. 23 is shown in the ink supply unit 46 side for convenience of explanation. However, as shown in FIG. 16, the maintenance unit 50 is arranged in the device body 12 side.

With reference to FIG. 17, the ink supply unit 46 includes a base member 52 mounted to the device body 12. The base member 52 includes: an ink tank 22, a first container holding member 54 serving as a "container holding member" and a "cover member", a buffer tank 56 serving as a "first fluid storage container", a waste liquid tank 58 serving as a "second fluid storage container, and a second container holding member 60.

As shown in FIG. 17, the plurality of ink tanks 22 are arranged in the front surface side of the device depth direction of the base member 52. The buffer tank 56 and the waste liquid tank 58 are arranged in the rear surface side of the device depth direction of the base member 52. In the device depth direction of the base member 52, the maintenance unit 50 is arranged in the interval between the ink tank 22 and the buffer tank 56 and the waste liquid tank 58.

D-3. Regarding Ink Tank

With reference to FIG. 17 and FIG. 19, in the present embodiment, the ink tank 22 includes five ink tanks 22A, 22B, 22C, 22D, 22E (hereinafter, when not being distinguished, simply referred to as the ink tank 22). The ink tank 22A has a larger width dimension than the other ink tanks 22B, 22C, 22D, 22E in the device width direction. That is, ink storage capacity of the ink tank 22A is set to be larger than the ink storage amount of the other ink tanks 22B, 22C, 22D, 22E. In the present embodiment, the ink tank 22A stores the black ink.

As shown in FIG. 22, the ink tank 22 includes an ink storage part 22*a* extending in a front and back direction of the device depth direction in the lower side of the device height direction, and an ink inlet part 22*b* projecting from the ink storage part 22*a* toward upward of the device height direction. An ink inlet port 22*d* is provided in an upper part of the ink inlet part 22*b*.

As shown in FIG. 13 and FIG. 14, an ink tank inlet cover 62 that can be switched in between a closing state of the ink inlet port 22*d* and an opening state, is attached to the ink tank part 21 so as to be rotatable. With reference to FIG. 19, an ink supply tube 36 that supplies the ink to the recording head 38 of the carriage 26 is connected to the lower part of the rear surface side of the device depth direction of the ink storage part 22*a* of each ink tank 22. One end of a connection tube 64 serving as a "first flow channel member" and a "connection flow channel member" is connected to an upper part of the ink inlet part 22*b* of each ink tank 22.

Two of each ink supply tube 36 and the connection tube 64 are drawn from the ink tank 22A provided in the most leftward in the device width direction in the present embodiment. The ink supply tube 36 and the connection tube 64 will be described later. In the present embodiment, the ink supply tube 36, the connection tube 64, and a first waste liquid tube 78 and a second waste liquid tube 80 described later compose a flow channel member 65. The flow channel member 65 is configured as a flexible tube member, as an example.

D-4. Regarding Maintenance Unit:

As shown in FIG. 17 and FIG. 23, the maintenance unit 50 includes a cap part 66 and a suction pump 68, as an example. The cap part 66 is located in the lower side of the device height direction of the recording head 38 of the carriage 26 when the carriage 26 is located in the home position.

The cap part 66 includes a cap 66*a* that can be switched in between a cap state of capping the recording head 38, and a non-cap state of separating from the recording head 38 in a state where the carriage 26 is located in the home position. The cap part 66 and the suction pump 68 are connected by the waste ink tube 70 shown in FIG. 23. When the suction pump 68 is driven in the cap state where the cap 66*a* caps the recording head 38, a negative pressure is generated in the cap 66*a* via a waste ink tube 70 connecting the cap part 66 and the suction pump 68. Suction of the ink is performed from the nozzle in the recording head 38 by the negative pressure, and clogging and air bubble mixing of the nozzle can be solved. The waste ink generated in the cap part 66 is sucked by the suction pump 68 via the waste ink tube 70.

D-5. Regarding Waste Liquid Tank:

Here, with reference to FIG. 18, a waste liquid tank mounting part 72 is provided in the rear surface side of the device depth direction of the maintenance unit 50 in the base member 52. The waste liquid tank 58 is mounted so as to be able to be inserted to and drawn from the waste liquid tank mounting part 72 from the rear surface side of the device depth direction of the base member 52. The waste liquid tank 58 is configured to be able to accommodate waste liquid (waste ink) sucked in the cap part 66, in the state of being mounted to the waste liquid tank mounting part 72. The flow channel and the like between the maintenance unit 50 and the waste liquid tank 58 will be described later.

D-6. Regarding First Container Holding Member:

Next, the first container holding member 54 will be described with reference to FIG. 19 and FIG. 20. The first container holding member 54 extends along the device depth direction. As shown in FIG. 17, the first container holding member 54 is attached to the base member 52 so as to cover an upper part of at least part of the waste liquid tank 58.

With reference to FIG. 20, a buffer tank holding part 54*a* that holds the buffer tank 56 in the rear surface side of the device depth direction is formed the first container holding member 54. A connection tube accommodation part 54*b* is extended and installed toward the front surface side of the device depth direction, in the front surface side of the device depth direction of the buffer tank holding part 54*a* in the first container holding member 54. An ink supply tube accommodation part 54*c* that extends toward left in the device width direction is provided in the front surface side end part of the device depth direction of the connection tube accommodation part 54*b*.

In a state where the first container holding member 54 is attached to the base member 52, as shown in FIG. 19 and FIG. 22, at least part of the connection tube accommodation part 54*b* and the ink supply tube accommodation part 54*c* is located above the ink storage part 22*a* of the ink tank 22 in the device height direction, and covers the ink storage part 22*a*.

As shown in FIG. 19, the ink supply tube 36 of which one end is connected to the ink storage part 22*a* of each ink tank 22 is held by the ink supply tube accommodation part 54*c* of the first container holding member 54 and is guided, and extends in left in the device width direction, and then, is connected to the relay adapter 34 (see FIG. 14) of the carriage 26 in the other end of the ink supply tube 36.

With reference to FIG. 21, a plurality of buffer tanks 56A, 56B, 56C, 56D, 56E (hereinafter, when not being distinguished, simply referred to as the buffer tanks 56) are arranged in the buffer tank holding part 54*a* of the first container holding member 54. The buffer tanks 56 are provided by the same number as the ink tanks 22. The buffer tanks 56A, 56B, 56C, 56D, 56E correspond to the ink tanks 22A, 22B, 22C, 22D, 22E. Particularly, the other end of the connection tube 64 connected to the corresponding ink tank 22 is connected to each buffer tank 56. In the present embodiment, the other ends of two connection tubes 64 connected to the ink tank 22A are connected to the buffer tank 56A.

As an example, in right of the device width direction, the four buffer tanks 56E, 56D, 56C, 56B having the same capacity are arranged in series from the front surface side of the device depth direction to the rear surface side. In left of the device width direction, the buffer tank 56A having larger capacity than the four buffer tanks 56B, 56C, 56D, 56E is arranged.

As shown in FIG. 17 and FIG. 23, the second container holding member 60 is attached to the first container holding member 54 so as to cover the plurality of buffer tanks 56. Each connection tube 64 is drawn from each buffer tank 56 to above the second container holding member 60. In the present embodiment, the plurality of buffer tanks 56 are arranged above the waste liquid tank 58 in the device height direction. At least part of the plurality of buffer tanks 56 and at least part of the waste liquid tank 58 are arranged so as to be overlapped in at least one of the device width direction and the device depth direction.

As shown in FIG. 17 and FIG. 23, the first flow channel holding part 74 serving as the "flow holding part" is provided above the second container holding member 60. The first flow channel holding part 74 prevents the connection tube 64 from being lifted in the upper side of the device height direction above the second container holding member 60. The first flow channel holding part 74 gathers the connection tubes 64 drawn from each buffer tank 56 in a bundle shape, and guide the connection tubes 64 to the front surface side of the device depth direction.

The connection tube 64 extends in the lower side of the device height direction in the front surface side end part of the device depth direction of the second container holding member 60, and is received by the connection tube accommodation part 54*b* of the first container holding member 54. The connection tube 64 extends in the front surface side of the device depth direction, along the connection tube accommodation part 54*b*. After extending to the rear surface side of the ink inlet part 22*b* of the ink tank 22 in the device depth direction, the connection tube 64 changes the direction to the device the upper side of the device height direction, and is connected to the upper portion the ink inlet part 22*b*.

A second flow holding part 76 serving as the "flow channel holding part" is provided in the connection tube accommodation part 54*b*. The second flow channel holding part 76 holds at least part of the connection tube 64 extending in the device depth direction in the connection tube accommodation part 54*b*, and prevents the connection tube 64 from being uplifted in the device height direction. In the present embodiment, the connection tube 64 is configured to be a multiple tube in which three connection tubes 64 are integrated. According to this configuration, the connection tube 64 is configured so that, in the second flow channel holding part 76, when one among the integrated three connection tubes 64 is held, the other two are also held in the connection tube accommodation part 54*b*.

D-7. Relationship Between Ink Tank and Buffer Tank:

Now, the relationship between the ink tank 22 and the buffer tank 56 will be described with reference to FIG. 22. Each buffer tank 56 is connected to the ink tank 22 by the connection tube 64. For example, when the temperature around the printer 10 increases, if the ink inlet port cover 62 blocks the ink inlet port 22*d*, the pressure in the ink tank 22 increases, and the ink stored in the ink tank 22 may be pushed out to the buffer tank 56.

As an example, the ink storage amount in each buffer tank 56 is set to be substantially the same as the ink storage amount of the ink tank 22 connected by the connection tube 64, or more than the amount. Accordingly, even when the ink accommodated in the ink tank 22 flows in the buffer tank 56, the ink is prevented or suppressed from leaking from the buffer tank 56. The ink tank 22 communicates with the atmosphere via the buffer tank 56.

The dot line added with the reference sign IL shown in FIG. 22 indicates the maximum height of the liquid level of the ink accommodated in the ink tank 22 in the device height direction. As an example, the bottom surface 56*a* of the ink storage space of the buffer tank 56 is set to be the height corresponding to the maximum height IL of the liquid level of the ink accommodated in the ink tank 22. It is desirable that the height of the buffer tank 56 in the device height direction of the bottom surface 56*a* of the ink storage space is set to be a higher position than the maximum height IL.

According to this configuration, for example, in a state where the atmospheric pressure in the ink tank 22 increases and the ink has flown in the buffer tank 56, the ink inlet port cover 62 is rotated so that the ink inlet port 22*d* or the temperature around the printer 10 decreases, and thereby, the atmospheric pressure in the ink tank 22 decreases. Thus, the ink in the buffer tank 56 returns to the ink tank 22 via the connection tube 64.

D-8. Regarding Relationship Between Maintenance Unit and Waste Liquid Tank:

Next, the relationship between the maintenance unit 50 and the waste liquid tank 58 will be described with reference to FIG. 18, FIG. 21, FIG. 23, and FIG. 24. With reference to FIG. 18 and FIG. 23, the maintenance unit 50 and the waste liquid tank mounting part 72 are connected by the first waste liquid tube 78 and the second waste liquid tube 80 serving as the "waste liquid flow channel member" and the "second flow channel member". The first waste liquid tube 78 and the second waste liquid tube 80 are connected by a joint member 82.

As shown in FIG. 23, one end of the first waste liquid tube 78 is connected to the maintenance unit 50, more particularly, the suction pump 68. The first waste liquid tube 78 extending from the suction pump 68 extends in the connection tube accommodation part 54*b* of the first container holding member 54, and is held in the second flow channel holding part 76.

With reference to FIG. 24, the first waste liquid tube 78 that has guided into the connection tube accommodation part 54*b* is located above the connection tube 64 in the device height direction. The first waste liquid tube 78 extends in the device depth direction by making one round around the second flow channel holding part 76 in a clockwise direction in FIG. 24 as an example. As shown in FIG. 23, the other end of the first waste liquid tube 78 is connected to the second waste liquid tube 80 by the joint member 82. In FIG. 24, illustration of the joint member 82 and the second waste liquid tube 80 is omitted.

In the present embodiment, the first waste liquid tube 78 is configured to make round around the second flow channel holding part 76. However, the first waste liquid tube 78 may be configured to extend in the device depth direction without making a round around the second flow channel holding part 76 as appropriate according to the length of the first waste liquid tube 78, or may be configured to make two or more rounds around the second flow channel holding part 76. That is, the second flow channel holding part 76 not only holds above the first waste liquid tube 78 so that the first waste liquid tube 78 is not uplifted in the upper side of the device height direction, but also functions as a length adjustment part of the first waste liquid tube 78.

Next, as shown in FIG. 21, one end of the second waste liquid tube 80 is connected to the joint member 82. The second waste liquid tube 80 extends out from the connection tube accommodation part 54*b*, and extends in the lower side of the device height direction, and the other end of the second waste liquid tube 80 is connected to the waste liquid tank mounting part 72. Accordingly, in a state where the waste liquid tank 58 is mounted to the waste liquid tank mounting part 72, the suction pump 68 of the maintenance unit 50 is connected with the waste liquid tank 58 via the first waste liquid tube 78, the joint member 82, the second waste liquid tube 80, and the waste liquid tank mounting part 72. Thereby, the waste liquid (waste ink) sucked by the suction pump 68 is sent to the waste liquid tank 58, and is accommodated in the waste liquid tank 58.

D-9. Regarding Relationship Between Waste Liquid Tank and Control Part:

Next, the relationship between the waste liquid tank 58 and the control part will be described with reference to FIG. 23 and FIG. 25. A control part not shown is provided in the device body 12 of the printer 10. This control part is configured as a circuit board including a plurality of electric components, and controls operation of the printer 10, or the like. A cable 84 serving as the "electric wiring" extends from the control part not shown to the waste liquid tank mounting part 72. As an example, the cable 84 is configured as a flexible flat cable (FFC).

As shown in FIG. 14, the cable 84 extends from left to right in the device width direction in the front surface side of the device depth direction of the movement region of the carriage 26. As shown in FIG. 23, the cable 84 changes the direction from the device width direction to the device depth direction, in the rear surface side of the device depth direction of the ink storage part 22*a* of the ink tank 22, and extends to the rear surface side of the device depth direction along the side part of the connection tube accommodation part 54*b* of the first container holding member 54.

The cable 84 that has extended in the rear surface side of the device depth direction along the side part of the connection tube accommodation part 54*b* is held in the wiring holding part 54*d* provided in between the buffer tank holding part 54*a* and the connection tube accommodation part 54*b* in the first container holding member 54, extends in the lower side of the device height direction, and is connected to the waste liquid tank mounting part 72. As shown in FIG. 25, a contact terminal 86 is provided in the waste liquid tank mounting part 72. The connection terminal 86 is connected to the cable 84.

A storage medium (not shown) is provided in a position corresponding to the contact terminal 86 shown in FIG. 25, in the waste liquid tank 58. The storage medium is configured to hold information on the waste ink storage amount in the waste liquid tank 58, and the like. In a state where the waste liquid tank 58 is mounted to the waste liquid tank mounting part 72, the storage medium of the waste liquid tank 58 and the contact terminal 86 contact with each other, and the storage medium and the connection terminal 86 are electrically connected. Thereby, the information stored in the storage medium of the waste liquid tank 58 is transmitted to the control part not shown provided in the device body 12.

D-10. Variation of Third Embodiment (1) The third embodiment has the configuration in which the first flow channel holding part 74 is provided in the second container holding member 60 covering the upper portion of the buffer tank 56. However, a configuration may be adopted, in which the buffer tank 56 is not covered by the second container holding member 60, and the first flow channel holding part 74 is provided in the upper portion of the buffer tank 56 to hold the connection tube 64.

(2) The third embodiment has the configuration in which the wiring holding part 54*d* holding the cable 84 is provided in the first container holding member 54. Instead of this configuration, a configuration may be adopted, in which the cable 84 is held by the buffer tank 56, or the like.

(3) The third embodiment has the configuration in which the maintenance unit 50 is provided in the device body 12 side. Instead of this configuration, a configuration may be adopted, in which the maintenance unit 50 may be provided in the ink supply unit 46 side.

(4) The third embodiment has a configuration in which the buffer tanks 56A, 56B, 56C, 56D, 56E are arranged in two arrays in the device width direction, in the buffer tank holding part 54*a* of the first container holding member 54.

However, instead of this configuration, as shown in FIG. 26 and FIG. 27, the buffer tanks 56 may be arranged in one array in the device width direction. Particularly, as shown in FIG. 27, only the buffer tank holding part 88*a* is provided in the first container holding member 88, without the connection tube accommodation part provided. As an example, the buffer tanks 56 may be arranged in series so that the buffer tank 56A is located in the most rear surface side of the device depth direction.

(5) The third embodiment has a configuration in which the first container holding member 54 and the buffer tank 56 are arranged in the rear surface side of the ink tank part 21 in the device depth direction. However, instead of this configuration, as shown in FIG. 28 and FIG. 29, a configuration may be adopted, in which the first container holding member 54 and the buffer tank 56 are arranged along the device width direction in the position in which the power supply part 44 is provided in the present embodiment, that is, the rear surface side of the device depth direction of the operation part 16. In this case, a configuration is such that the plurality of buffer tanks 56 are arranged in series along the device width direction.

As a conclusion of the description described above, the printer 10 includes: the recording head 38 having the nozzle that can jet the ink; the non-mobile fluid storage container 59 that can accommodate at least one of the ink and the gas, and does not move together with the recording head 38; the flow channel member 65 connected to the fluid storage container 59; and the first flow channel holding part 74 that is located in the upper portion of the fluid storage container 59, and can hold the connection tube 64.

According to the configuration described above, since the first flow channel holding part 74 that can hold the connection tube 64 is located in the upper portion of the fluid storage container 59, the printer 10 can be prevented from increasing in size in the plan surface direction. Since the first flow channel holding part 74 is located in the upper portion of the fluid storage container 59, work can be performed from above in device assembly, and workability is improved. "Being located in the upper portion" in "the first flow channel holding part 74 is located in the upper portion of the fluid storage container 59" means that the first flow channel holding part 74 is located above the fluid storage container 59 in the positional relationship in the height direction, is not limited to a mode in which the first flow channel holding part 74 is directly provided on the fluid storage container 59, and includes a mode in which the first flow channel holding part 74 is arranged on the fluid storage container 59 via the other member.

The first flow channel holding part 74 is included in the fluid storage container 59, and the second container holding member 60 holding the fluid storage container 59. The second flow channel holding part 76 is included in the first container holding members 54, 88 holding the fluid storage container 59 (buffer tank 56). According to this configuration, the first flow channel holding part 74 that can hold the connection tube 64 is included in the fluid storage container 59 or the second container holding member 60 holding the fluid storage container 59, and the second fluid holding part 76 that can hold the connection tube 64 is included in the first container holding members 54, 88 holding the fluid storage container 59 (buffer tank 56). Thus, as compared to the configuration in which the first flow channel holding part 74 and the second flow channel holding part 76 are provided in different places from the fluid storage container 59 and the first container holding members 54, 88, the components related to the ink are made compact, the device can be prevented from increasing in size, or the assembly work of the device is facilitated.

The fluid storage container 59 includes the buffer tank 56, and the waste liquid tank 58 that overlaps at least partially with the buffer tank 56 when plan-viewed in the height direction. According to this configuration, in the configuration in which the plurality of fluid storage containers 59 are provided, particularly, the device can be prevented from increasing in size in the plan direction.

The buffer tank 56 is located above the waste liquid tank 58. The flow channel member 65 includes the connection tube 64 connected to the buffer tank 56, and the first waste liquid tube 78 and the second waste liquid tube 80 connected to the waste liquid tank 58. At least the connection tube 64 among the connection tube 64, the first waste liquid tube 78, and the and the second waste liquid tube 80 is held above the buffer tank 56. According to this configuration, the installation work of the connection tube 64 may be performed from above, and the workability is facilitated.

The fluid storage container 59 includes the buffer tank 56, and the waste liquid tank 58 that overlaps at least partially with the buffer tank 56 in the height direction. The buffer tank 56 is located above the waste liquid tank 58. The flow channel member 65 includes the connection tube 64 connected to the buffer tank 56, and the first waste liquid tube 78 and the second waste liquid tube 80 connected to the waste liquid tank 58. The connection tube 64, the first waste liquid tube 78, and the second waste liquid tube 80 are held in the second flow channel holding part 76 above the first container holding members 54, 88 holding the buffer tank 56 so that one of the connection tube 64, the first waste liquid tube 78, and the second waste liquid tube 80 overlaps with the other.

According to the configuration described above, the connection tube 64, the first waste liquid tube 78, and the second waste liquid tube 80 are held in the second flow channel holding part 76, in above the first container holding members 54, 88 holding the buffer tank 56. Thus, the installation space of the connection tube 64, the first waste liquid tube 78, and the second waste liquid tube 80 can be prevented from increasing according to expansion of the connection tube 64, the first waste liquid tube 78, and the second waste liquid tube 80 in the horizontal direction. The connection tube 64, and the first waste liquid tube 78 and the second waste liquid tube 80 are held in the second flow channel holding part 76 so that one of the connection tube 64, and the first waste liquid tube 78 and the second waste liquid tube 80 overlaps with the other. Thus, the one flow channel member can prevent the other flow channel member, and as compared to the configuration in which a dedicated uplift prevention member is provided in both the flow channel members, the installation space of the flow channel member can be prevented from increasing in the height direction. In addition, since uplifting of the flow channel member is prevented, the interference of the printer 10 with the other component can be prevented.

The wiring holding part 54*d* holding the cable 84 is included in the liquid storage container 59 or the first container holding members 54, 88. According to this configuration, as compared to a case where the dedicated space for installation of the wiring holding part 54*d* is secured, the device can be prevented from increasing in size.

The printer 10 includes: the recording head 38 having the nozzle that can inject the ink; the ink tank 22 that can accommodate at least one of the ink and the gas; the connection tube 64 connected to the ink tank 22; the buffer tank 56 connected to the ink tank 22 by the connection tube 64; the ink supply tube 36 that supplies the ink from the ink tank 22 to the recording head 38; and the first container holding member 54 that covers at least part of the ink tank 22 and the buffer tank 56. The first container holding member 54 includes the second flow channel holding part 76 and the ink supply tube accommodation part 54*c* that hold the connection tube 64 and the ink supply tube 36.

According to the configuration described above, the first container holding member 54 that covers at least part of the ink tank 22 and the buffer tank 56 includes the second flow channel holding part 76 and the ink supply tube accommodation part 54*c* that hold the connection tube 64 and the ink supply tube 36. Thus, as compared to the configuration in which the second flow channel holding part 76 and the ink supply tube accommodation part 54*c* are provided in different positions with respect to the dedicated installation members, the components related to the ink are made compact, the device can be prevented from increasing in size, or the assembly work of the device is facilitated.

The waste liquid tank 58 that collects the waste liquid (waste ink) discharged via the nozzle of the recording head 38, the first waste liquid tube 78 and the second waste liquid tube 80 that are connected to the waste liquid tank 58, for collecting the waste liquid are included, the second flow channel holding part 76 holds the first waste liquid tube 78 and the second waste liquid tube 80. According to this configuration, since the second flow channel holding part 76 holds the first waste liquid tube 78 and the second waste liquid tube 80, the components related to the ink are made compact, the device can be prevented from increasing in size, or the assembly work of the device is facilitated.

The second flow channel holding part 76 holds the connection tube 64, the first waste liquid tub 78, and the second waste liquid tube 80 so that the connection tube 64, the first waste liquid tub 78, and the second waste liquid tube 80 overlap with each other in the height direction. According to this configuration, the installation space of the connection tube 64, the first waste liquid tube 78, and the second waste liquid tube 80 can be prevented from increasing according to the expansion of the connection tube 64, the first waste liquid tube 78, the second waste liquid tube 80 in the horizontal direction. The connection tube 64, the first waste liquid tube 78, and the second waste liquid tube 80 are held in the second flow channel holding part 76 so that one of the connection tube 64, and the first waste liquid tube 78 and the second waste liquid tube 80 overlaps with the other. Thus, one flow channel member can prevent uplifting of the other flow channel member, and as compared to the configuration in which the dedicated uplift prevention member is provided in both flow channel members, the installation space of the flow channel member can be prevented from increasing in the height direction. In addition, since the uplifting of the flow channel member is prevented, interference of the printer 10 with the other components also can be prevented.

The first container holding members 54, 88 include the wiring holding part 54*d* holding the cable 84. According to this configuration, as compared to a case where the dedicated space for installation of the wiring holding part 54*d* is secured, the device can be prevented from increasing in size.

The ink tank 22 and the buffer tank 56 are arranged with an interval along the front and back direction of the printer 10, at least part of the maintenance unit 50 that causes the ink to be discharged from the nozzle of the recording head 38 is arranged in the interval. According to this configuration, the device can be prevented from increasing in the right and left direction by arranging the ink tank 22, the buffer tank 56, and the maintenance unit 50 along the device front and back direction.

The ink tank 22 and the buffer tank 56 are arranged along the device right and left direction of the printer 10. According to this configuration, the device can be prevented from increasing in size in the front and back direction.

The printer 10 includes: the recording head 38 having the nozzle that can jet the ink; the plurality of ink tanks 22; the buffer tanks 56 connected to the plurality of ink tanks 22 via the connection flow channel member; and the holding member 54 that integrally holds the plurality of buffer tanks 56. Since the plurality of buffer tanks 56 are integrally held in the holding member, the buffer tanks 56 are easy to be compact, and increase in size can be prevented.

In the present embodiment, the buffer tank 56 and the waste liquid tank 58 according to the present invention are applied to the inkjet printer as an example of the liquid jetting device. However, the buffer tank 56 and the waste liquid tank 58 can be applied other general liquid jetting devices. Here, the liquid jetting device is not limited to recording devices such as a printer, a copy machine, and facsimile in which an inkjet recording head is used, for performing recording to the recording medium by discharging the ink from the recording head. The liquid jetting device includes the device that jets, instead of the ink, liquid corresponding to the use purpose of the ink, from the liquid jetting head corresponding to the inkjet recording head to the recording medium, to make the liquid adhere to the medium performed with the jetting.

E. Other Variation

The present invention can be applied not only to the inkjet printer, and the liquid supply device for supplying the ink to the inkjet printer, but also to any liquid jetting device that jets other liquid than ink, and a liquid supply device for storing the liquid. For example, the present invention can be applied to the various liquid jetting devices and the liquid supply device thereof as below.

(1) An image recording device such as a facsimile device
(2) A color material jetting device used for manufacturing of a color filter for an image display device such as a liquid crystal display
(3) An electrode material jetting device used for electrode formation such as an electro luminescence display, or a field emission display (FED)
(4) A liquid jetting device that jets liquid including a bio-organic matter used for biochip manufacture
(5) A sample jetting device as a precision pipette
(6) A jetting device of lubricant
(7) A jetting device of resin solution
(8) A liquid jetting device that jets lubricant in pinpoint to a precision machine such as a clock or a camera
(9) A liquid jetting device that jets transparent resin solution such as an ultraviolet ray curable resin solution to a substrate for forming a micro hemispherical lens (optical lens) used in an optical communication element
(10) A liquid jetting device that jets acid or alkaline etching solution for etching a substrate or the like
(11) A liquid jetting device including a liquid jetting head for discharging a minute amount of any other droplets The "droplet" refers to a state of liquid discharged from the liquid jetting device, and includes ones that leave traces of a granular shape, a tear shape, or a thread shape. The "liquid" here may be a material that can be jet by the liquid jetting device. For example, the "liquid" may be a material in a state where a substance is in a liquid phase. A material in a liquid state such as a material in a liquid state with high or low viscosity, sol, gel water, other inorganic solvent, organic solvent, liquid resin, or liquid metal (metal melt). The "liquid" includes not only liquid as a state of a substance, but also ones obtained by dissolving, dispersing, or mixing a particle of a functional material formed of a solid such as a pigment or a metal particle, in a solvent. Representative examples of the liquid include the ink, the liquid crystal, and the like that are described in the embodiments described above. Here, the ink includes various liquid compositions such as a general water based ink, oil based ink, gel ink, and hot-melt ink.

The present invention is not limited to the embodiments, examples, and modifications described above, and can be performed in various configurations without departing from the spirit of the invention. For example, the technical features in the embodiments, and variations corresponding to the technical features in each embodiment described in Summary of the Invention may be changed or combined as appropriate, in order to solve a part or all of the problem described above, or achieve a part or all of the effects described above. If the technical features are not described in this specification as essential, the technical features can be deleted as appropriate.

The present invention is not limited to the embodiment described above, and can be performed with various modifications. Needless to say, such modifications are included in the scope of the present invention.

The configuration of the printer 110 of the first embodiment and the second embodiment, and the configuration of the printer 10 of the third embodiment can be combined with each other as appropriate. The configuration of the liquid supply device 150 of the first embodiment and the second embodiment, and the configuration of the ink supply unit 46 of the third embodiment can be combined with each other as appropriate. The liquid storage chambers 162, 162*a* in the first embodiment and the second embodiment correspond to the ink tank 22 in the third embodiment. The air storage chambers 172, 172*a* in the first embodiment and the second embodiment correspond to the buffer tank 56 in the third embodiment. The connection channel 562, 562*a* in the first embodiment and the second embodiment correspond to the connection tube 64 in the third embodiment. The holding members 155, 155A, 155B in the first embodiment and the second embodiment correspond to the base member 52 in the third embodiment.

REFERENCE SIGNS LIST

1: Liquid jetting system, 110: Printer, 111: Operation panel, 112: Casing, 114: Liquid jetting head, 116: Discharge part, 118: Carriage, 118*a*: Liquid supply needle, 119: Control part, 120, 120C, 120M, 120Y, 120K: Sub tank, 125: Carriage unit, 130: Accommodation member, 140: Front surface case, 141: Hinge, 145: Side surface case, 150, 150C, 150M, 150Y, 150K, 150T, 150*a*: Liquid supply device, 155, 155A, 155B: Holding member, 155B1: First holding member, 155B2: Second holding member, 156, 156*a*: Atmospheric communication channel, 160, 160*a*: First shell, 162, 162*a*: Liquid storage chamber, 163: Liquid outlet part, 164: Inside air storage chamber, 166, 166*a*: First shell side flow channel part, 168: Liquid inlet portion, 170, 170*a*: Second shell, 172, 172*a*: Air storage chamber, 176, 176*a*: Second shell side flow channel part, 177: Atmospheric opening part, 179: Atmospheric opening port, 199: Tube, 101: Front surface, 102: Rear surface, 103: Left side surface, 104: Right side surface, 105: Upper surface, 106: Bottom surface, 202: Liquid receiving part, 204: Liquid reservoir chamber, 206: Filter, 208: Liquid flowing channel, 502: First holding member, 503: Second holding member, 504: Bracket, 505: Screw, 506: Screw hole, 510: First bracket, 512: Screw, 514: Screw hole, 520: Second bracket, 522: Screw, 524: Screw hole, 562: Connection channel, 562*a*: First connection channel, 564: Second connection channel, 568: Connection forming member, 601: First liquid storage chamber wall, 602: Second liquid storage chamber wall, 603: Third liquid storage chamber wall, 604: Fourth liquid storage chamber wall, 605: Fifth liquid storage chamber wall, 606: Sixth liquid storage chamber wall, 607: Corner part, 615: Partition wall, 667: One end, 668, 668*a*: Air inlet port, 669: Other end, 681: Plug member, 690: Second upstream side connection port, 692: First downstream side connection port, 701: First air storage chamber wall, 702: Second air storage chamber wall, 703: Third air storage chamber wall, 704: Fourth air storage chamber wall, 705: Fifth air storage chamber wall, 706: Sixth air storage chamber wall, 764: Atmospheric side connection part, 766: Air side connection port, 766*a*: First upstream side connection port, 768: One end, 769: Other end, 772: Sheet member, d1: Water head difference, 10: Printer, 12: Device body, 14: Scanner, 16: Operation part, 18: Medium discharge tray, 20: Medium storage part, 21: Ink tank part, 21*a*: Display part, 22, 22A, 22B, 22C, 22D, 22E: Ink tank, 22*a*: Ink storage part, 22*b*: Ink inlet part, 22*d*: Ink inlet port, 23: Casing, 24: Cover, 26: Carriage, 28: Drive motor, 30: Driven pulley, 32: Endless belt, 34: Relay adapter, 36: Ink supply tube, 38: Recording head, 40: Medium support member, 42: Conveyance roller pair, 44: Power supply part, 46: Ink supply unit, 48: Tightening member, 50: Maintenance unit, 52: Base member, 52*a*, 52*b*: Tightening part, 54, 88: First container holding member, 54*a*: Buffer tank holding part, 54*b*: Connection tube accommodation part, 54*c*: Ink supply tube accommodation part, 54*d*: Wiring holding part, 56, 56A, 56B, 56C, 56D, 56E: Buffer tank, 56*a*: Bottom surface, 58: Waste liquid tank, 59: Fluid storage container, 60: Second container holding member, 62: Ink inlet port cover, 64: Connection tube, 65: Flow channel member, 66: Cap part, 66*a*: Cap, 68: Suction pump, 70: Waste ink tube, 72: Waste liquid tank mounting part, 74: First flow channel holding part, 76: Second flow channel holding part, 78: First waste liquid tube, 80: Second waste liquid tube, 82: Joint member, 84: Cable, 86: Contact terminal, 88*a*: Buffer tank holding part, IL: Maximum height

What is claimed is:

1. A liquid supply device for supplying liquid to a liquid jetting head, comprising:

a first shell having a liquid storage chamber configured to store the liquid, and a liquid inlet portion through which the liquid is poured into the liquid storage chamber;

a second shell that is a different member from the first shell;

a holding member for holding a mutual positional relationship between the first shell and the second shell to be constant; and an atmospheric communication channel that makes outside and the liquid storage chamber communicate with each other, the atmospheric communication channel including an air inlet port formed at a wall partitioning the liquid storage chamber, and serving as one end for leading air into the liquid storage chamber, an atmospheric opening port provided at the second shell and serving as an other end that opens outward, an air storage chamber included in the second shell and located between the atmospheric opening port and the air inlet port, and a connection channel connecting the first shell and the second shell and allowing fluid communication between the air storage chamber and the liquid storage chamber.

2. The liquid supply device according to claim 1, wherein the holding member is a member connected to part of the first shell and part of the second shell.

3. The liquid supply device according to claim 2, wherein the holding member is a member that connects the part of the first shell and the part of the second shell so that the second shell configured to be detached from the first shell.

4. The liquid supply device according to claim 1, wherein the holding member is a member for fixing the first shell and the second shell to an other member that is different from the liquid supply device.

5. The liquid supply device according to claim 4, wherein the other member is an accommodation member that accommodates the liquid supply device.

6. The liquid supply device according to claim 1, wherein the first shell includes an inside air storage chamber that composes part of the atmospheric communication channel, for storing the air, and allows fluid communication between the air storage chamber and the air inlet port.

7. The liquid supply device according to claim 6, wherein, in a flow direction of the air extending from the atmospheric opening port to the air inlet port, the air storage chamber includes a sheet member partitioning an upstream side portion and a downstream side portion, through which gas permeates and liquid does not permeate.

8. The liquid supply device according to claim 1, wherein the air inlet port is located in a region of a lower side of a vertical direction in the liquid storage chamber.

9. A liquid jetting system comprising:

the liquid supply device according to claim 1, the liquid jetting head, and a liquid supply flow channel that connects the liquid jetting head and the liquid supply device.

10. A liquid jetting device comprising:

a liquid jetting part having a nozzle configured to jet liquid;

a non-mobile fluid storage container configured to store at least one of the liquid and gas, and does not move together with the liquid jetting part;

a flow channel member connected to the fluid storage container; and a flow channel holding part that is configured to hold the flow channel member and that is located in an upper portion of the fluid storage container when the liquid jetting device is in a state in which the nozzle of the liquid jetting part jets liquid.

11. The liquid jetting device according to claim 10, wherein the flow channel holding part is included in the fluid storage container, or a container holding member holding the fluid storage container.

12. The liquid jetting device according to claim 10, wherein the fluid storage container includes a first fluid storage container, and a second fluid storage container that at least partially overlaps with the first fluid storage container when plan-viewed in a height direction.

13. The liquid jetting device according to claim 12, wherein the first fluid storage container is located upper than the second fluid storage container, the flow channel member includes a first flow channel member connected to the first fluid storage container, and a second flow channel member connected to the second fluid storage container, and at least the first flow channel member among the first flow channel member and the second flow channel member is held above the first fluid storage container.

14. The liquid jetting device according to claim 12, wherein the first fluid storage container is located upper than the second fluid storage container, the flow channel member includes a first flow channel member connected to the first fluid storage container, and a second flow channel member connected to the second fluid storage container, and the first flow channel member and the second flow channel member are held by the flow channel holding part so as to be above the container holding member holding the first fluid storage container, so that one of the first flow channel member and the second flow channel member overlaps with the other.

15. The liquid jetting device according to claim 11, wherein a wiring holding part that holds an electric wiring is included in the fluid storage container or the container holding member.

16. A liquid jetting device comprising:

a liquid jetting part having a nozzle configured to jet liquid;

a liquid tank configured to store the liquid;

a connection flow channel member connected to the liquid tank, a buffer tank connected to the liquid tank by the connection flow channel member;

a liquid supply channel member that supplies the liquid from the liquid tank to the liquid jetting part; and a cover member that covers at least part of the liquid tank and the buffer tank, the cover member including a flow channel holding part that holds the connection flow channel member and the liquid supply channel member.

17. The liquid jetting device according to claim 16, further comprising:

a waste liquid tank that collects waste liquid discharged via the nozzle of the liquid jetting part, and a waste liquid flow channel member that is connected to the waste liquid tank, and is for collecting the waste liquid, wherein the flow channel holding part holds the waste liquid flow channel member.

18. The liquid jetting device according to claim 17, wherein the flow channel holding part holds the connection flow channel member and the waste liquid flow channel member so that the connection flow channel member and the waste liquid flow channel member overlap with each other when plan-viewed in the height direction.

19. The liquid jetting device according to claim 16, wherein the cover member comprises a wiring holding part that holds an electric wiring.

20. The liquid jetting device according to claim 16, wherein the liquid tank and the buffer tank are arranged with an interval along a front and back direction of the liquid jetting device, and at least part of a maintenance unit that causes the liquid to be discharged from the nozzle of the liquid jetting part is arranged in the interval.

21. The liquid jetting device according to claim 16, wherein the liquid tank and the buffer tank are arranged along a right and left direction of the liquid jetting device.

22. A liquid jetting device comprising:

a liquid jetting part having a nozzle configured to jet liquid;

a plurality of liquid tanks configured to store the liquid;

buffer tanks connected to the plurality of liquid tanks respectively via a connection flow channel member; and a holding member that integrally holds the plurality of buffer tanks.

* * * * *